US007565818B2

(12) United States Patent
Thomas et al.

(10) Patent No.: US 7,565,818 B2
(45) Date of Patent: Jul. 28, 2009

(54) APPARATUS AND METHODS FOR MANUFACTURING CIGARETTES

(75) Inventors: Timothy Frederick Thomas, High Point, NC (US); Vernon Brent Barnes, Advance, NC (US); John Larkin Nelson, Lewisville, NC (US); August Joseph Borschke, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 343 days.

(21) Appl. No.: 11/375,700

(22) Filed: Mar. 14, 2006

(65) Prior Publication Data

US 2006/0272655 A1 Dec. 7, 2006

Related U.S. Application Data

(63) Continuation-in-part of application No. 11/143,889, filed on Jun. 1, 2005.

(51) Int. Cl.
*A24C 5/00* (2006.01)

(52) U.S. Cl. ..... 65/74; 65/70; 65/72

(58) Field of Classification Search ..... 131/70–76, 131/77

See application file for complete search history.

(56) References Cited

U.S. PATENT DOCUMENTS

| | | | |
|---|---|---|---|
| RE7,871 | E | 9/1877 | Nichols |
| 636,625 | A | 11/1899 | Brehm |
| 638,887 | A | 12/1899 | Root |
| 646,938 | A | 4/1900 | Andstem |
| 760,800 | A | 5/1904 | Nice |
| 828,611 | A | 8/1906 | Kobler |
| 969,376 | A | 9/1910 | Kiely |
| 1,064,568 | A | 6/1913 | Toplis |
| 1,075,050 | A | 10/1913 | Mihills |
| 1,196,387 | A | 8/1916 | Noon |
| 1,267,201 | A | 5/1918 | Fleming |
| 1,735,520 | A | 11/1929 | Williams |
| 1,892,143 | A | 12/1932 | Gordon |
| 2,296,772 | A | 9/1942 | Crist |
| 2,376,103 | A | 5/1945 | Wahl |
| 2,425,888 | A | 8/1947 | Matteson et al. |

(Continued)

FOREIGN PATENT DOCUMENTS

| | | |
|---|---|---|
| CA | 889660 | 1/1972 |

(Continued)

OTHER PUBLICATIONS

Randy's Tobacco Shop "Rolling Machines for Making Your Own Cigarettes" advertisement for cigarette machines, 3 pages, viewed Oct. 30, 2002.

(Continued)

*Primary Examiner*—Steven P Griffin
*Assistant Examiner*—Jodi Cohen
(74) *Attorney, Agent, or Firm*—Brinks Hofer Gilson & Lione

(57) ABSTRACT

An apparatus and method for manufacturing small quantities of cigarettes in a substantially simultaneous fashion while maintaining consistent quality between the cigarettes. The invention provides an apparatus and method for simultaneously inserting charges of tobacco into pre-formed tubular cigarette wrappers.

37 Claims, 22 Drawing Sheets

U.S. PATENT DOCUMENTS 2,427,884 A 9/1947 Snodgrass
2,427,957 A 9/1947 Getts, Jr.
2,496,375 A 2/1950 Carter
2,503,353 A 4/1950 Pugh
2,551,095 A 5/1951 Chaze
2,554,379 A 5/1951 Oetinger
2,594,747 A 4/1952 Laney
2,633,133 A 3/1953 Higgins
2,699,788 A 1/1955 Kastner
2,714,383 A 8/1955 Gee
2,731,971 A 1/1956 Kastner
2,850,019 A 9/1958 Sosa
2,868,209 A 1/1959 Marcotte
3,006,348 A 10/1961 Banning, Jr.
3,011,498 A 12/1961 Armelin
3,124,141 A 3/1964 Seitter
3,127,900 A 4/1964 Kastner
3,202,156 A 8/1965 Kappeler et al.
3,491,768 A 1/1970 Paynter
3,645,272 A 2/1972 Jenkins et al.
3,688,777 A 9/1972 Kastner
3,693,313 A 9/1972 Sexstone
3,693,630 A 9/1972 Kastner
3,699,975 A 10/1972 Saraber
3,732,873 A 5/1973 O'Rear
3,821,915 A 7/1974 Larrable
3,822,710 A 7/1974 Bramhill
3,884,013 A 5/1975 Solomon
3,892,245 A 7/1975 Asbill, Jr.
4,103,692 A 8/1978 Baier
4,164,229 A 8/1979 Hurt
4,167,091 A 9/1979 Ruppert et al.
4,167,948 A 9/1979 Moscovitch
4,180,082 A 12/1979 Wachter
4,184,591 A 1/1980 Geldmacher
4,215,705 A 8/1980 Marcil
4,249,546 A 2/1981 Heil et al.
4,303,082 A 12/1981 Thompson et al.
4,306,648 A 12/1981 Manservisi
4,319,588 A 3/1982 Evans
4,368,741 A 1/1983 Meinunger
4,411,278 A 10/1983 Kastner
4,474,190 A 10/1984 Brand
4,534,367 A 8/1985 Newsome
4,554,931 A 11/1985 Born
4,565,203 A 1/1986 Stewart
4,572,216 A * 2/1986 Josuttis et al. ..... 131/70
4,620,551 A 11/1986 Ruppert et al.
4,658,837 A 4/1987 Ruppert et al.
4,697,602 A 10/1987 Pelkey
4,760,853 A 8/1988 Gamberini
4,763,673 A 8/1988 Barnes et al.
4,770,191 A 9/1988 Moscovitch
4,771,793 A 9/1988 Kastner
4,832,056 A 5/1989 Bryant et al.
4,884,602 A 12/1989 Yamamoto et al.
4,887,617 A 12/1989 Ruppert et al.
4,913,171 A 4/1990 Lasko
4,962,773 A 10/1990 White et al.
5,009,237 A 4/1991 Schmidt et al.
5,018,536 A 5/1991 Liebich
5,072,740 A 12/1991 Gätschmann et al.
5,088,506 A 2/1992 Kastner
5,105,830 A 4/1992 Brackmann et al.
5,133,366 A 7/1992 Liebich
5,135,008 A 8/1992 Oesterling et al.
5,139,140 A 8/1992 Burrows et al.
5,141,000 A 8/1992 Ruppert et al.
5,167,241 A 12/1992 Ruppert et al.
5,167,248 A 12/1992 Tuller
5,197,495 A 3/1993 Ruppert et al.
5,398,701 A 3/1995 Neumann et al.
5,425,215 A 6/1995 Lewis et al.
5,450,861 A 9/1995 Colani
5,465,554 A 11/1995 Lewis et al.
5,524,515 A 6/1996 Boda
5,526,825 A 6/1996 Ruppert et al.
5,615,692 A * 4/1997 Ruppert et al. ..... 131/70
5,617,943 A 4/1997 Belvederi et al.
5,657,768 A 8/1997 Neumann et al.
5,666,975 A 9/1997 Lord
5,687,747 A 11/1997 Schramm
5,713,377 A 2/1998 Gerding et al.
5,730,159 A 3/1998 Draghetti et al.
5,749,378 A 5/1998 Ruppert et al.
6,206,006 B1 3/2001 Schutze et al.
6,345,624 B1 2/2002 Kastner
6,431,812 B1 8/2002 Budny
6,484,867 B2 11/2002 Spatafora et al.
6,557,560 B2 5/2003 Kastner
6,571,800 B1 6/2003 Yu
6,739,343 B1 5/2004 Trinkies et al.
6,786,123 B1 9/2004 Chen
6,913,022 B2 7/2005 Moser et al.
2004/0099277 A1 5/2004 Moser et al.
2004/0129281 A1 7/2004 Hancock et al.
2004/0255962 A1 12/2004 Perfetti et al.
2005/0103175 A1 5/2005 O'Banion et al.

FOREIGN PATENT DOCUMENTS

CA 973048 8/1975
CA 1039603 10/1978
DE 2 055 673 5/1972
DE 2 159 054 6/1972
DE 21 36 550 A1 2/1973
DE 2 187 076 A 9/1987
DE 37 06 504 A1 9/1988
DE 42 33 213 A1 4/1994
DE 44 04 274 A1 8/1995
DE 103 46 744 A1 5/2005
EP 0 144 060 6/1985
EP 0 659 353 A1 6/1995
EP 1 138 214 A2 10/2001
EP 1 177 731 A2 2/2002
EP 1 382 264 A 1/2004
FR 733 899 10/1932
FR 2 150 199 3/1973
FR 2 716 344 8/1995
GB 15535 3/1914
GB 29777 4/1914
GB 1 289 563 9/1972
GB 2 055 354 3/1981
GB 2 104 035 3/1983
GB 2 151 218 7/1985
GB 2 160 514 12/1985
GB 2 187 928 A 9/1987
JP 60-087117 5/1985
WO WO 2002/056714 A1 7/2002
WO WO 2004-110187 12/2004

OTHER PUBLICATIONS

Cigarettes Cheaper!: The Smoker's Newspaper, Jul./Aug. 2003, advertisement for a "Load-Your-Own!" cigarette machine, 3 pages, Oct. 12, 2002.

Tobacco Reporter, Apr. 2002, p. 26, "Burghart develops automatic cigarette maker for RYO testing," 2 pages.

Greg Jaffe and Christopher J. Chipello, The Wall Street Journal, "A Boom in Homemade Smokes: Rising Prices Light Up Sales of Rolling Kits," May 11, 1999, p. B1, 2 pages.

Box for Easy Roller, manufactured by C.P. Rolling ApS, and pictures of the same, 5 pages.

John Roscoe, Cigarettes Cheaper!: The Smoker's Newspaper, "The Great Cigarettes Cheaper! Make-Your-Own Machine Contest," Aug. 2000, p. 1, and contest entries, 212 pages.
Description of "The Amazing Cigarette Machine," www.weirdlinks.com/cigmachine.htm, 4 pages, viewed Oct. 30, 2002.
Roll Your Own Magazine, Oct./Dec. 2001, review of Excel cigarette injector machine, www.ryomagazine.com/october2001/injectors.htm, 4 pages.
Letter from John Roscoe to Bob Daily regarding Taiwanese cigarette machine and including pictures, Feb. 4, 2002, 11 pages.
Letter from John Roscoe to Glenn Morris regarding Lord cigarette machine and including literature regarding the same, Nov. 22, 1999, 7 pages.
Images of the Mack Roller cigarette machine and literature regarding the same www.webspot.com/mackroller/, 8 pages, viewed Oct. 30, 2002.
Letter from John Roscoe to Bob Daily regarding Taiwanese ideas for cigarette rolling machine, including drawings, Nov. 30, 2001, 5 pages.
Sally Baldwin, note regarding Harting cigarette machine and pictures of same, Jun. 6, 1999, 9 pages.
Pictures and review of Supermatic II cigarette machine, www.jackgee.com/supermatic_ii.htm and www.ryomagazine.com/july2001/injectors.htm, 20 pages.
"Roll-Your-Own Cigarette Machines and Supplies" advertisement, source and date unknown, p. 72, 1 page.
English abstract for FR 2 716 344, www.espacnet.com, 1 page, Feb. 21, 1994.
English abstract for EP 1 138 214 A2, www.espacnet.com, 1 page, Mar. 17, 1999.
English abstract for DE 38 31 420, www.espacnet.com, 1 page.
English abstract for EP 1 177 731, www.espacnet.com, 1 page, Jul. 10, 2001.
CTC Cigarette Machine Instructions, 2 pages, Jan. 1, 1999.
Supermatic Parts List, 2 pages.
Package insert for Machine A Cigarettes Excel Cigarette Machine, 2 pages.
Package insert for Easy Roller, 4 pages.
Instructions for using the Supermatic II, 4 pages.
Package insert for How to use your Bugler Cigarette Making Machine, 2 pages.
Package insert for Escort, 2 pages.
Package insert for Presta, 2 pages.
Package insert for Premier Twin Double Cigarette Tube Filling Machine, 2 pages.

* cited by examiner

99

APPARATUS AND METHODS FOR MANUFACTURING CIGARETTES

CROSS REFERENCE TO RELATED APPLICATION

This is a continuation-in-part of co-pending U.S. patent application Ser. No. 11/143,889, filed Jun. 1, 2005, which is incorporated herein by reference in its entirety.

FIELD OF THE INVENTION

The present invention relates to smoking articles, and in particular, to cigarettes. More specifically, the present invention relates to equipment and methods for manufacturing and handling relatively small quantities of cigarettes in an automated fashion.

BACKGROUND OF THE INVENTION

Smoking articles, such as cigarettes, have a substantially cylindrical rod-shaped structure and include a charge, roll, or column of smokable material, such as shredded tobacco, surrounded by a paper wrapper, to form a "cigarette rod," "smokable rod," or a "tobacco rod." A typical cigarette has a cylindrical filter element axially aligned in an end-to-end relationship with the tobacco rod. Typically, the filter element comprises plasticized cellulose acetate tow circumscribed by a paper material known as "plug wrap." Certain cigarettes incorporate filter elements comprising, for example, activated charcoal particles. Typically, the filter element is attached to one end of the tobacco rod using a circumscribing wrapping material known as "tipping paper." A ventilated or air-diluted smoking article can be provided with an optional air-dilution means, such as a series of perforations, each of which extend through the tipping material and plug wrap. Conventional automated cigarette rod making machines that have been employed for the manufacture of commercially popular packaged cigarettes are of the type commercially available from Molins PLC or Hauni-Werke Korber & Co. KG. For example, a description of a commercially available "Protos" cigarette-making machine is provided in U.S. Pat. No. 4,474,190 to Brand, at col. 5, line 48 through col. 8, line 3. Types of equipment suitable for the manufacture of cigarettes also are set forth in U.S. Pat. App. Pub. No. 2004/0129281 to Hancock et al. A cigarette-making machine for making relatively small amounts of cigarettes has been available commercially as "Hauni Baby" from Hauni-Werke Korber & Co. KG. Another type of portable cigarette-making machine has been set forth in U.S. Pat. No. 4,164,229 to Hurt.

Cigarettes are commercially available in a wide variety of types. For example, different brands of cigarettes are available containing different individual types of tobaccos having unique or characteristic flavors and aromas (e.g., Burley, Oriental, and Virginia tobaccos). Cigarettes are also available that contain blends of tobacco types and/or flavoring agents in or on the tobacco. Different colors and flavors of wrappers are available as well as filter elements providing variety in, for example, flavoring, strength of flavor, and tar yield. Conventionally, consumers obtain commercially available cigarettes in a pack containing a single type of cigarette. Thus, consumers wishing to smoke different types of cigarettes typically have to purchase multiple packs of cigarettes. Some consumers purchase wrapping materials, filters, and loose tobacco for so-called "hand-rolling" of their own cigarettes. While this approach allows a consumer to produce a variety of his own cigarettes, the making process requires a certain degree of skill, time, inconvenience, and/or some specialized equipment. A variety of hand-operated devices for manufacturing individual cigarettes have been proposed. See, for example, U.S. Pat. No. 2,376,103 to Wahl; U.S. Pat. No. 2,425,888 to Matteson et al.; U.S. Pat. No. 2,427,884 to Snodgrass; U.S. Pat. No. 2,427,957 to Getts; U.S. Pat. No. 2,496,375 to Carter; U.S. Pat. No. 2,594,747 to DuLaney; U.S. Pat. No. 2,699,788 to Kastner; U.S. Pat. No. 2,714,383 to Ming Gee; U.S. Pat. No. 2,731,971 to Kastner; U.S. Pat. No. 2,850,019 to Sosa; U.S. Pat. No. 2,868,209 to Marcotte; U.S. Pat. No. 3,006,348 to Banning, Jr.; U.S. Pat. No. 3,011,498 to Armelin; U.S. Pat. No. 4,832,056 to Bryant et al. and U.S. Pat. No. 4,534,367 to Newsome; PCT Application Pub. No. WO 2004/110187 to Szabo; and European Patent No. EP 1,177,731 to Tinkles et al.

Various manners and methods for filling paper cigarette tubes with tobacco have been proposed. See, for example, U.S. Pat. No. 2,633,133 to Higgins; U.S. Pat. No. 3,124,141 to Seitter; U.S. Pat. No. 3,202,156 to Kappeler et al.; U.S. Pat. No. 3,892,245 to Asbill, Jr.; U.S. Pat. No. 4,167,948 to Moscovitch; U.S. Pat. No. 4,572,216 to Josuttis et al. and U.S. Pat. No. 5,072,740 to Gatschmann et al. See, also, U.S. Pat. No. 3,491,768 to Paynter and U.S. Pat. No. 3,693,313 to Sexstone which set forth manners and methods for manufacturing individual cigarettes by filling a tube or "spill" with a tobacco charge and a filter plug. One type of cigarette-making machine for the manufacture of one cigarette at a time using loose tobacco and a filtered cigarette tube has been marketed as "Bugler™" filter cigarette-making machine by Brown & Williamson Tobacco Corporation. Another type of automated machine for filling pre-formed cigarette tubes with loose tobacco filler has been available commercially as "Cig-a-mat" from Jenkins & Ott, Inc. A device representative of such a machine is described in U.S. Pat. No. 3,645,272 to Jenkins et al. Yet another type of automated device for filling pre-formed cigarette tubes with tobacco filler is an electrically-operated cigarette-making machine that has been available commercially as Easy Roller from C. P. Rolling ApS of Denmark.

A cigarette machine for filling pre-formed cigarette tubes with tobacco filler has been produced commercially by The Central Tobacco Mfg. Co. Ltd. and marketed as "Premier Supermatic™." Other types of cigarette machines for filing cigarette tubes with tobacco have been marketed as "Escort" and "Pressta Deluxe" by CTC Canada Inc. See, for example, the representative types of machines set forth in U.S. Pat. No. 3,127,900 to Kastner and U.S. Pat. No. 4,771,793 to Kastner.

U.S. Pat. No. 3,822,710 to Bramhill proposes manufacturing individual cigarettes by inserting a cartridge of tobacco into an empty filter-tip cigarette tube. Other manners and methods for manufacturing individual cigarettes are set forth in U.S. Pat. No. 4,887,617 to Ruppert et al.; U.S. Pat. No. 5,018,536 to Liebich; U.S. Pat. No. 5,105,830 to Brackmann et al.; U.S. Pat. No. 5,133,366 to Liebich; U.S. Pat. No. 5,141,000 to Ruppert et al.; U.S. Pat. No. 5,167,241 to Ruppert et al.; U.S. Pat. No. 5,167,248 to Ruppert et al.; U.S. Pat. No. 5,197,495 to Ruppert et al.; U.S. Pat. No. 5,615,692 to Ruppert et al.; U.S. Pat. No. 5,713,377 to Gerding et al.; and U.S. Published Pat. App. 2006/0021625 to Nyffler.

Yet other manners and methods for fabricating cigarettes have been proposed. For example, the manufacture of cigarettes using a dispensing-type machine that has been proposed, and such a machine that has the referred to as "Cigaretterie" has been marketed by National Amusement Network, Inc. A device representative of such a machine is set forth in U.S. Pat. No. 5,666,975 to Lord.

It would be desirable to provide, in a commercial setting, small lots of cigarettes having different user/customer-selectable profiles in response to an individual customer order. It would also be desirable to provide for the manufacture of relatively small lots of cigarettes in an efficient and effective manner. It would be desirable that all of the cigarettes within each lot are of consistent quality. That is, it also would be desirable in one aspect that all of the cigarettes within a lot may be selected by a user/customer to be substantially identical to one another in appearance, size, shape, weight and component materials, including tobacco filler materials. It would be desirable in another aspect to provide a small lot of cigarettes wherein a plurality within the lot or individual cigarettes have different user/customer-selected characteristics such as flavored wrappers of differing types and strengths, flavored tobaccos, different colored wrappers, different species of tobacco, different blends of tobacco, or different filter element constructions. It also would be highly desirable that the cigarettes within a lot exhibit similar performance characteristics, such as smoking character, puff count and smoke yield. Alternatively, it may be desirable to efficiently and effectively manufacture simultaneously a plurality of cigarettes with different smoking characteristics (e.g., flavors, tobacco types), all while maintaining consistent smoking quality of the cigarettes

SUMMARY OF THE INVENTION

The present invention relates to the manufacture of cigarettes in an automated fashion. Cigarette manufacture is carried out such that relatively small lots of cigarettes can be manufactured during a relevant period. Cigarette manufacture most preferably is carried out such that substantially all of the cigarettes within a lot are of consistent quality.

A first aspect of the present invention relates to an apparatus or device for manufacturing cigarettes from tobacco (such as, for example, loose tobacco or pre-formed cylinders of tobacco) and pre-formed tubular wrapping portions. In one aspect the device includes a reservoir or hopper region for receiving and containing loose tobacco filler. The device also includes, below the hopper region, several downwardly extending passageways for downward passage of loose tobacco filler from the hopper region. The device also includes several receptacles, each of predetermined size, for receiving loose tobacco filler from each respective downwardly extending passageway (e.g., each individual downwardly extending passageway provides tobacco filler to a corresponding receptacle).

Most preferably, the device incorporates one or more weights or other structures adapted to provide downward force or compression on loose tobacco filler within each downwardly extending passageway. Application of force to the tobacco filler within each downwardly extending passageway using the weight provides for altered arrangement of tobacco filler within each passageway. Application of force to the tobacco filler within each downwardly extending passageway using the weight also provides for controlled feed of tobacco filler within each receptacle. The device most preferably incorporates at least one movable side wall for each downwardly extending passageway, thereby providing for altered arrangement of tobacco filler within each passageway as well as controlled feed or introduction of tobacco filler within each receptacle. As a result of the foregoing, for a particular blend of tobacco filler, a predetermined amount of tobacco filler can be supplied to, and provided within, each receptacle.

The device further includes a compression mechanism for arranging a pre-determined amount of loose tobacco filler within each receptacle into a charge of tobacco filler of predetermined shape and size (e.g., a cylindrical shape that is capable of filling the hollow region of a tubular wrapping portion). The device also includes a tray or cartridge for containing a plurality of pre-formed tubular wrapping portions. Each such wrapping portion has a hollow region, open at one end, for receiving tobacco filler. The cartridge is adapted to be positioned relative to the receptacles such that individual pre-formed tubular wrapping portions within the cartridge are aligned with corresponding individual receptacles. The device also includes an insertion unit including a plurality of feeding units (e.g., movable insertion arms) for delivering each charge of tobacco filler from each receptacle into the hollow region of each corresponding individual pre-formed tubular wrapping portion. That is, a tubular wrapping portion aligned with and adjacent to a corresponding receptacle is held in place while each charge of tobacco filler positioned within each receptacle is transferred from each receptacle through a nozzle into the hollow region of each corresponding tubular wrapping portion.

A representative embodiment of a cigarette manufacturing apparatus includes five downwardly extending passageways, five compression regions within the compression mechanism, five receptacles for formation of five charges of tobacco filler, five insertion arms, and a cartridge containing at least five hollow tubular wrapping portions; and, as such, five cigarettes can be manufactured substantially simultaneously by using the apparatus to fill each of five wrapping portions with a formed charge of tobacco filler. A representative lot of twenty cigarettes (e.g. a sufficient number of cigarettes to fill a traditional type of cigarette package) can be provided using such a representative cigarette manufacturing apparatus by employing at least a sufficient amount of tobacco filler to adequately fill twenty tubular wrapping portions contained within a cartridge designed to hold twenty tubular wrapping portions, and after appropriate placement of the cartridge within the apparatus, carrying out the tobacco filler filling operation four times.

A second aspect of the invention relates to removal of tobacco from ends of cigarettes. Tobacco filler extending from the end of a plurality of cigarettes can be removed by aligning a row of cigarettes and cutting that excess tobacco away from the ends of the cigarettes. Typically, after cigarettes have been manufactured using the representative apparatus of the present invention, a slight amount of tobacco filler located at the foremost lighting end of the cigarette may extend outwards from the open end of the tubular wrapper portion. That is, a slight excess amount of tobacco filler may extend beyond that region circumscribed by the tube of wrapping material. A representative embodiment of this aspect of the invention includes a circular, highly sharpened cutting blade rotating at a high speed which can be passed by the lighting end of the cigarette, at or just beyond the end of the tubular wrapper portion, in order to cut excess tobacco filler away. For example, finished cigarettes can be properly aligned in a cartridge, a highly sharpened cutting wheel configured in a general table saw type of manner can be aligned relative to the cartridge, and the cutting wheel cartridge can be rotated at a very high rate of speed and moved past the lighting ends of those cigarettes sufficiently close so as to cut excess tobacco filler away while not cutting or damaging the paper wrapping material at the lighting ends of those cigarettes. Thus, in one aspect of the present invention, the ends of finished cigarettes positioned in a cartridge can be trimmed while those cigarettes are positioned within that cartridge.

A third aspect of the present invention relates to an apparatus or device for loading a cartridge with pre-formed hollow tubular wrapping portions useful for the manufacture of cigarettes. Such a cartridge-loading device or assembly preferably includes a region for supporting the cartridge in a manner that at least a portion of the cartridge can be loaded with tubular wrapping portions. The device optionally includes a supply mechanism for supplying tubular wrapping portions to the cartridge. Specifically, the device is configured to fill the cartridge with a pre-determined number of tubular wrapping portions. In one embodiment, the supply mechanism includes an upper reservoir for receiving and containing a plurality of tubular wrapping portions, a hopper region including a plurality of downwardly extending passageways, a lower bed or tray located below the hopper region, and a transfer mechanism that facilitates transport tubular wrappers from the bed to corresponding locations within the cartridge. The downwardly extending passageways are adapted so as to receive tubular wrapping portions. Thus, in an operation of this embodiment, an individual tubular wrapping portion within the upper reservoir falls into each passageway of the hopper, and hence, several vertically extending columns of tubular wrapping portions are provided. Tubular wrapping portions positioned at the bottom of the supply mechanism are aligned with desired locations on the cartridge, which is positioned in a predetermined location adjacent the bottom region of the supply mechanism. As a result, a series of movable rods can be used to push the series of tubular wrapping portions from the bottom bed into desired positions within the cartridge.

A fourth aspect of the present invention relates to an apparatus or device for packaging cigarettes. One embodiment of this aspect of the invention includes a device having a base that has a region for locating an open cigarette package. The device also includes an upper region or platform, above the base, adapted to support a cartridge containing finished cigarettes. Below the upper platform is located a downwardly extending passageway for the passage of cigarettes from the cartridge and into the cigarette package. Removal of cigarettes from the cartridge is accomplished by movement of the cartridge relative to the upper platform such that cigarettes within the cartridge are pushed from the cartridge and into the downwardly extending passageway, traveling thereby into the package.

A fifth aspect of the present invention is directed to the use of the various components associated with various aspects of the present invention as a system to provide a cigarette product manufacturing apparatus. In an exemplary embodiment, a specific tobacco filler blend can be selected. Pre-formed tubular wrapping portions also can be selected. Empty tubular wrapping portions can be loaded into a cartridge using the cartridge-loading assembly. A cartridge carrying hollow tubular wrapping portions can be suitably positioned within the cigarette-making apparatus. The cigarette-making apparatus also can be fitted with a removable hopper unit containing the selected tobacco filler blend, or alternatively, the hopper unit can be appropriately positioned within the cigarette-making apparatus and then loaded with the selected tobacco filler blend. Cigarettes are manufactured by filling tubular wrapping portions with controlled amounts of loose tobacco filler until the cartridge is filled with manufactured cigarettes. As such, numerous cigarettes of consistent quality (e.g., in terms of components, dimensions, and weight) are produced. The cartridge, filled with manufactured cigarettes, is removed from the cigarette-making apparatus. Any excess tobacco filler extending from the lighting ends of those cigarettes can be trimmed, in order that the various cigarettes have ends that are relatively uniform and aesthetically pleasing. The cigarettes are transferred from the cartridge into the cigarette packaging device, where the cigarettes are loaded into a package. As such, there is provided a manner or method for manufacturing and packaging relatively small quantities, lots, or batches of finished cigarettes of consistent quality in an automated fashion. It is particularly desirable to employ the cigarette-making machine in combination with all or certain of the foregoing devices in a commercial setting, such as a tobacco products retail establishment, in order that a customer can choose a type or blend of tobacco filler for a package of cigarettes, and view the production and handling of the cigarettes that are produced expressly for that customer by a representative of the retail establishment.

The invention also includes a device for manufacturing cigarettes from pre-formed tobacco cartridges and pre-formed tubular wrapping portions. The device includes a tobacco cartridge delivery hopper, which comprises a plurality of substantially parallel chambers open at the top and bottom of each chamber. A plurality of receptacles is disposed beneath the plurality of substantially parallel chambers. The device also includes a wrapper-holding cartridge adapted to be placed adjacent the plurality of receptacles. The wrapper-holding cartridge is adapted for supporting a plurality of pre-formed tubular wrapping portions, each wrapping portion having a hollow region at one end for receiving tobacco filler, and each of a predetermined number of the wrapping portions being aligned with one of the plurality of receptacles. The device also includes an insertion mechanism configured for inserting a pre-formed tobacco cartridge from each receptacle into the hollow region of each of the predetermined number of the wrapping portions. In another aspect, the invention includes a method using the device to make cigarettes from pre-formed tobacco cartridges and pre-formed wrappers.

Although useful in many environments, it is particularly desirable to employ the cigarette-making machine in combination with all or certain of the foregoing devices in a commercial setting, such as a tobacco products retail establishment, in order that a customer can choose a type or blend of tobacco filler for a package of cigarettes, and view the production and handling of the cigarettes that are produced expressly for that customer by a representative of the retail establishment. The cigarette-making machine, the cartridge-loading device and the packaging device of the present invention each can be used, for example, for the manufacture of cigarettes for personal use (e.g., for use at home), for the manufacture of specialty type cigarettes within tobacco products retail establishments (e.g., for the production of individual packages of cigarettes at tobacco shops), for the manufacture of small lots of cigarettes for quality control or regulatory related activities, or for research and development purposes. In one aspect of the invention, the small lots of cigarettes may each include a mixture of two or more different types of cigarette to allow a customer to order a container of cigarettes including selected different tobaccos, blends, or flavors. The selection may be made by the customer in a manner such that several of each different customer-selected cigarette is chosen for placement in the container, or a customer may elect to have one each of a customer-selected variety of cigarettes in the container, or the customer may elect an unspecified assortment (e.g., cigarettes with different characteristics chosen at random). The act of selection may include selecting from cigarettes already made and/or selecting from different tobacco types (including individual tobaccos for use alone or in blends, or from blends provided). The differences in cigarettes may include, for example, one or more of flavored wrappers, flavored tobaccos, different colored wrappers, different species of tobacco, different blends of tobacco, or different filter profiles. In a preferred embodiment of this method, the different cigarettes include visual indicia correlated to one or more of their characteristics.

DETAILED DESCRIPTION OF THE PREFERRED EMBODIMENTS

Figure 1:
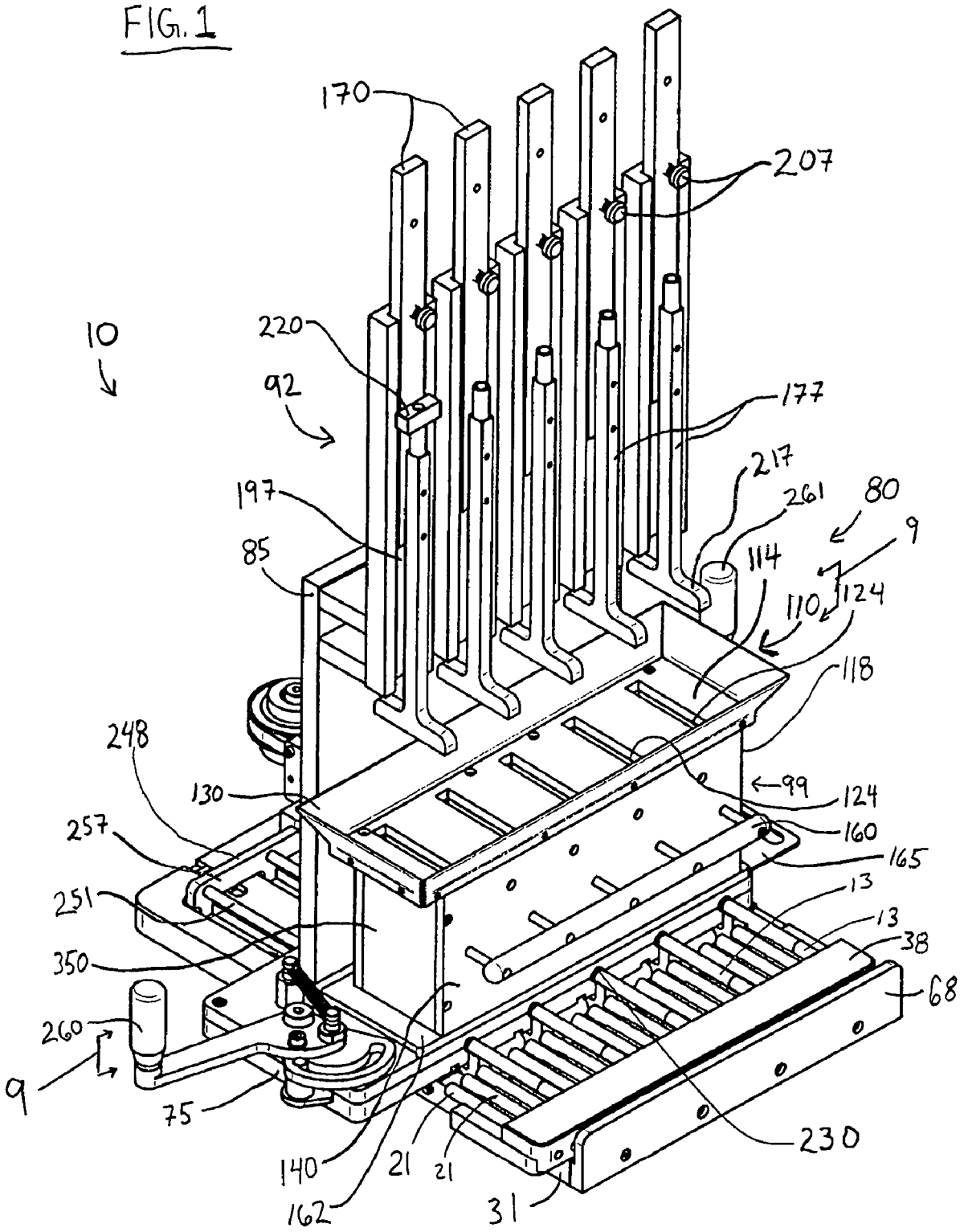
FIG. 1 is a perspective view of an apparatus for manufacturing a plurality of cigarettes by filling pre-formed tubular wrappers with loose tobacco filler, showing a front view of that apparatus.

Referring to FIG. 1, there is shown an automated device or apparatus 10 for manufacturing a plurality of cigarettes 13 by filling pre-formed filtered tubular wrappers 21 with loose tobacco filler (not shown). For the embodiment shown, the automated cigarette-making apparatus is designed to concurrently manufacture five cigarettes by simultaneously filling the hollow portions of five pre-formed tubular wrappers with five cylindrical charges formed from loose tobacco filler. (The terms "tubular wrapper" and "tubular wrapping portion" may be used interchangeably)

The cigarette manufacturing apparatus 10 includes a lower base 31, which can be manufactured from a suitable material, such as metal (e.g., stainless steel, brass or aluminum), plastic (e.g., polycarbonate, polymethylmethacrylate, acrylate/butadiene/styrene or ABS type plastic, nylon, or other suitable polymeric material), composite material (e.g., a graphite-based ceramic), or like material; but preferably is manufactured from aluminum. Although the shape and dimensions of the base can vary, and can be a matter of design choice, a representative base is generally rectangular and is about 35 cm deep, about 25 cm wide, and about 2 cm high. A perspective view of the base 31 is described below with reference to FIG. 3.

Figure 22:
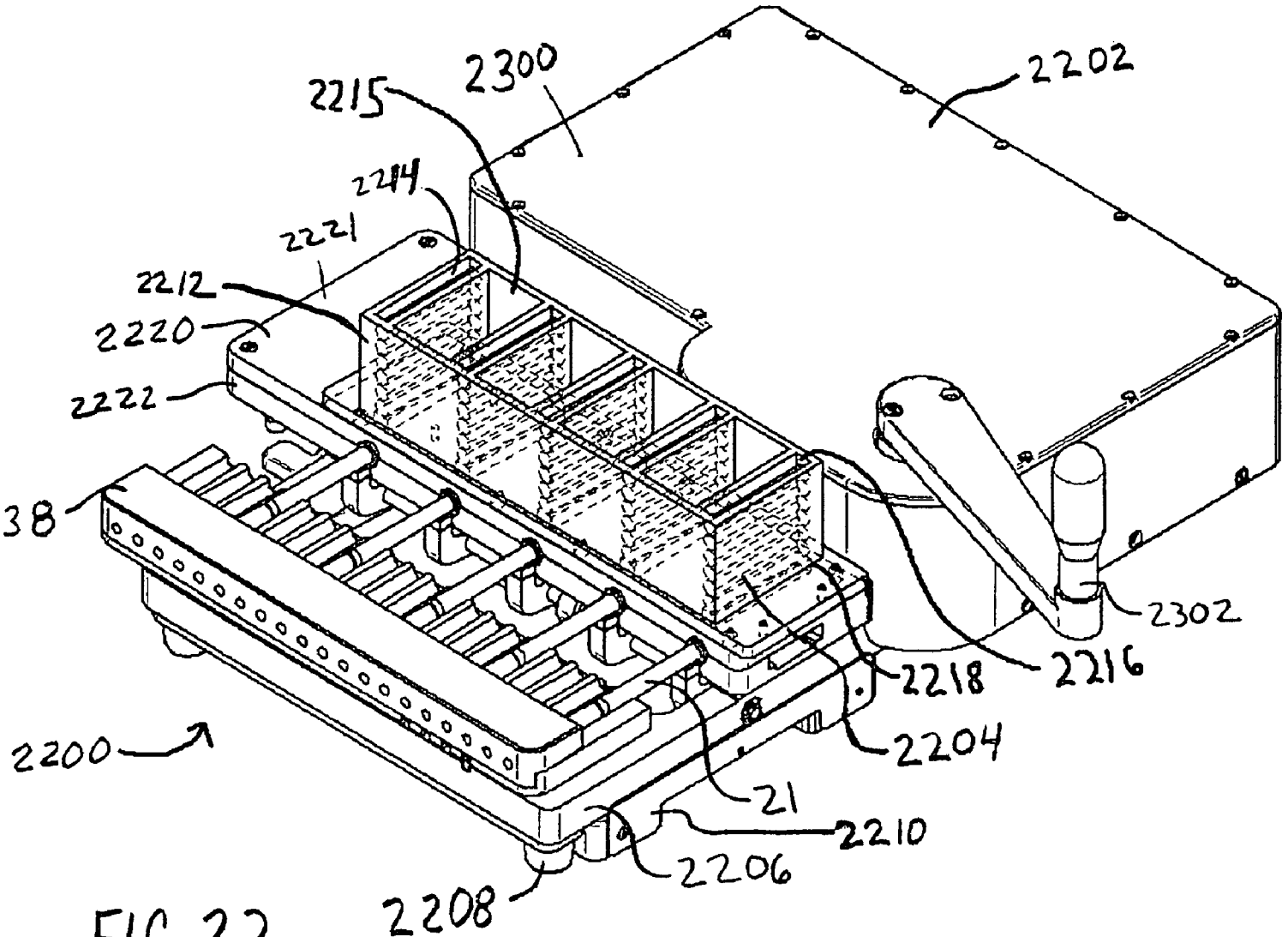
FIG. 22 is a top perspective view of a second cigarette manufacturing apparatus, including a hopper configured for holding and delivering cylindrical charges of tobacco.

If desired, various components of the cigarette manufacturing apparatus 10 can be covered with an aesthetically pleasing cover (see, for example, the alternative embodiment shown in FIG. 22, which includes a cover 2202 over a tobacco filler insertion mechanism 2300). For example, portions of the base 31 can be adapted to support an optional formed plastic cover of a desired design and color.

The base 31 supports a movable wrapper-holding tray or wrapper-holding cartridge 38, which can be manufactured from a suitable material above, but preferably is manufactured from a metal, such as aluminum. The wrapper-holding cartridge 38 preferably is adapted to be movable from side to side relative to the base 31, along the longitudinal axis of the wrapper-holding cartridge 38, and to be removable therefrom. Movement can be facilitated manually by a machine operator. Although the dimensions of the wrapper-holding cartridge 38 can vary, and can be a matter of design choice, a representative, generally rectangular-shaped cartridge is about 7 cm deep, about 26.5 cm long, and about 2.5 cm high. Rear and front views of the wrapper-holding cartridge 38 are shown, respectively, in FIGS. 5 and 6.

Figure 5:
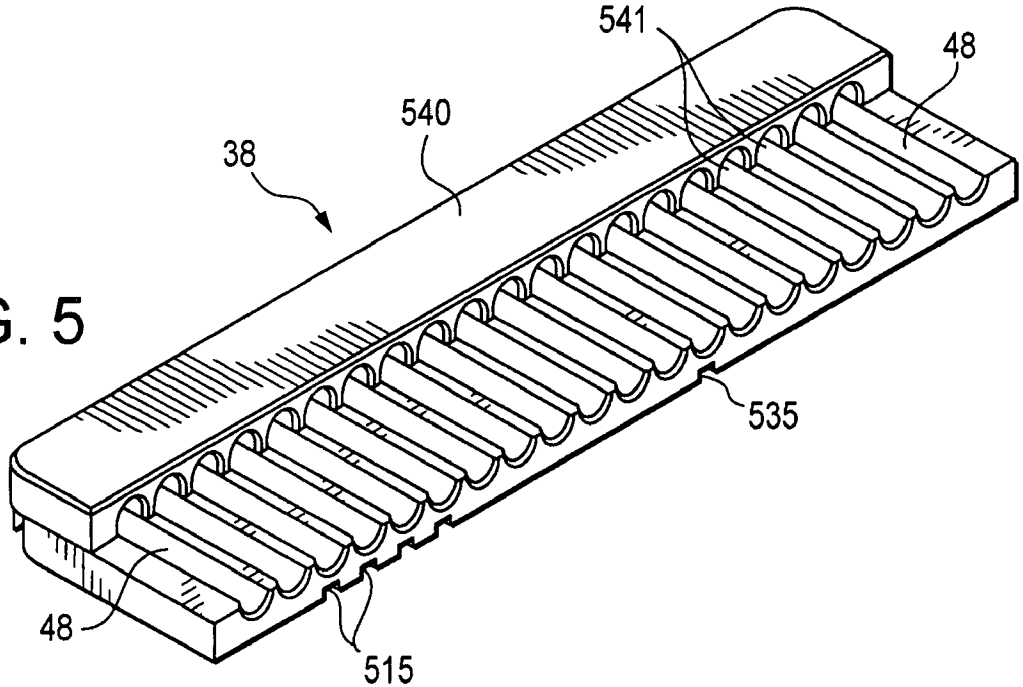
FIG. 5 is a perspective view of a cartridge of the apparatus shown in FIG. 1.
Figure 6:
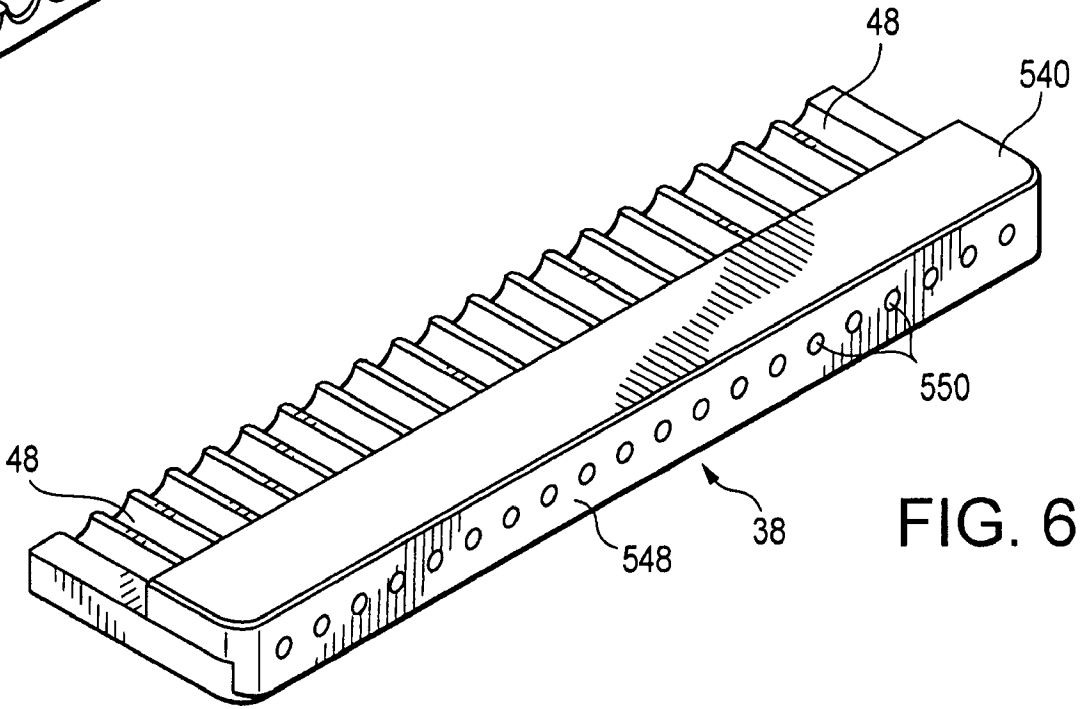
FIG. 6 is a perspective view of the cartridge of the apparatus shown in FIG. 1.

Referring to FIGS. 1, 5, and 6, the wrapper-holding cartridge 38 includes a series of parallel rounded grooves 48 in its upper face, with the grooves 48 being oriented perpendicular to the longitudinal axis of the wrapper-holding cartridge 38. The size and shape of the grooves can vary, and generally depend upon factors such as the desired size of a pre-formed tubular wrapper 21 that is properly positioned in each respective groove 48. That is, each groove 48 acts as a type of cradle for a pre-formed tubular wrapper 21. A representative groove is designed to hold a pre-formed tubular wrapper that is about 86 mm long with a circumference of about 24.5 mm. The representative groove has a generally semi-circular shape of about 4.4 mm radius and is about 60 mm long. As such, each tubular wrapper can extend about 30 mm beyond the rear face of the cartridge. For the embodiment shown, the wrapper-holding cartridge 38 includes twenty grooves 48, and thus the wrapper-holding cartridge 38 can hold twenty pre-formed tubular wrappers 21 for the manufacture of twenty cigarettes.

The wrapper-holding cartridge 38 preferably is adapted to be removable from the base 31. Thus, a wrapper-holding cartridge 38 loaded with empty tubular wrappers 21 can be positioned on the base 31, loaded with loose tobacco filler (not shown), and—once loaded with finished cigarettes resulting from the tubular wrappers 21 having been filled with tobacco filler—can be removed from the base 31 for packaging or use. It is highly preferred that the tubular wrappers 21 within the wrapper-holding cartridge 38 are positioned lying on their sides (e.g., the longitudinal axis of each is parallel to, or substantially parallel to, the horizontal plane). The wrapper-holding cartridge 38 preferably acts as a source and holder of tubular wrappers 21 that are employed during the cigarette-manufacturing process using the cigarette-making apparatus, as well as a holder for transfer of finished cigarettes 13 manufactured using that apparatus 10 to a package filling device.

Figure 3:
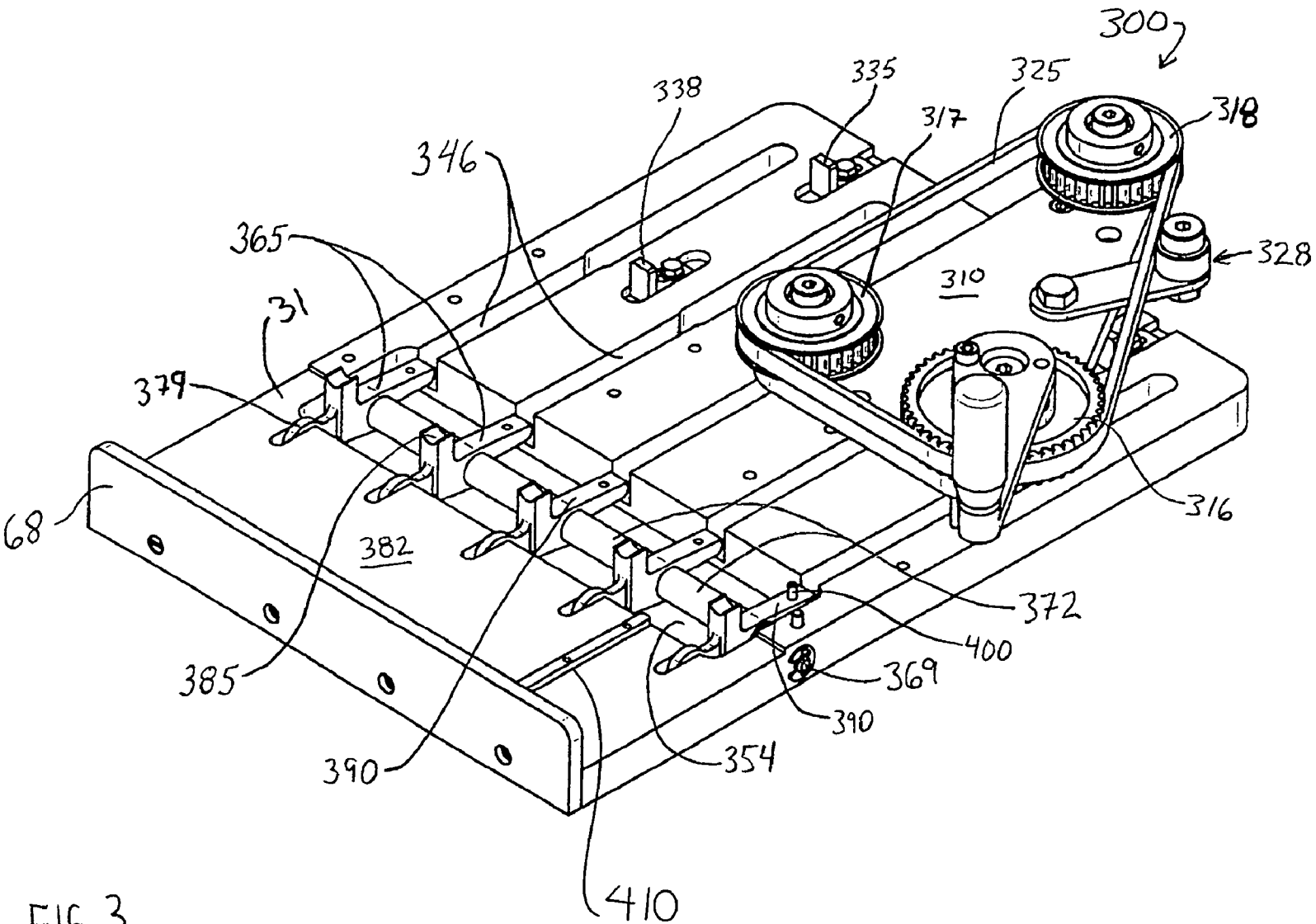
FIG. 3 is a perspective view of the base and various components of the plunger mechanism of the apparatus shown in FIG. 1.
Figure 14:
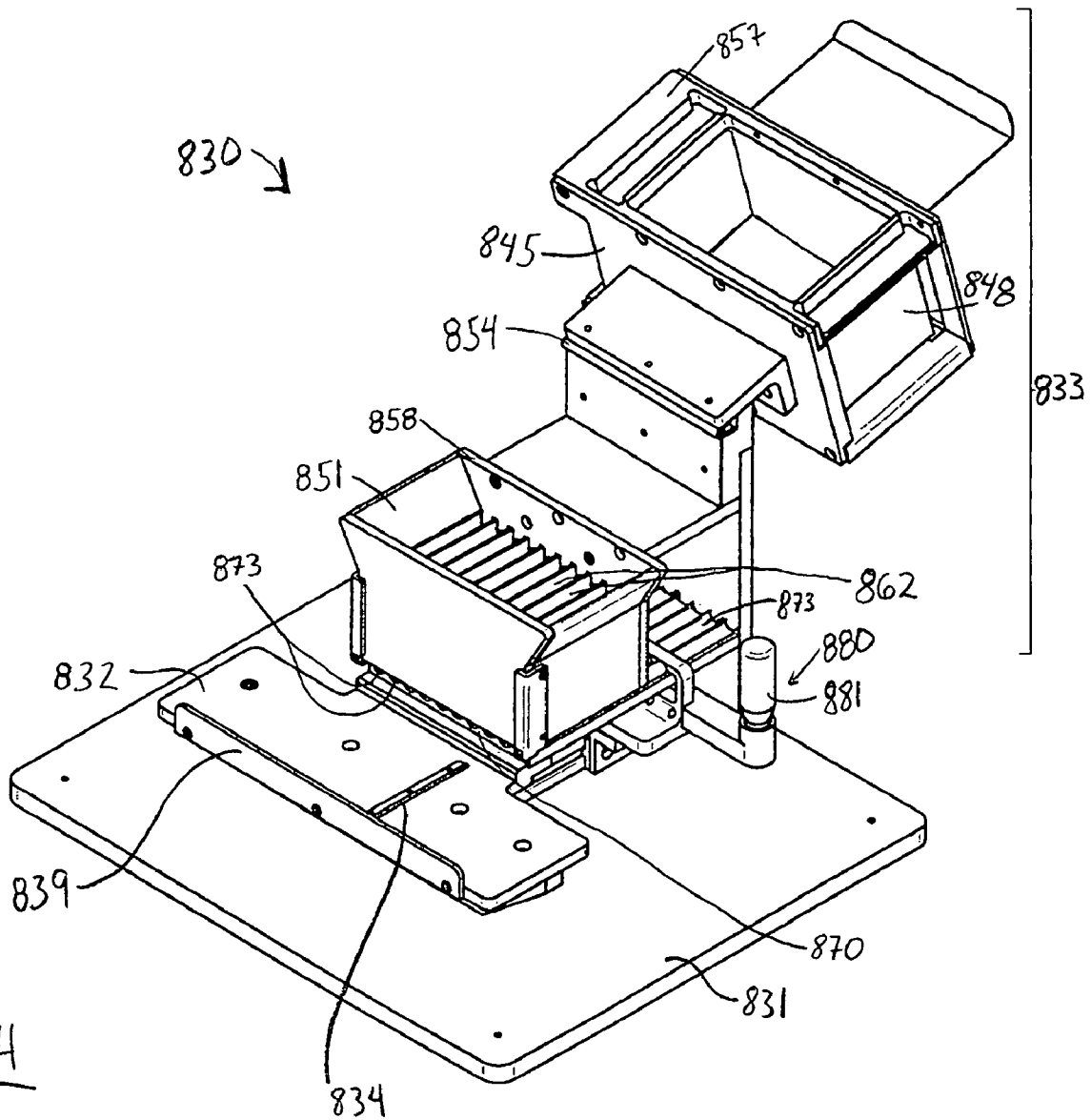
FIG. 14 is a perspective view of an apparatus for filling a cartridge with pre-formed tubular wrappers, the apparatus shown in the open position.

The wrapper-holding cartridge 38 preferably is adapted to be capable of being maintained firmly in place relative to the base 31 during periods when the apparatus 10 is being used to insert loose tobacco filler into selected tubular wrappers 21. Appropriate secure positioning of the cartridge within the base preferably is accomplished by any suitable means. For example, the wrapper-holding cartridge 38 may be laterally secured to the base 31 using, for example, a pin or key type of design (e.g., a square key stock 834, such as is illustrated in FIG. 14) whereby a protrusion located at a predetermined position in the base 31 cooperates with a coordinating hole or slot located at a predetermined location in the bottom face of the wrapper-holding cartridge 38. In addition, as shown in FIGS. 1 and 3, a backstop wall 68, or other suitably designed backstop means, protruding upwardly across the length of the front end of the base 31, acts to hold the cartridge (and pre-formed tubular wrappers carried thereby) in place relative to the base. Use of the backstop wall 68 and/or other securing means may thus minimize or prevent undesirable effects of lateral movement (whether side-to-side or back-and-forth) during normal operation of the apparatus 10.

The base 31 also supports a compression assembly 75 (which is discussed in greater detail below with reference to FIGS. 7-8). The compression assembly 75, in turn, supports a hopper assembly 80. Extending upwards and supported by the base 31 is a support frame 85, which can be manufactured from a suitable material, but preferably is manufactured from aluminum. The support frame 85 preferably is connected to the remainder of the apparatus 10 using screws, or other suitable connection means for adequately securing the various components in place. For example, screws may be threaded through the compression assembly 75 and into the bottom face of the support frame 85. The support frame 85 preferably is adapted to support an upper weight-source assembly 92.

The tobacco hopper assembly 80 also includes a hopper unit 99. The hopper unit 99 is adapted to be maintained firmly in place relative to the compression assembly 75 during periods when the apparatus 10 is being used to insert loose tobacco filler into selected tubular wrappers 21. Such firm positioning of the hopper unit 99 preferably is accomplished by appropriately positioned coordinating locating slots and pins (not shown). As such, the hopper unit 99 functions as a source of loose tobacco filler that is processed using the apparatus 10 to produce finished cigarettes.

Various components of the hopper assembly 80 preferably are adapted to be removable from the compression assembly 75, in order that the relevant hopper assembly components can be serviced or cleaned. In a preferred embodiment of the apparatus 10, individual hopper units, each containing a different blend of loose tobacco filler, can readily be removed and substituted for one another. The desired secure positioning of each removable hopper unit 99 relative to the other components of the apparatus 10 preferably is facilitated by placement of protruding pins on the bottom of the hopper unit and complementary mating holes in the top of the compression assembly 75. By use of the pin/hole arrangement or another suitable mechanism, the hopper unit can appropriately be aligned with the other components of the apparatus.

Figure 2:
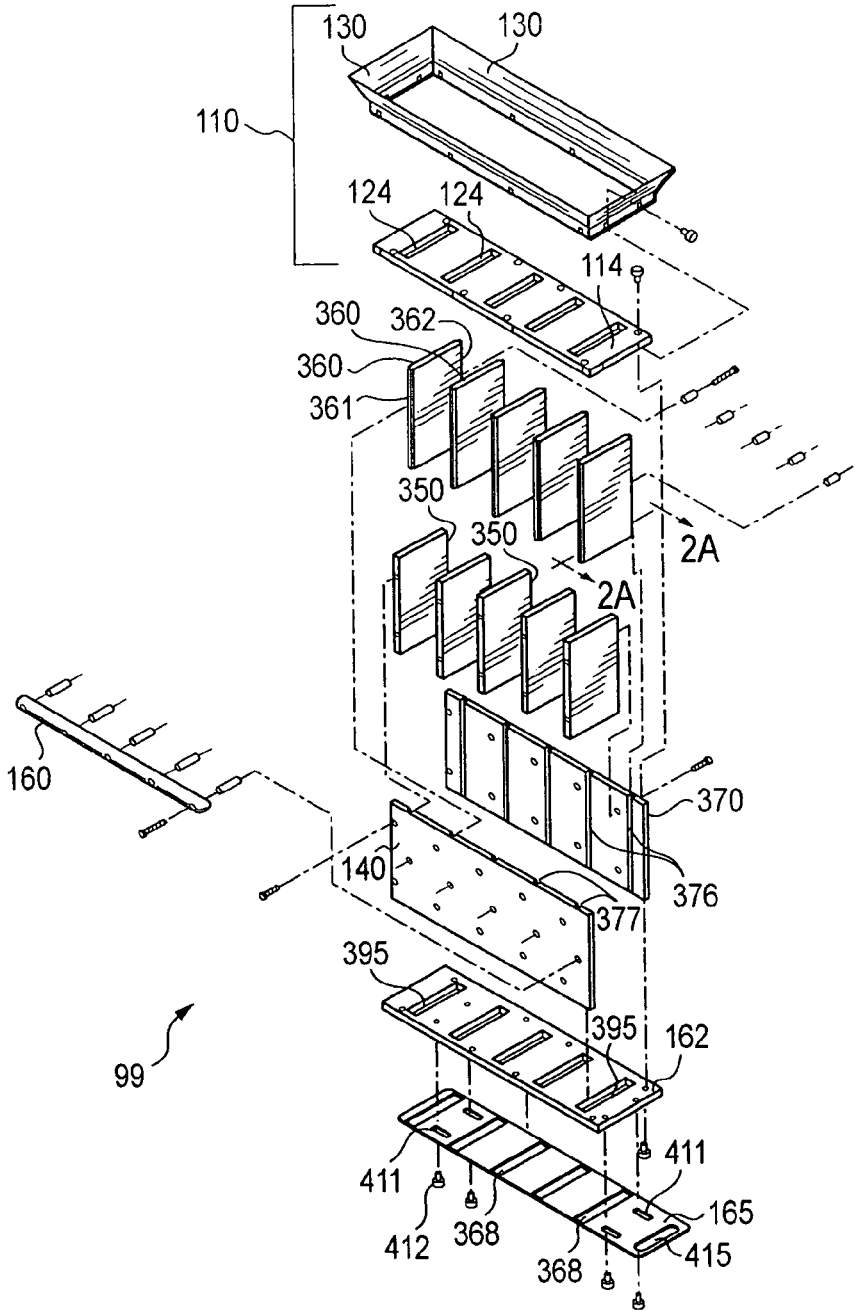
FIG. 2 is an exploded view of various components of the hopper assembly of the apparatus shown in FIG. 1.

Referring to FIGS. 1 and 2, the hopper unit 99 includes an open upper reservoir region 110 into which loose tobacco filler (not shown) can be deposited. A top wall 114 of an intermediate hopper portion 118 defines the bottom of the upper reservoir region. The top wall 114 can be manufactured from any suitable metallic material, such as aluminum, or from plastic. The top wall 114 includes a series of openings 124. For the embodiment shown, the top wall 114 includes five openings 124. The longitudinal axis of the top wall 114 preferably is generally parallel to the longitudinal axis of the wrapper-holding cartridge 38. Each opening 124 extends transversely to the longitudinal axis of the top wall 114. Each opening 124 provides access to a vertical passageway or channel through the intermediate hopper portion 118 for the controlled transport of tobacco filler (not shown) from the upper reservoir region 110 to the bottom of the intermediate hopper portion 118. For example, for the manufacture of a cigarette having a tobacco rod length of about 56 mm, each opening preferably is about 10 mm to about 12 mm wide by about 55 mm to about 60 mm long. Preferably, each corresponding vertical passageway in the intermediate hopper portion 118 is sufficient to provide for passage of a charge of tobacco sufficient to provide about four or about five fillings of about four or about five individual tubular wrappers. For the manufacture of a cigarette from a hollow tubular rod having a tobacco rod section of about 56 mm in length and about 24.5 mm in circumference, a representative preferred opening has dimensions of 10.25 mm wide by about 58 mm long.

The dimensions of the upper reservoir region 110 may vary depending upon the amount of tobacco desired to be used with the apparatus 10. Preferably, the upper reservoir region 110 has the capability of containing about 50 g to about 100 g of loose tobacco filler (not shown). A representative upper reservoir region 110 includes outwardly sloping walls 130 that extend upwards and outwards from the top wall 114 of the intermediate hopper portion 118 to a vertical height of about 2 cm to about 5 cm. Those outwardly sloping walls can be manufactured from any suitable material and preferably include a metallic material, such as stainless steel.

The intermediate hopper portion 118 is defined by top wall 114, front wall 140, fixed left side wall 350, a rear wall 370, movable right side wall 360 and bottom wall 162. A representative intermediate hopper assembly has dimensions of about 29 cm wide, about 10.1 cm long, and about 10 cm high. Preferably, the walls of the representative intermediate hopper region are manufactured from sheets of a clear material such as polycarbonate or polymethylmethacrylate, in order that the presence or absence of loose tobacco filler in the intermediate hopper region readily can be viewed.

A series of side walls 350, 360 extend downwardly within the intermediate hopper portion 118. That is, for each opening 124, a fixed wall 350 and a movable wall 360 extend downwardly from the bottom of the top wall 114 of the intermediate hopper portion 118, thereby forming a vertically extending passageway extending downwardly from each opening 124. Each movable wall 360 is movable relative to the other components of the intermediate hopper portion 118. That is, the movable walls 360 of the intermediate hopper portion 118 can be moved back and forth along a front-to-rear axis that is perpendicular to the longitudinal axis of the top wall 114. This front to back movement preferably may be effected by an operator using an appropriately connected wall-moving handle 160 that extends across the front exterior region of the intermediate hopper portion 118. An appropriate connection of the wall-moving handle 160 to the movable walls 360 may include screws or bolts combined with spacers, rivets, or any other suitable connection means. Preferably, a reciprocating motion of a wall-moving handle 160 helps tobacco filler to gently settle within each passageway, hence providing a consistent amount of tobacco filler in each tobacco charge that is used during cigarette manufacture. The wall-moving handle 160 can be manufactured from any suitable material, such as wood, plastic, polytetrafluoroethylene, or aluminum.

The bottom region of hopper assembly 80 includes a bottom wall 162, which includes a series of bottom wall slots 395. A movable slat 165 is located below the bottom wall 162. The movable slat 165 is adapted to be movable back and forth along its longitudinal axis within the lower region of the hopper unit 99. An exemplary movable slat can be manufactured from any suitable material and preferably is manufactured from a metallic material, such as stainless steel. A representative movable slat is about 6.5 cm wide, about 29 cm long, and about 1.6 mm thick. The movable slat 165 includes a series of slat apertures 368 that, when the movable slat 165 is in an "open" position are aligned with the openings 124 of the top wall 114, the vertical passageways, and the bottom wall slots 395 of the bottom wall 162. As is described below with more specific reference to FIG. 2, movement of the slat 165 to one side (e.g., to the right) allows alignment of each vertical passageway and its corresponding bottom wall slot 395 with each respective slat aperture 368 in the slat 165, thus allowing tobacco filler to fall through the hopper unit 99 and into the compression assembly 75. Movement of the slat 165 to the other side (e.g., to the left) allows closure of the passageways through the hopper unit 99. As such, when the slat 165 is moved to a "closed" position tobacco filler is retained within the hopper unit 99, which can then be removed from the apparatus 10 without a resulting spillage of significant quantities of tobacco filler.

Referring again to FIG. 1, above the upper region of the hopper assembly 80 is positioned a weight-source assembly 92. The weight-source assembly 92 includes several ball slides 170 or other suitable means for supplying compressive force to tobacco filler (not shown) within the intermediate hopper portion 118. Representative ball slides are available as "Del-Tron SA1-8" from Del-Tron, Inc. Each ball slide 170 is suitably connected to the support frame 85 so as to maintain the weight-source assembly 92 appropriately positioned above the hopper unit 99.

Each ball slide 170 is suitably adapted so as to provide for the desired movement and positioning of a series of weights 177. For the embodiment shown, the apparatus 10 includes five weights 177. Each weight 177 is appropriately attached (e.g., using fasteners such as screws) to a corresponding ball slide 170. Each weight 177 is adapted to travel up and down with each respective ball slide 170 in an appropriate channel 197. A series of spring plungers 207, or other suitable control means, within each ball slide 170 acts to hold each respective weight and ball slide in an "up" position (as shown in FIG. 1). The spring plungers 207 are releasable to allow the weight into a "down" position providing downward force to compress or compact tobacco filler in the hopper assembly 80 and provide for a generally consistent flow of the tobacco to the receptacles 641 below the hopper assembly 80.

Each weight 177 includes a bottom foot 217 that preferably is adapted to fit within corresponding opening 124 below that weight 177. Preferably, each foot 217 also is adapted so as to provide for ensuring compression of the tobacco filler within each corresponding vertical passageway of the hopper unit 99. In a representative embodiment, each weight preferably has a mass of about 150 g to about 400 g, more about 200 g to about 300 g, and most preferably about 200 g. Optionally, the mass of each individual weight 177 can be changed (e.g., by adapting each weight so that smaller weights can be added and taken away, in order that the downward compressive force can be selected and controlled). For example, an optional, additional weight 220 can be positioned on top of weight 177 such that the degree of downward compressive force would be increased. In operation, a series of additional weights optionally can be positioned on top of each weight 177, and as tobacco filler is gradually removed from each vertical passageway for cigarette manufacture, the additional weights can be removed, as desired, from each larger weight to prevent a disproportionate downward pressure on a lesser volume of tobacco filler.

Most preferably, each weight 177 provides substantially identical downward compressive force. However, the amount of downward force provided to the tobacco material in each vertical passageway of the hopper unit 99 can be varied between individual vertical passageways, depending upon factors such as the relative amount of tobacco filler in each passageway. Preferably, the weight-source assembly 92 is configured such that the loose tobacco filler within each vertical passageway is consistently or uniformly positioned within each passageway, and the packing density of the tobacco filler within each passageway are comparable with the other passageways. Control of the downward compressive force to the tobacco filler is desirable in order to control the amount of tobacco filler used for the manufacture of each individual cigarette. For example, a mechanism such as a set of force gauges or scales (not shown) may be positioned within each vertical passageway or attached to the top of each of the weights in order to monitor the degree of downward force applied to the tobacco filler therein.

Figure 7:
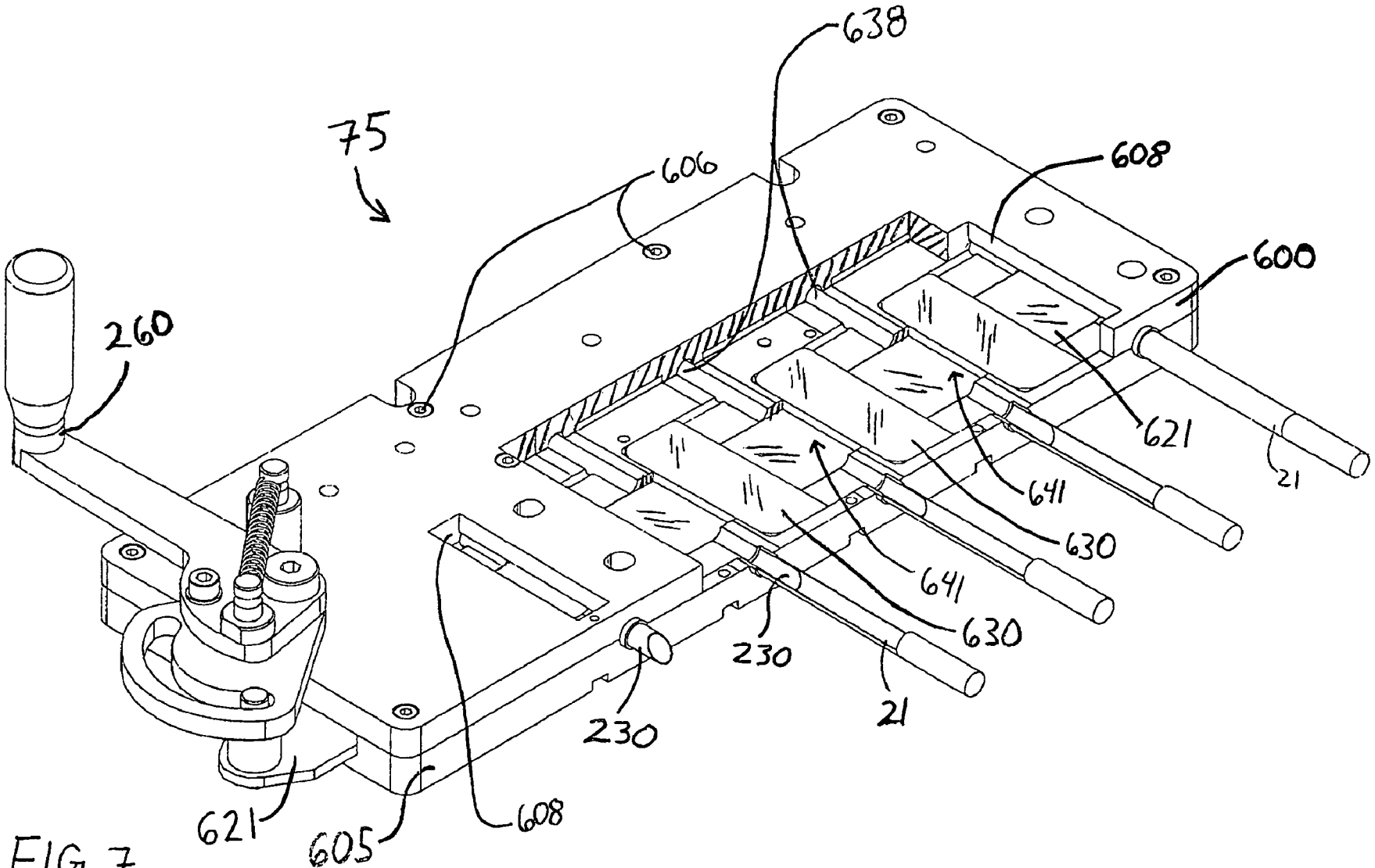
FIG. 7 is a perspective view of a compression assembly of the apparatus shown in FIG. 1, showing the upper portion thereof as partially cut away, and showing the compression plates thereof in open positions.

Referring now to FIGS. 1 and 7, the compression assembly 75 includes a plurality of nozzles 230. For the embodiment shown in FIGS. 1-11, the apparatus 10 includes five nozzles 230. Each nozzle 230 preferably is designed such that the open end of a hollow pre-formed tubular wrapper 21 fits over that nozzle 230 such that tobacco filler (not shown) can be transported through that nozzle 230 and into a corresponding tubular wrapper 21. Representative nozzles preferably are manufactured from a metallic material, such as stainless steel. Preferably, each nozzle is generally cylindrical in shape; and a representative nozzle (for use in conjunction with a pre-formed tubular wrapper having a circumference of about 24.5 mm) has an inner diameter of about 6.75 mm and an outer diameter of about 7.25 mm.

For the embodiment shown in FIGS. 1 and 7, each tubular wrapper 21 is axially aligned with a corresponding nozzle 230 and is positioned so as to be inclined at a slight angle (e.g., about 5° relative to horizontal). It is preferred that the tubular wrappers 21 located on the wrapper-holding cartridge 38 rest in a horizontal plane that is slightly below a central plane of the nozzles 230. Thus, when the open end of a tubular wrapper 21 extends around a nozzle 230, it (the open end) is raised slightly higher than the other (e.g., filtered) end.

The compression assembly 75 is located on and supported by the base 31. Preferably, the compression assembly 75 is attached securely to the base 31 using several screws, or other appropriate fastening means. The removable hopper unit 99 preferably is maintained in place on top of the compression assembly 75 by a suitable number of appropriately positioned locating pins (not shown). That is, several positioning pins of appropriate shape and size can be located in the bottom of the hopper unit 99, and corresponding location holes can be positioned in the top face of the compression assembly. Any other suitable structure may be used to maintain the relative positions of the hopper unit 99 and the compression assembly 75.

Figure 9:
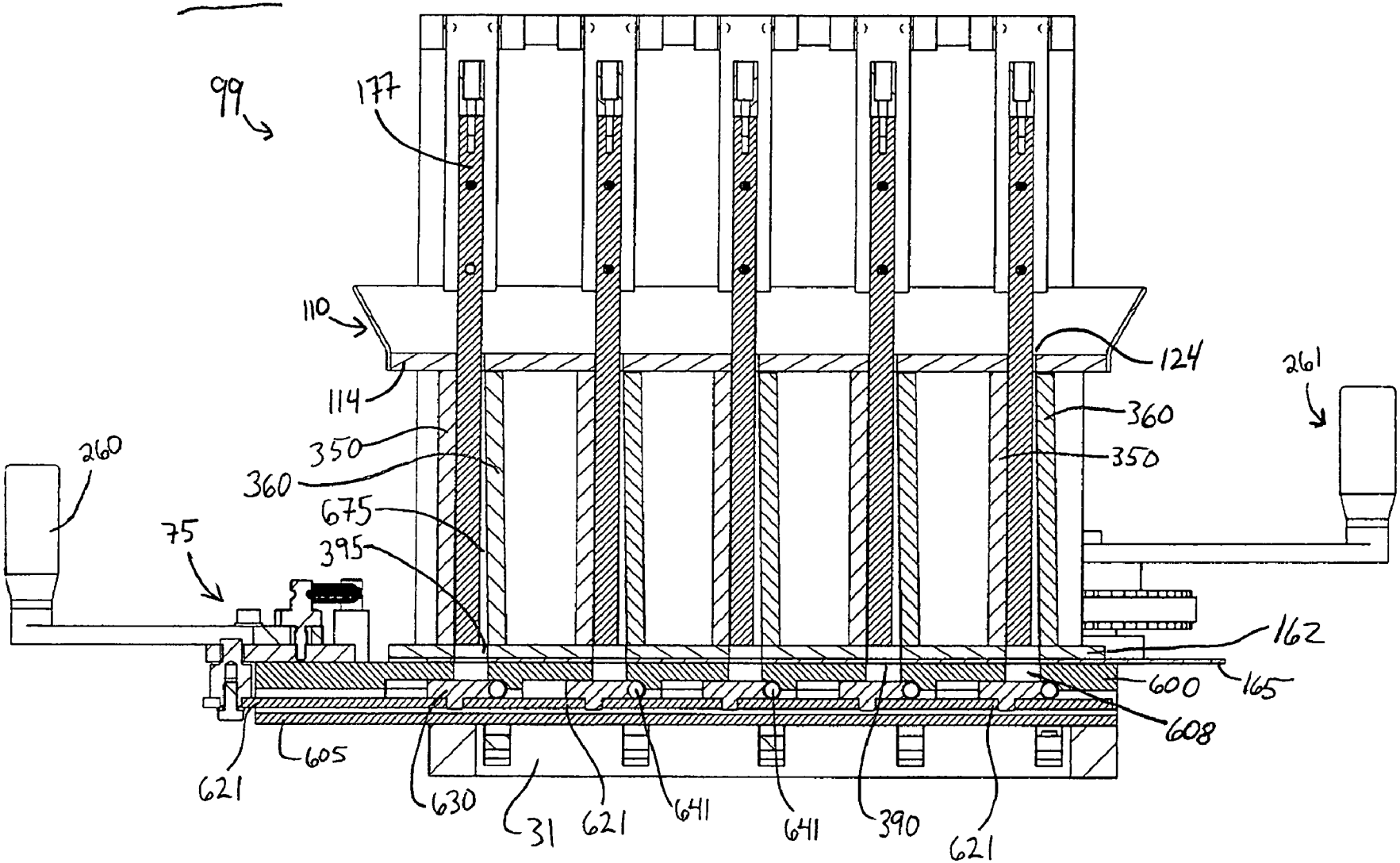
FIG. 9 is a cross-sectional view of the apparatus shown in FIG. 1 taken along lines 9-9 in FIG. 1, and showing the compression plates in closed positions.

As shown in FIG. 9, a plunger assembly 248 is located in the lower rear region of the apparatus 10. The plunger assembly 248 includes several plunger arms 251 that extend forward, and are mounted on a plunger arm cross-member 257. When an operator moves the plunger assembly 248 forward, each plunger arm 251 moves correspondingly to push a charge of tobacco filler (not shown) from each corresponding receptacle area 641 located within the compression assembly 75 into each corresponding tubular wrapper 21. The illustrated plunger assembly includes five plunger arms 251, but it should be appreciated that other embodiments could have more or fewer plunger arms (for example, a representative apparatus 10 may include a plunger assembly 248 having two plunger arms, or having 20, 40, or more).

Referring to FIGS. 1 and 7, the apparatus 10 includes two operational arms: a compression arm 260 and a plunger arm 261. The compression arm 260 is located on the left side of the apparatus. The compression arm 260 is used to arrange tobacco filler within the compression assembly 75 so as to form a plurality of cylindrical charges for insertion into corresponding pre-formed tubular wrappers 21, and thereby form several cigarettes. The function of the compression arm 260 is described below with reference to FIG. 7. The plunger arm 261 is located on the right side of the apparatus. The plunger arm 261 is used to facilitate movement of the plunger assembly 248, and hence facilitate insertion of a formed cylindrical charge of tobacco filler within a corresponding pre-formed tubular wrapper 21. The function of the compression arm 260 is described below with reference to FIG. 3. Representative operational arms may be manufactured from any suitable material, and preferably are manufactured from aluminum.

The operational arms or handles 260, 261 that are shown are each designed to be operated within a horizontal plane. The design and selection of the operational arms are such that the operational mechanism (e.g., a gear and/or spring mechanism such as, for example the compression assembly 75 or the plunger assembly 248) can provide the appropriate amount of force to readily operate the apparatus in an efficient and effective manner (i.e., the operational arms 260, 261 can be repeatedly moved back and forth to provide the desired effect of moving tobacco with relative ease of the operator). Alternatively, either or both of the operational arms can be substituted with other means for providing the desired operational effect, such as in-line toggle clamp handles.

Referring to FIG. 2, there is shown an exploded view of various components of a portion of the hopper unit 99 of the cigarette-making apparatus 10 previously described with reference to FIG. 1. The upper reservoir region 110 is positioned over the top wall 114. The top wall includes a series of openings 124. Beneath the top wall 114, and positioned to the left side of each respective opening 124 is fixed wall 350. Beneath the top wall 114, and positioned to the right side of each respective opening 124 is movable wall 360. The desired location of the fixed walls 350 relative to the other components of the hopper unit 99 can be accomplished by attaching the fixed walls 350 to predetermined positions on the rear wall 370 and the front wall 140 of the hopper unit, using screws or other suitable fastening means.

Figure 2A:
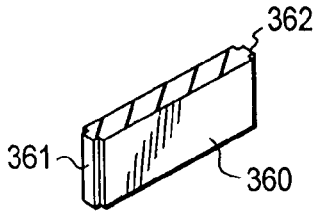
FIG. 2A is a cut-away perspective detail view of a movable wall of the hopper assembly shown in FIG. 2.

In the illustrated embodiment of FIG. 2, the movable side walls 360 each have a tongued front and rear edge 361, 362. This is shown in greater detail in FIG. 2A, which shows an enlarged cut-away perspective view along line 2A-2A of FIG. 2. The tongued rear edges 362 fit into complementary rear wall grooves 376, and the tongued front edges 361 fit into complementary front wall grooves 377. The movable walls 360 are sized and positioned between front and rear walls 140, 370 such that—with the aforementioned tongue and groove configuration—the walls 360 are movable back and forth along a front-to-rear axis. The tongued edges 361, 362 and grooves 376, 377 are sized and positioned such that, even as the walls 360 move back and forth, the tongue-and-groove maintains a patent separation of spaces on either side of each wall 360. Preferably the tolerance between each tongue and groove is sufficiently close that tobacco substantially is prevented from getting into the space between each tongue and its corresponding groove. The front edge 361 of each movable wall 360 is attached to a wall-moving handle 160. The configuration is such that a repeated movement of the wall-moving handle 160 provides corresponding movement of each movable wall, resulting in a convenient manner or method for providing a type of reciprocating movement of each movable wall. The movable walls 360 preferably are attached to the wall-moving handle 160 using screws, or other suitable fastening means, that extend slidably through the front wall 140. The hopper unit 99 also includes a bottom wall 162.

A movable slat 165 is positioned below the bottom wall 162. The slat 165 can be moved laterally along its longitudinal axis in such a manner that slat apertures 368 therein can alternately be aligned, or not aligned, with the corresponding bottom wall slots 395 in the bottom wall 162. Preferably, the slots 395 in the bottom wall 162 generally resemble the openings 124 in the top wall 114 in overall shape. However, it is preferred that the bottom wall slots 395 be slightly larger than the corresponding openings 124 in the top wall 114. For the manufacture of a cigarette from a hollow tubular rod having a tobacco rod section of about 56 mm in length and about 24.5 mm in circumference, a representative preferred opening in the bottom wall has dimensions of 12 mm wide by about 58 mm to about 60 mm deep. It is also preferred that the dimensions of the slots 395 in the bottom wall 162 be substantially identical to those of the corresponding apertures 368 in the slat 165. Controlled movement of the slat 165 is allowed by tracking slots 411 being moveable about corresponding shoulder pins 412 or other suitable means. The slat 165 can include an optional handle aperture 415 that provides a type of handle for grasping and sliding the slat 165 back and forth.

In one embodiment, the major surfaces of the fixed and movable side walls 350, 360 are all substantially vertical and parallel to each other. In certain preferred embodiments, each of the fixed and movable side walls 350, 360 is broader near its top end and tapers narrower near its bottom end. This configuration provides a vertical passage between the side walls 350, 360 that is slightly broader at its bottom than at its top. For example in one preferred configuration, the major faces of each side wall each taper about 0.5° to about 1° from vertical. Alternatively, the side walls are slightly tilted toward each other at the top to achieve this effect. A vertical passage of such a shape is preferred in that downward movement of tobacco filler of a tobacco filler column within that passage is facilitated or promoted.

For the embodiment shown in FIG. 2, the major face or inner surface of each wall 350, 360 that makes up the right and left inner face of each vertical passageway is generally flat; and hence the gradual increase in width of each passageway from top to bottom is linear in nature. However, in alternative embodiments, the major face of each panel may be modified so as to be slightly curved, and thereby provide a non-linear downward increase in the width of each passage.

FIG. 3 depicts the main base 31 of the cigarette manufacturing apparatus 10 previously described with reference to FIG. 1. The base 31 supports a tobacco filler insertion mechanism 300. The mechanism 300 includes a horizontally extending generally triangular-shaped base 310 that is, in turn, mounted on and slightly above the main base 31. The triangular base 310 can be manufactured from any suitable material, but preferably is manufactured from aluminum. A representative triangular base is about 20 cm in length, about 13 cm in width, and about 1.3 cm in height. The triangular base 310 supports three gears 316, 317, 318. The first gear 316 is larger and the second and third gears 317, 318 are smaller than the first gear 316, but about the same size as each other. The first gear 316 is operably attached to the plunger arm 261. Representative gears can be manufactured from any suitable material, such as steel or aluminum. The gears 316, 317, 318 are substantially coplanar and each is positioned so as to rotate about a vertical axis. A representative larger gear includes 48 teeth, each of 5 mm pitch. Representative smaller gears each include 32 teeth, and each tooth has a pitch of 5 mm. In the illustrated embodiment of FIG. 3, the three gears support a belt 325 that is adapted to move in a generally horizontal plane in response to a rotation of the gears 316, 317, 318. A representative belt is a slightly elastic belt composed of neoprene, rubber, or another suitable material. The representative belt has length of about 61 cm, and includes one hundred twenty two grooves each of 5 mm pitch. Also supported by triangular-shaped base 310 is a belt tensioner 328, or other suitable means for facilitating removal, tightening and operation of the belt 325.

In the assembled apparatus 10, a plunger assembly 248 (shown in FIGS. 1 and 11) is located beneath the triangular-shaped base 310, and supported above the main base 31. The base 31 also includes a first plunger stop 335 located near the rear edge of the base 31. The first plunger arm stop 335 extends upwards, and acts to limit the rearward movement of the plunger arm cross-member 257 (see FIGS. 10 and 11) of the plunger assembly 248. The base 31 also includes a second plunger arm stop 338 located forward of the first plunger arm stop 335. The second plunger arm stop 338 extends upwards, and acts to limit the forward movement of the plunger arm cross-member 257 (see FIGS. 10 and 11) of the plunger assembly 248.

The backstop wall 68 defines the front end of the base 31 and extends above its upper surface. The main base 31 includes several guidance grooves 346 within its upper face. The guidance grooves 346 extend longitudinally across the base 31. For the embodiment shown in FIG. 3, the upper face of the main base 31 includes five guidance grooves 346. The guidance grooves 346 serve as a track for the guides 728 of the plunger arm assembly 248 (see FIG. 10). One representative guidance groove design provides grooves each having a width of about 9.5 mm and a length of about 8.8 cm. Another representative guidance groove design provides grooves each having a width of about 12 mm and a length of about 9.4 cm.

The base 31 also includes a front platform portion 382 immediately rear of the backstop wall 68. The front platform portion 382 provides a region configured to support a wrapper-holding cartridge 38 in a proper position and location for making cigarettes with the apparatus 10. The main base 31 includes a broad recess 354 at the front edge of the guidance grooves 346. The dimensions of a representative opening region 354 are about 6 cm deep and about 22 cm wide. A plurality of spaced tension arms 365 is positioned within the broad recess 354. For the embodiment shown in FIG. 3, the main base 31 includes five tension arms 365. The tension arms 365 are mounted on an axle 369 that extends transversely across the broad recess 354, with its ends secured rotatably in the sides of the base 31. A plurality of spacers 372 is individually positioned about the axis between adjacent tension arms 365. The tension arms 365 are designed to pivot on the axle 369.

In the assembled apparatus 10, tension arms 365 are located beneath filling nozzles 230 of the compression assembly 75 (see FIG. 7) and each is designed to hold a corresponding tubular wrapper 21 in position during the filling operation. This holding function preferably ensures complete and consistent filling of the wrapper 21 with tobacco filler during an operation of the apparatus 10. As is explained below with reference to FIGS. 1 and 4, each tension arm 365 exerts force upon a corresponding tubular wrapper 21 during the time when the tubular wrapper 21 is being filled with tobacco filler, and facilitates maintenance of the tubular wrapper in place relative to the nozzle during that period. A representative tension arm has a height of about 3 cm, a width of about 9 mm, and a length of about 7.4 cm. Representative spacers each are cylindrical in shape and are about 13 mm outer diameter, about 6.5 mm inner diameter, and about 4 cm long. Representative spacers are manufactured from aluminum.

Figure 4:
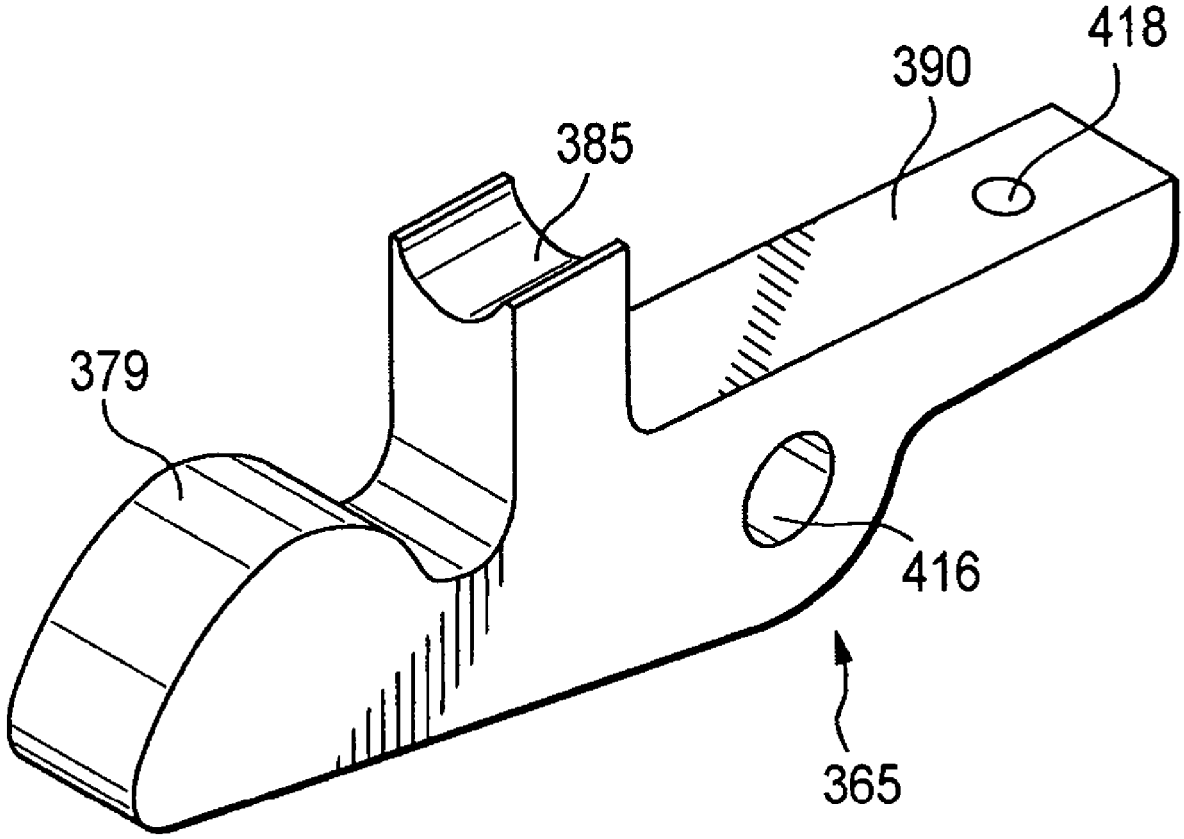
FIG. 4 is an enlarged perspective view of a tension arm of the apparatus shown in FIG. 1.

Referring to FIGS. 3 and 4, the tension arms 365 each include a front arm portion 379. Each front arm portion 379 is located in front of the axle 369. For example, a representative front arm portion extends forward about 46 mm from the center of the axle. Each front arm portion preferably is adapted and positioned so as to have the ability to extend slightly above the upper surface of the front platform portion 382 of the base 31 (e.g., about 2 mm above the base). Each front arm portion 379 is of a size and shape, and is positioned, such that it will be pushed downward when a wrapper-holding cartridge 38 is positioned on the upper surface of the front platform portion 382 of the base 31.

The tension arms 365 each include an upper arm surface 385. Each upper arm surface 385 is located in front of the axle 369. As a result, a downward movement of the front arm portion 379 of each tension arm also results in a downward movement of each respective upper arm surface 385. A representative upper arm surface has a generally concave shape and is designed to act as a support for the open end of a tubular wrapper. A representative upper arm surface corresponds to about one third of the circumference of the open end region of the tubular wrapper that is cradled thereon. Each representative upper portion extends upwards about 5 mm to about 10 mm above the upper surface of the base 31. Representative tension arms, and particularly the upper faces of those tension arms, are manufactured from nylon, or another suitable material. Representative tension arms, and particularly the upper surface of the those tension arm, also can be manufactured from metal coated with an elastomer in order to provide a surface exhibiting some friction, and thereby improving the ability of the tension arm to clamp and hold a tubular wrapper to a nozzle of the compression assembly.

The tension arms 365 each include a rear arm portion 390. In a representative embodiment, each rear arm portion extends rearwards about 28 mm from of the center of the axle. Each rear arm portion 390 of each tension arm 365 preferably is located adjacent the front end of each corresponding guidance groove 346. During an operation of the apparatus 10, the tension arms interact with the plunger arm assembly, which is described below with reference to FIG. 10.

In FIG. 3, the foremost tension arm 365 is illustrated with a tension arm spring 400 extending upward from the upper face of the rear arm portion 390. In a preferred embodiment, each of the tension arms 365 includes a tension arm spring 400. When the tension arm 365 is assembled to the apparatus 10, each of the tension arm springs 400 extends up against the underside of the compression assembly 75 that rests thereabove. A representative spring, when at rest, has a diameter of about 2 mm and a length of about 15 mm. When at rest, the springs 400 hold the tension arms 365 in a "rocked-back" position. That is, the tension arm spring 400 acts to maintain the back portion of the tension arm in a down position when (i) upward force is not being applied to the back portion, or (ii) when downward force is not being applied to the front portion.

The front platform portion 382 preferably includes a key stock 410 extending upwards therefrom. The key stock 410 provides for a convenient manner of positioning of a cartridge securely in a desired position relative to the base 31. For the embodiment shown in FIG. 3, the key stock 410 is a longitudinal protrusion with a square cross-section that extends from front to rear of the front platform portion 382. That is, the stock is designed to align with each of a series of mating grooves 515 located at pre-determined locations on the bottom face of a wrapper-holding cartridge 38 (see FIG. 5). As such, there is provided a precise and desired alignment of a set of five tubular wrappers with five corresponding nozzles 230 extending from the compression assembly 75 of the apparatus 10 (see FIGS. 1 and 4).

Referring to FIG. 4, there is shown a tension arm 365 that is representative of the design of the type of tension arm described previously with reference to FIG. 3. The tension arm 365 includes an axle passage 416 extending transversely therethrough, in order to provide a region for the axle 369 of the main base 31 to pass and hence provide a pivot axis. The top of the rear arm portion 390 includes a divot 418 that acts as a seat for a tension arm spring 400. The tension arm 365 also includes a front arm portion 379 that extends slightly upwards relative to the rear arm portion 390. The upper surface portion 385 that extends upwards relative to the forward and back regions preferably has an arcuate shape (e.g., covering about 120° to about 180°). The arcuate shape can be employed to support the end of a tubular wrapper portion and apply pressure that holds the wrapper 21 against the lower outer surface region of a nozzle 230. This function is described below in greater detail, with reference to an operation of the apparatus 10.

Referring to FIGS. 5 and 6, there are shown rear and front views of a wrapper-holding cartridge 38. As is shown in FIG. 5, the wrapper-holding cartridge 38 preferably is configured to be capable of being maintained laterally in place relative to the base of the cigarette manufacturing. Appropriate secure positioning of the wrapper-holding cartridge 38 relative to the base 31 is accomplished in the illustrated embodiment by engaging one of the mating grooves 515 with the raised key stock 410 (see FIG. 3) located on the front platform portion 382 of the base 31. Other structures and/or methods for adjusting the location of a wrapper-holding cartridge 38 on or within the cigarette manufacturing apparatus, and for securing the wrapper-holding cartridge 38 at a desired location within the apparatus 10, can be employed (e.g., through the use of clamps, adjustable threaded nuts, or the like). For the embodiment shown in FIGS. 5 and 6, the wrapper-holding cartridge 38 includes four mating grooves 515. With this configuration, a base 31 including a single protruding, cooperating key stock 410 allows for the secure alignment or registration of the wrapper-holding cartridge 38 in at least four independent positions on the base 31 of the cigarette manufacturing apparatus 10.

The wrapper-holding cartridge 38 preferably also includes at least one optional coordinating slot 535 on its bottom face at a predetermined location that is a distance apart from the location of slots 515. The coordinating slot 535 can be used in order to provide for a desired positioning of the cartridge within one or more other devices, such as, for example, an apparatus designed to fill an empty cartridge with pre-formed tubular wrappers, a device to trim the ends of tobacco charges in cigarettes on the cartridge, or a device to transfer cigarettes from the cartridge to a container. A representative device for trimming cigarette ends is described below with reference to FIGS. 12 and 13. A representative apparatus for filling a wrapper-holding cartridge 38 with empty tubular wrappers 21 is described in greater detail below with reference to FIG. 14 through FIG. 16.

The wrapper-holding cartridge 38 includes a raised region 540 on the front thereof. The raised region 540 facilitates capture and control of the filter ends of the tubular wrappers 21 within a series of preferably semi-cylindrical grooves 48 on the cartridge. As such, desired positioning of the tubular wrappers on the cartridge is promoted. When the wrapper-holding cartridge 38 is loaded with pre-formed tubular wrappers 21, the filtered ends of those tubular wrappers 21 are situated at least partially within a series of cavities 541 within the raised region 540 of the cartridge, and the open ends of those tubular wrappers 21 are oriented toward the rear of the wrapper-holding cartridge 38.

Referring to FIG. 6, there is shown a front view of the wrapper-holding cartridge 38. A series of cylindrical push-through openings 550 is aligned across the front face 548 of the wrapper-holding cartridge 38. Each opening 550 extends through the raised front region of the wrapper-holding cartridge to a corresponding cavity 541, and is aligned with a corresponding groove 48. Referring to a representative embodiment, for a cartridge adapted to contain tubular wrappers having circumferences of about 7 mm to about 8.5 mm, the representative passageway has a diameter of about 5 mm. That is, it is highly preferred that each push-through opening is not so large as to allow a wrapper cigarette to pass therethrough. The openings 550 allow for cigarettes positioned on the wrapper-holding cartridge 38 to be removed from the cartridge by inserting appropriately sized rods into the openings so as to push the cigarettes from the cartridge. A device for facilitating this operation is described below with reference to FIGS. 17 and 18.

Figure 8:
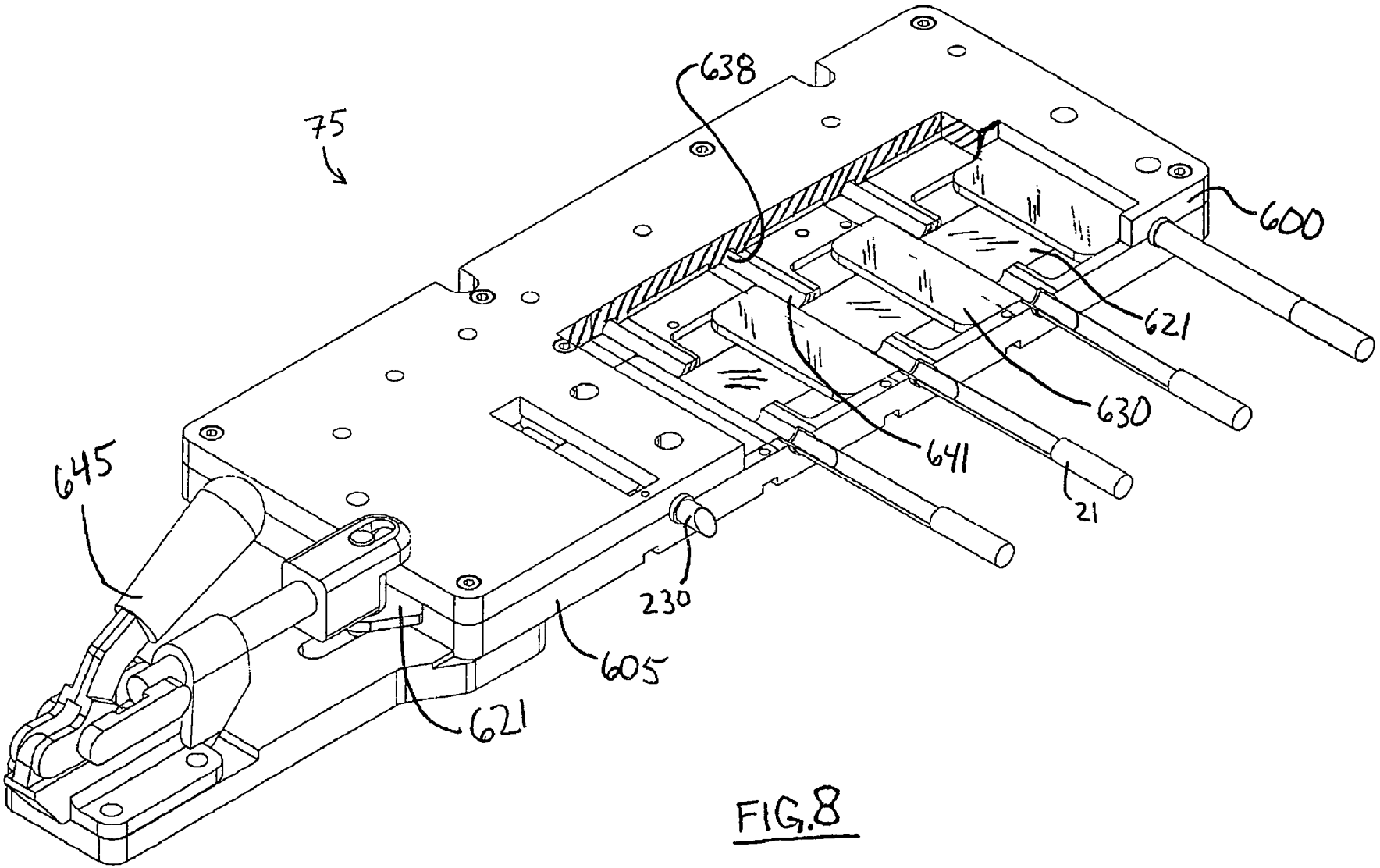
FIG. 8 is a perspective view of an alternative embodiment of a compression assembly showing the upper portion thereof as partially cut away, and showing the compression plates thereof in closed positions.

In FIGS. 7 and 8, there is shown a tobacco filler rod-forming compression assembly 75. During a preferred operation of the compression assembly 75, loose tobacco filler is arranged into a charge of tobacco, which preferably is rod-shaped. The embodiments of FIGS. 7 and 8 are substantially similar, except that the embodiment of FIG. 8 incorporates an alternative handle design. Referring to FIG. 7, the compression assembly 75 includes a top plate 600 that is shown as partially cut away. The compression assembly 75 also includes a bottom plate 605. Each of the top and bottom plates 600, 605 are connected by bolts 606, rivets, or another suitable connector means so as to remain in position relative to one another. The plates 600, 605 are also configured to be held consistently in a desired position on the main base 31 of the cigarette manufacturing apparatus 10. The top plate 600 and the bottom plate 605 each can be manufactured from any suitable material, but preferably are manufactured from brass.

In the embodiment shown in FIG. 7, the top plate 600 includes five fill slots 608 in its top plate, and each fill slot 608 extends transversely to the longitudinal axis of the compression assembly 75. The middle three fill slots 608 are in the cutaway portion of the top plate 600 and are therefore not shown in FIGS. 7 and 8; however, the entire leftmost fill slot 608 and the interior right-side portion of the rightmost fill slot 608 are shown therein. Each fill slot 608 serves as a passageway for filling a lower receptacle area 641 with a charge of tobacco filler. For the embodiment shown in FIGS. 7 and 8, the compression assembly 75 has the capability of providing five tobacco filler charges at a given time. It is highly preferred that the size and shape of each lower receptacle area, and the ability of the other components of the apparatus to supply tobacco filler to each lower receptacle area, be such that the lower receptacle can be readily filled with tobacco filler in a complete, uniform and reproducible manner.

In the embodiment of FIG. 7, a compression arm 260 is positioned at the left side of the compression assembly 75. The compression arm 260 is in operable communication with a movable compression bar 621. The compression bar 621 is movable back and forth along the longitudinal axis of the base of the compression assembly, and defines a bottom surface of each receptacle 641. Five compression plates 630 are mounted to the top of the compression bar 621 and are movable with the compression bar. A counter-clockwise movement of the compression arm 260 moves the compression bar 621 and the compression plates 630 to the right. A representative compression bar is about 32 mm wide, about 33 cm long, and about 3.5 mm thick. The compression bar may be made from any suitable material and a representative compression bar may be manufactured from any suitable metallic material, such as steel. The compression plates 630 may be manufactured from any suitable material, but preferably are manufactured from aluminum, steel or stainless steel.

The compression assembly 75 includes a set of compression assembly channels 638 that run transverse to the longitudinal axis of the assembly 75. The compression assembly channels 638 provide for passage of a series of plunger insertion arms 251 from the plunger assembly 248 therethrough. As is described in greater detail below, the plunger insertion arms 251 function to push compressed charges of tobacco filler from the lower receptacle area 641 into tubular wrappers 21.

During an operation of the compression assembly 75, a charge of tobacco filler is allowed to pass from the hopper unit 99 above into the receptacle area 641. The compression arm 260 is moved so as to move each compression bar 621 to the right, such that the compression plates 630 simultaneously move toward the right. As a result, the tobacco filler in each lower receptacle 641 is formed into a generally cylindrical charge.

When the compression assembly is in open position, as is shown in FIG. 7, a preferred receptacle 641 has a height that approximates that of each compression plate 630. Most preferably, the length of the receptacle 641 approximates that of corresponding opening in the top face of the compression assembly. Most preferably, the width of the receptacle area 641 is greater than that of the width of the corresponding fill slot 608 in the top plate 600 of the compression assembly 75. Preferably, the right wall of each receptacle area is generally concave in shape in order to accommodate the forward and backward travel of the front semi-cylindrical extension portion 695 of a plunger insertion arm 251 of the plunger assembly 248 that is used to transfer the cylindrical tobacco filler charges or rods from the receptacle area 641 to the tubular wrappers. For the manufacture of a representative cigarette from a hollow tubular rod having a tobacco rod section of about 56 mm in length and about 24.5 mm in circumference, a representative preferred receptacle area has dimensions of at least about 12 mm wide, at least about 58 mm long and about 6 mm high. Larger size receptacle areas can be used for the production of cigarettes having larger tobacco rods.

A representative compression plate has a length of about 6 cm, a width of about 24.5 mm and a thickness of about 6.3 mm. For one preferred embodiment, the compression plates are equally spaced from one another at a distance of about 2.5 cm. The manner that the compression plates 630 communicate with the compression bar 621 can vary. In some embodiments, the compression bar and compression plates extending upward therefrom can be of unitary construction. However, it is preferred that each compression plate includes a downwardly extending pin that fits into a corresponding hole within the compression plate; and as such, compression plates can be removed for servicing of the apparatus, and compression plates of desired sizes can be substituted within the apparatus.

Several filling nozzles 230 are positioned on the front of the compression assembly 75. Representative nozzles preferably are manufactured from brass or stainless steel. For the embodiment shown in FIGS. 7 and 8, the front of the compression assembly 75 includes five filling nozzles 230. Each filling nozzle 230 (shown as partially cut away) is adapted to receive the open end of a tubular wrapping portion 21 (several of which are shown as partially cut away in order to show a preferred positional relationship of the nozzles 230 relative to the tubular wrapping portions 21). Each filling nozzle 230 also is adapted to position each tubular wrapper 21 in place and to act as a passageway for a cylindrical charge of tobacco filler from a receptacle area 641 to within a corresponding tubular wrapping portion 21.

Referring to FIG. 8, there is shown a compression assembly 75 of the type described previously with reference to FIG. 7. However, the compression assembly 75 is shown with the compression plates 630 in a closed position. Specifically, the leading edge of each compression plate 630 (which preferably is concave to facilitate formation of a cylindrical tobacco filler charge) is substantially flush with the left edge of the corresponding channel 638. In addition, the compression assembly 75 shown in FIG. 8 includes an alternate type of handle mechanism 645 for moving the compression applying compressive force to the tobacco filler material within each receptacle. A representative compression handle mechanism 645 is a De-Sta-Co Industries as "Straight Line Toggle Clamp" Model 603. The use of the compression mechanism embodiments of FIGS. 7 and 8 are particularly suited for use with a cigarette-making apparatus that is bolted or otherwise affixed to a bench top.

Referring to FIG. 9, there is shown a cross-sectional partial view (taken along line 9-9 of FIG. 1) of the cigarette-making apparatus 10, as viewed from the front and showing the inner regions of the hopper unit 99 and the compression assembly 75. The hopper unit 99 includes an upper reservoir region 110, a top wall 114 having openings 124 extending therethrough, vertical passageways 675, bottom wall 162 having bottom wall slots 395, and a bottom slat 165 (which is shown such that the slat apertures 368 thereof are aligned with the bottom wall slots 395). The compression assembly 75 includes a top plate 600 with fill slots openings 608 that are aligned with the bottom wall slots 395 of the bottom wall 162 of the hopper unit 99. The compression assembly 75 is supported by base 31.

As shown in FIG. 9, the compression assembly 75 is in a closed position. As such, each compression plate 630 is shown as having been moved to the right. As described above with reference to FIGS. 7 and 8, movement of the compression plates 630 to the right is accomplished by movement of the compression arm 260, which in turn causes movement to the right of a lower compression bar 621 to which the compression plates 630 are secured. As a result, tobacco filler that has fallen into the receptacle areas 641 of the compression assembly 75 when the compression assembly was in the open position is pushed to the right by movement of each respective compression plate 630.

When the plunger assembly 248 is assembled to the compression assembly 75, the right/leading face of each compression plate 630 and the inner/left surface of each respective plunger semi-tube 695 cooperate to form a generally cylindrical region. That is, the right/leading face of each compression plate 630 is sufficiently concave to form the general shape of a semi-circle, and each cooperating plunger semi-tube 695 has the general open shape of a semi-circle. As such, movement of these two components together and into proper alignment results in the receptacle 641 taking on a generally cylindrical shape with a generally circular cross-section. As such, for each cooperating plunger semi-tube and compression plate compressed into close alignment, a generally cylindrical charge of tobacco filler is formed.

For the hopper unit 99, each fixed wall 350 of each vertical passageway 675 is shown so as to be substantially vertical. Each movable wall 360 is positioned at a slight angle relative to vertical, such that the width of the vertical passageway 675 is slightly greater near the bottom than near the top. For example, each movable wall 360 is positioned at an angle of 1° off vertical, tapering outwards toward its bottom. In different embodiments, any or all of the walls 350, 360 may be vertical or slightly angled, but in preferred embodiments, the movable walls 360 are at least slightly angled. The weights 177 of the hopper assembly 80 are shown in a lowered position, such that each weight 177 extends within the corresponding vertical passageway 675 of the hopper unit 99.

Figure 10:
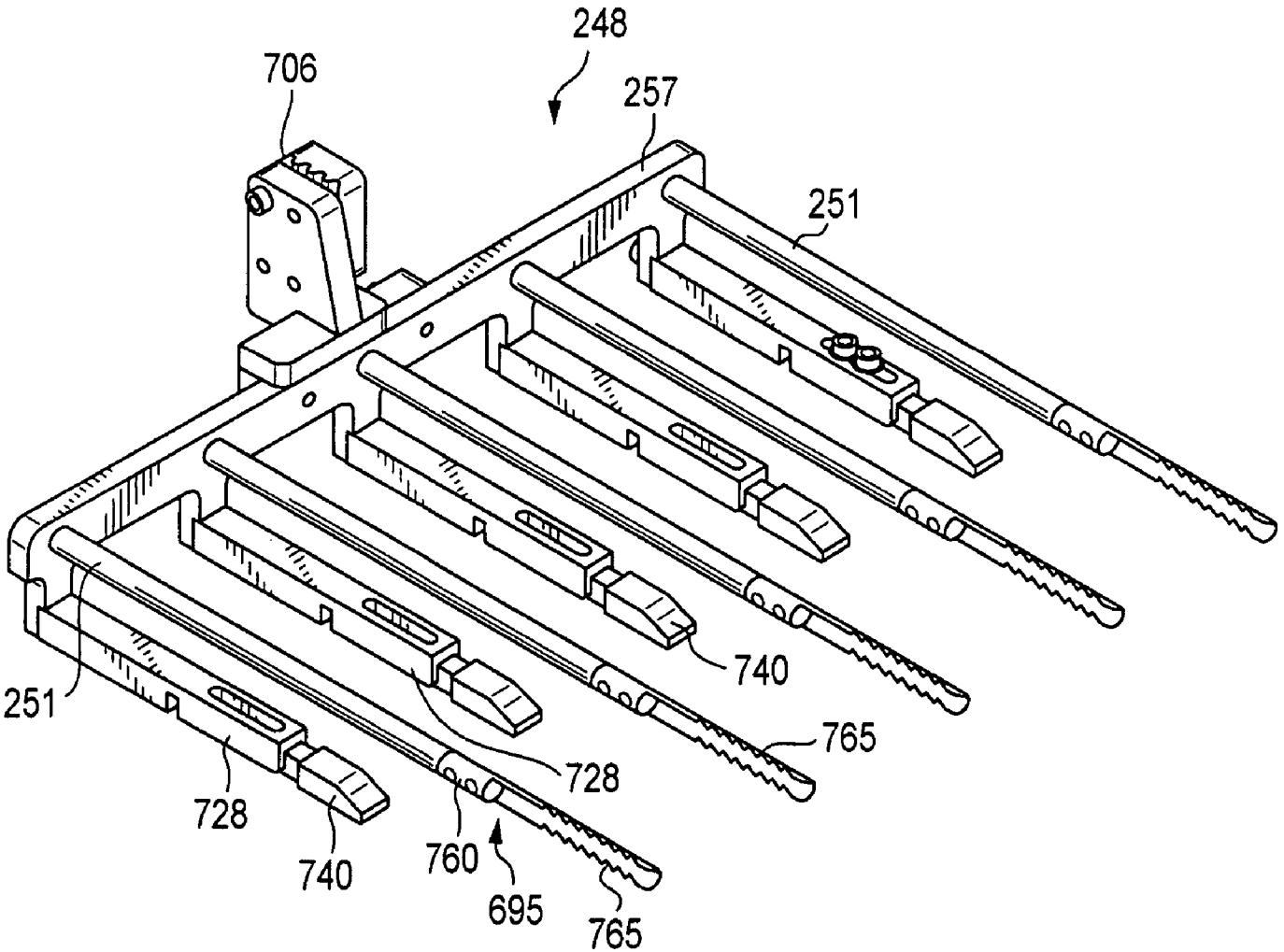
FIG. 10 is a perspective view of the plunger assembly of the apparatus shown in FIG. 1.

Referring to FIG. 10, there are shown components of the plunger assembly 248. The plunger assembly 248 includes a clamp or bracket 706, or other suitable means, for secure attachment of the assembly to the belt 325 of the tobacco filler insertion/plunger mechanism 248. Any suitable clamp or other attachment means may be used to attach the plunger assembly 248 to the belt 325. In the illustrated embodiment, the clamp 706 is secured to a cross-member 257 using screws, bolts, spot weld, or other fastening means, or through a unitary construction design.

Protrusions from the lower edge of the cross-member 257 support several forward-extending guides 728. The guides 728 may be manufactured from any suitable material, but preferably are manufactured from aluminum. A tension release wedge 740 is positioned at the front face of each guide. Each tension release wedge 740 is designed to cooperate with a corresponding tension arm located on the base 31 (as described above). A representative forward facing guide and release wedge assembly extends forward from the cross-member 257 by about 10 cm, and a representative wedge is about 7 mm high and about 9 mm wide. The front face of a representative release wedge is configured such that the face slopes downward from back to front. That is, the shape of each tension release wedge can be designed to cooperate with a corresponding shape of the rear arm portion 390 of each tension control arm 365. In essence, the forward movement of the release wedge 740 acts as a cam to move the rear arm portion 390, which acts as a cam follower. The result when the wedge 740 is moved forward is an upward movement of the rear arm portion 390 of the tension arm 365.

A plunger arm 251 is positioned above each guide arm 728, such that each plunger arm 251 extends essentially parallel to each guide arm 728 and is supported by the cross-member 257. For the embodiment shown in FIG. 10, the plunger assembly 248 includes five plunger arms 251. Representative plunger arms can be manufactured from any suitable material, but preferably are manufactured from stainless steel. A representative plunger arm has dimensions of about 6.35 mm in diameter and about 15 cm in length.

Extending from the front face of each plunger arm 251 is a plunger partial tube or semi-tube 695, or other suitable means for insertion of tobacco filler into a tubular wrapper portion. The plunger semi-tube 695 is securely attached to the front end of the plunger arm 251, using any suitable fastening means, such as, for example, unitary construction, spot weld, recessed rivets, adhesive, or recessed nuts and bolts. As another example, the plunger semi-tube 695 can include a tube portion that fits over the front end of a cooperating plunger arm 251 and is crimped thereabout.

The design of each plunger semi-tube 695 can vary. One preferred design for a plunger semi-tube 695 is a generally semi-cylindrical tube with a generally cylindrical base portion 760 attaching it to a corresponding plunger insertion arm 251. A representative plunger semi-tube is about 67 mm long; about 15 mm thereof is a generally tubular region that fits over the front end of the plunger insertion arm, and about 52 mm thereof is a generally semi-cylindrical region. A preferred semi-tube 695 incorporates a plurality of teeth 765 on each side edge thereof (i.e., the semi-tubular section includes two rows of teeth making the two sides serrated). In a representative embodiment each row of teeth located about 8 mm from the extreme front end of the semi-tubular section and extends about 28 mm along its length. Preferably the teeth are angled toward the tip or front of the plunger arm assembly 248. A plunger semi-tube having serrated side edges facilitates effective forward movement of tobacco filler into a tubular wrapper portion, and also facilitates ready removal of the plunger semi-tube from the tubular wrapper portion while minimizing the likelihood of tobacco filler being pulled out of the tubular wrapping portion. Preferably the serrations are directed toward the inner portion of the semi-tube in order to minimize the likelihood that movement thereof might damage a tubular wrapping portion into which tobacco is being inserted.

Each plunger semi-tube 695 can be manufactured from any suitable material, but preferably is manufactured from a metallic material, such as stainless steel. For example, a stainless steel tube of appropriate size (e.g., having a circular cross-section of about 5.5 mm inner diameter and about 6.35 mm outer diameter) can be machined to provide a plunger semi-tube of appropriate shape. Representative plunger semi-tube designs are incorporated in those types of cigarette-making devices that have been commercially available as "Premier Supermatic"™ from The Central Tobacco Mfg. Co. Ltd.

Figure 11:
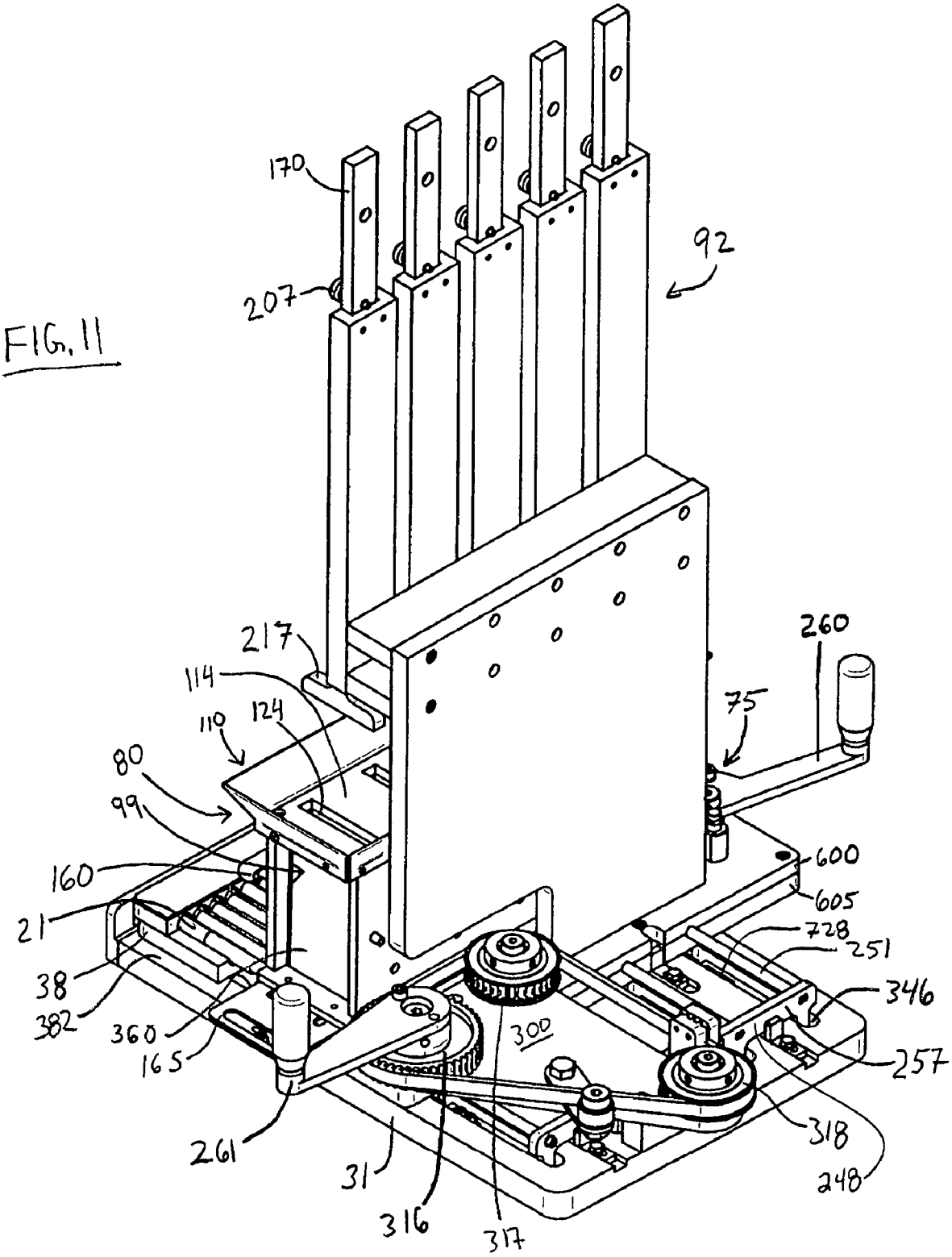
FIG. 11 is a perspective view the apparatus shown in FIG. 1 showing a rear view of that apparatus.

Referring to FIG. 11, there is shown a rear perspective view of the cigarette manufacturing apparatus 10 described previously with reference to FIG. 1. In operation, the apparatus 10 preferably is positioned firmly in place on a table, bench, counter, or the like. If desired, the bottom of the base 31 can be equipped with non-skid components (not shown), such as rubber legs, or the like. Alternatively, the apparatus can be permanently affixed to components of a work station. For example, the apparatus can be bolted, clamped, or otherwise secured, to a bench top.

During an operation of the apparatus 10, loose tobacco filler material is placed in the upper reservoir region 110 of the hopper assembly 80. Most preferably, the tobacco filler has the form of cut filler of a desirable particle size, and the tobacco filler is substantially absent of tobacco dust or fines. The tobacco filler is gently moved over each opening 124 in the top wall 114 of the hopper unit 99 so that the tobacco filler falls into each corresponding vertical passageway 675, and into the lower region of the hopper unit 99. Preferably, for the embodiment shown, sufficient loose tobacco filler is introduced into the hopper assembly 99 to provide for adequate manufacture of more than twenty cigarettes. Manipulation of the ball slides 170 to effect downward movement of each weight 177 into each respective opening 124 provides a desired compression of the tobacco filler in the lower region of the hopper assembly 99. Reciprocating movement of the wall-moving handle 160 moves the movable walls 360 and preferably promotes settling of tobacco filler within each vertical passageway. As such, consistent or uniform filling of the relevant region with a consistent or uniform amount of tobacco filler is promoted.

Counter-clockwise movement of the compression arm 260 provides for formation of cylindrical charges of tobacco filler in the receptacle areas 641 of the compression assembly 75, as is described above with reference to FIGS. 7, 8, and 10. As such, components of the compression assembly 75 alter the arrangement of tobacco filler within each receptacle 641 within the compression assembly 75 to form several tobacco filler charges.

Explanation of an operation of the tension arms and other components is best made with reference to FIGS. 1, 3, 5, 10, and 11. In a method of operation, a wrapper-holding cartridge 38 is placed on the front platform portion 382 of the base 31. The alignment of a tubular wrapper portion with each nozzle 230 of the compression assembly 75 is such that the longitudinal axes of the nozzles 230 and the longitudinal axes of the tubular wrapper portions 21 are essentially parallel to one another. Such alignment is facilitated by fitting a mating groove 515 located on the bottom face of a wrapper-holding cartridge 38 with the key stock 410 protruding from the forward upper face 382 of the base 31. However, it is preferred that, for a nozzle 230 having its bottom region protruding relative to its top region, the bottom region of a corresponding tubular wrapping portion rests about 2 mm to about 3 mm below the bottom portion of the nozzle. The wrapper-holding cartridge 38 is moved rearward toward the tension arms 365. Preferably, the movement of the cartridge is performed manually by an operator, and the cartridge is moved about 2 cm toward the rear of the base 31. As the wrapper-holding cartridge 38 is moved toward the tension arms 365, each corresponding tubular wrapper portion 21 preferably will ride up and fit over the corresponding nozzle 230. Simultaneously, movement of the wrapper-holding cartridge 38 against the front arm portions 379 of the tension arms 365 causes the front arm portion 379 of each arm 360 to move downward. Downward movement of the front arm portion 379 of each tension arm 365 results in formation of a space between the upper arm surface 385 of each tension arm 365 and a corresponding nozzle 230, and hence provides clearance to allow the tubular wrapper portion 21 to slide over the nozzle 230. That is, as each tension arm 365 rocks forward, each corresponding concave upper arm surface 385 cradles and lifts a tubular wrapper end from the wrapper-holding cartridge 38 and allows the open end of each tubular wrapper 21 to ride over each cooperating nozzle 230. The forward rocking movement of the tension arms 365 also compresses the tension arm springs 400. The wrapper-holding cartridge 38 preferably then is moved forward, away from the tension arms 365. Preferably, movement of the wrapper-holding cartridge 38 is performed manually by the operator, such that the cartridge is moved about 2 cm toward the front of the base 31 and rests against the backstop wall 68.

This forward movement of the wrapper-holding cartridge 38 away from the tension arms 365 results in release of downward force thereupon. As a result, each tension arm spring 400 uncompresses and forces pivoting of each tension arm 365 rearward such that each upper arm surface 385 thereof moves upward and pushes a portion of the tubular wrapping portion against the nozzle (i.e., applies a clamping force to the tubular wrapping portion). That is, release of downward force on the front portion of each tension arm 365 results in an upward movement of each upper arm surface 385, which clamps the lower inner surface of a corresponding tubular wrapper 21 against the lower outer surface of a corresponding nozzle 230. As such, each tubular wrapper 21 is held securely in place so that a cylindrical charge of tobacco filler may be transferred from the compression assembly 75 into the open end of the tubular wrapper 21.

Movement of the plunger arm 261 works through the gears of the insertion mechanism 300 to cause forward movement of the of the plunger insertion arms 251 of the plunger assembly 248. That is, each plunger insertion arm 251 travels forward parallel to and above each corresponding guidance groove 346 as the forward-extending guides 728 extending from the underside of the plunger arm cross-member 257 track through the guidance grooves 346. The plunger arm assembly is explained in greater detail with reference to FIG. 10. A forward movement operation of the plunger assembly 248 causes the tubular wrapper portion 21 that is clamped to a nozzle 230 of the compression assembly 75 to be filled with a formed charge of tobacco filler. (Operation of the compression assembly 75 to form charges of tobacco filler is explained in greater detail with reference to FIGS. 7 and 8.)

When the plunger assembly 248 has been moved forward sufficiently to fill the tubular wrapper portion 21 with a charge of tobacco filler, the front face of each tension release wedge 740 at the forward end of each forward-extending guide arm 728 reaches and contacts the rear arm portion 390 of each corresponding tension arm 365. This contact causes a slight upward movement of the rear arm portion 390 of each tension arm 365. As a result, the upper arm surface 385 of each tension arm 365 is moved downwards. This downward movement of each upper arm surface 385 results in release of the clamping force on the tubular wrapping portion 21 to each corresponding nozzle 230, and each resulting finished cigarette is released from the corresponding nozzle. Rearward movement of the plunger assembly 248 results in release of the upward pressure on the rear arm portion 390 of each tension arm 365, and each tension arm 365 is allowed to move freely back to its original position. This completes a single manufacturing operation cycle for one sub-lot of cigarettes (five cigarettes in the illustrated apparatus 10).

The wrapper-holding cartridge 38 then can be moved on the base 31 to either the left or right to align five more empty tubular wrapping portions 21 with the corresponding nozzles 230 of the compression assembly 75. The manufacturing operation cycle of filling five more tubular wrapping portions 21 with five corresponding charges of tobacco filler, preferably of consistent density, can then be repeated. It is highly preferred that the cigarettes are manufactured without damaging (e.g., tearing) the wrapping material at their lighting ends.

Referring to FIGS. 1, 3, 10, and 11, the gears 316, 317, 318 and the belt 325 are arranged on the triangular-shaped base so as to undergo movement in response to movement of plunger arm 261. A counter-clockwise movement of the plunger arm 261 results in movement the larger gear 318, which consequently causes movement by the belt 325 of the plunger insertion assembly 248. Movement of the belt 325 results in forward movement of the plunger mechanism, which in turn, results in the transfer or injection of each respective tobacco filler charge into each respective tubular wrapper as described above. As a result, substantially all of the tobacco filler contained within each receptacle area 641 is formed into a cylindrical charge and is evacuated from the receptacle areas 641. As such, several finished cigarettes 13 are provided on the wrapper-holding cartridge 38. A complete forward movement of the plunger arm 261 also causes release of each formed cigarette 13 from each respective nozzle 230 as the plunger insertion arms 251 push the cigarettes off. It is highly preferred that the extreme front end of each plunger semi-tube 695 move forward a sufficient distance so as to very closely approach, or contact, the filter element of the tubular wrapping portions 21. As such, uniform filling of the tubular wrapper 21 with tobacco filler is facilitated.

A clockwise movement of the plunger arm 261 results in rearward movement of the plunger assembly 248. A clockwise movement of the compression arm 260 results in leftward movement of the compression plates 630 within the compression assembly 75. When the compression plates 630 are moved to the open position (i.e., to the left) another portion of tobacco filler from each corresponding vertical passageway is allowed to fall into each respective receptacle. Typically, the amount of tobacco filler within each receptacle is controlled such that the tobacco filler fills the height of the receptacle (e.g., the approximate height/thickness of the compression plate), as well as the width and depth of the receptacle area 641.

Weight applied to tobacco filler (not shown) in each vertical passageway of the hopper unit 99, and movement of the wall-moving handle 160 located on the front of the hopper unit, act to promote control of a consistent amount of tobacco filler within each receptacle. In a preferred operation, the wrapper-holding cartridge 38 is moved to the right, backward and forward movement of the cartridge (to affix a set of tubular wrappers 21 to corresponding nozzles 230, as described above) is repeated, and the movement of each of the compression arm 260 and plunger arm 261 is repeated, and as such, five more tubular wrappers 21 are filled with tobacco filler. The weight 177 that has been dropped into each vertically extending passageway can be lifted in order to allow additional tobacco filler to be introduced into each passageway. In this manner, an adequate supply of tobacco filler within each receptacle for formation of a tobacco filler charge of the desired density is facilitated. However, in a highly preferred embodiment of using the apparatus, sufficient tobacco filler will already have been positioned within each vertically extending passageway to provide for successive filling of each receptacle with an adequate and consistent amount of tobacco filler during preparation of further finished cigarettes.

With the illustrated embodiment, the above-described process can be repeated a total of four times, with the preferred result being that a lot of twenty substantially identical cigarettes are manufactured and contained within the cartridge. For each cigarette manufactured in accordance with the foregoing process, it is highly desirable to have sufficient tobacco filler in each vertically extending passageway above each receptacle to ensure supply of an adequate amount of tobacco filler within each receptacle, and hence to provide for consistent filling of each pre-formed tubular wrapper with the desired amount of tobacco filler. That is, it is highly desirable that whenever tobacco filler within a receptacle is compressed into a first cylindrical charge, there be adequate tobacco filler positioned in the vertically extending passageway above the tobacco filler in that receptacle to provide for at least three more tobacco charges substantially similar in volume and density as the first charge.

When complete, the wrapper-holding cartridge 38 containing manufactured cigarettes can be removed from the cigarette-making apparatus 10. In addition, the slat 165 located on the bottom of the hopper unit can be shifted to the closed position, the weights 170 can be raised, and the hopper unit 99 can be refilled with tobacco filler, or removed from the cigarette-making apparatus 10 and replaced with another hopper unit 99. When the loose tobacco filler is handled and used to manufacture cigarettes in accordance with the present invention, it is highly preferred that the various pieces of tobacco material that make up that tobacco filler undergo an extremely low degree of breakage or degradation. That is, it is highly preferred that the cigarette-making device be operated so as to cause an extremely low degree of degradation of the tobacco filler.

For the embodiments described with reference to FIG. 1 through FIG. 11, exemplary materials and designs for compression assembly components, tension arms, nozzles for tobacco filler transport and plunger assembly components also are of the type that have been incorporated in those types of cigarette-making devices that have been commercially available as Premier Supermatic from The Central Tobacco Mfg. Co. Ltd., and "Escort" and "Pressta Deluxe" by CTC Canada Inc. See, also, those component materials, component designs and component operation descriptions set forth in U.S. Pat. No. 3,127,900 to Kastner and U.S. Pat. No. 4,771,793 to Kastner, each which is incorporated herein by reference in its entirety.

For a preferred cigarette manufacturing apparatus 10, and components thereof, described with reference to FIG. 1 through FIG. 11, that apparatus 10 is designed to produce five cigarettes substantially simultaneously, and the wrapper-holding cartridge 38 thereof is designed to hold twenty cigarettes. Suitable alterations to the apparatus and its components can be made to produce any number of cigarettes at a given time (e.g., two, four, ten, twenty, or more). Suitable alterations also can be made to provide a cartridge capable of supporting any number of cigarettes at a given time (e.g., three, five, ten, thirty, forty, or more). Exemplary devices can be characterized as those incorporating (a) at least two receptacle areas and including cartridges capable of holding at least ten tubular wrapping portions; (b) at least four receptacles and cartridges capable of holding at least twenty tubular wrapping portions; (c) at least five receptacles and cartridges holding at least ten tubular wrapping portions; (d) at least five receptacles and cartridges holding no more than forty tubular wrapping portions; or (e) no more than five receptacles and cartridges holding no more than twenty tubular wrapping portions. Furthermore, the cigarette manufacturing apparatus can be designed and adapted to introduce tobacco filler into tubular wrapping portions of larger or smaller size (e.g., the plunger arms and receptacles can be made longer to fill hollow tubular wrapper portions of longer length).

For a preferred cigarette manufacturing apparatus, and components thereof, described with reference to FIG. 1 through FIG. 11, that apparatus 10 preferably is designed to produce small lots or batches of cigarettes having consistent quality. For a particular selection of tobacco filler (e.g., as determined by factors such as composition, particle size, moisture content, and the like), and for pre-formed tubular wrappers of a particular size (e.g., as determined by factors such as the length and circumference of the hollow region), a plurality of cigarettes can be made to specification by appropriate control of the operation of various components of the apparatus. The size of the tobacco filler charge used to fill each hollow tubular wrapper portion can be controlled; for example, by selecting appropriate dimensions of each vertical passageway, of each lower receptacle, of the compression bars and associated components, and of the insertion arms and associated components. Preferably, the size of the tobacco charge is such that it effectively and efficiently fills the hollow space of a pre-formed wrapper. The dimensions of the various nozzles of the compression assembly can be appropriately altered in order to produce cigarettes of desired circumference. The components of the compression and insertion mechanisms are designed to be set and operated in order that tobacco filler charges are formed and inserted into hollow tubular wrapper portions consistently and in a controlled manner. Each compression chamber is filled with tobacco filler in an automated fashion; and hence, precise control of amount of tobacco filler supplied to each compression chamber is achieved. Thus, supply of a consistent amount of tobacco filler within each tobacco filler charge is accomplished by controlling the density of the tobacco filler in each compression region prior to the time that the tobacco filler is compressed into a the form of a cylindrical charge to insertion into the hollow tubular wrapper portion.

Other manners or methods can be employed in order to ensure that a controlled amount of tobacco filler is distributed within each vertically extending passageway and each cooperating receptacle. For example, in an alternative embodiment (that is not illustrated), the bottom region of each receptacle of the compression assembly can be adapted so as to be composed of a fine mesh screen or foraminous material. That porous region can be adapted so as to be in communication with a slight vacuum (e.g., as can be provided by appropriate connection to a vacuum source, such as a laboratory vacuum source). As such, the negative air pressure applied to the bottom region of each receptacle can act to pull tobacco filler material downward, and hence adequately fill each receptacle with a uniform and controlled amount of tobacco filler. The degree of vacuum pulled on each column of tobacco filler within each respective vertical passageway and receptacle can be altered depending upon factors such as the amount of tobacco filler within each vertical passageway.

Another manner or method for ensuring that a controlled amount of tobacco filler is distributed within each vertically extending passageway and each cooperating receptacle involves the use of a hydraulic plunger or spring mechanism. For example, for an embodiment that is not shown, a hydraulically-operated plunger can be used to apply downward force to the tobacco filler in each vertical passageway, and the amount of force applied to the tobacco filler can be decreased as the amount of tobacco filler in the vertical passageway decreases. As another example of an embodiment that is not shown, a resistance spring can be positioned so as to vertically extend around an appropriately configured weight such that the weight can extend into the vertical passageway and the spring rests on the top wall of the hopper unit. As such, as tobacco filler is removed from each vertical passageway as a result of cigarette manufacture, the weight falls further into the vertical passageway, and the resulting compression of the spring results in the application of less downward compressive force by the weight to the tobacco filler.

Figure 12:
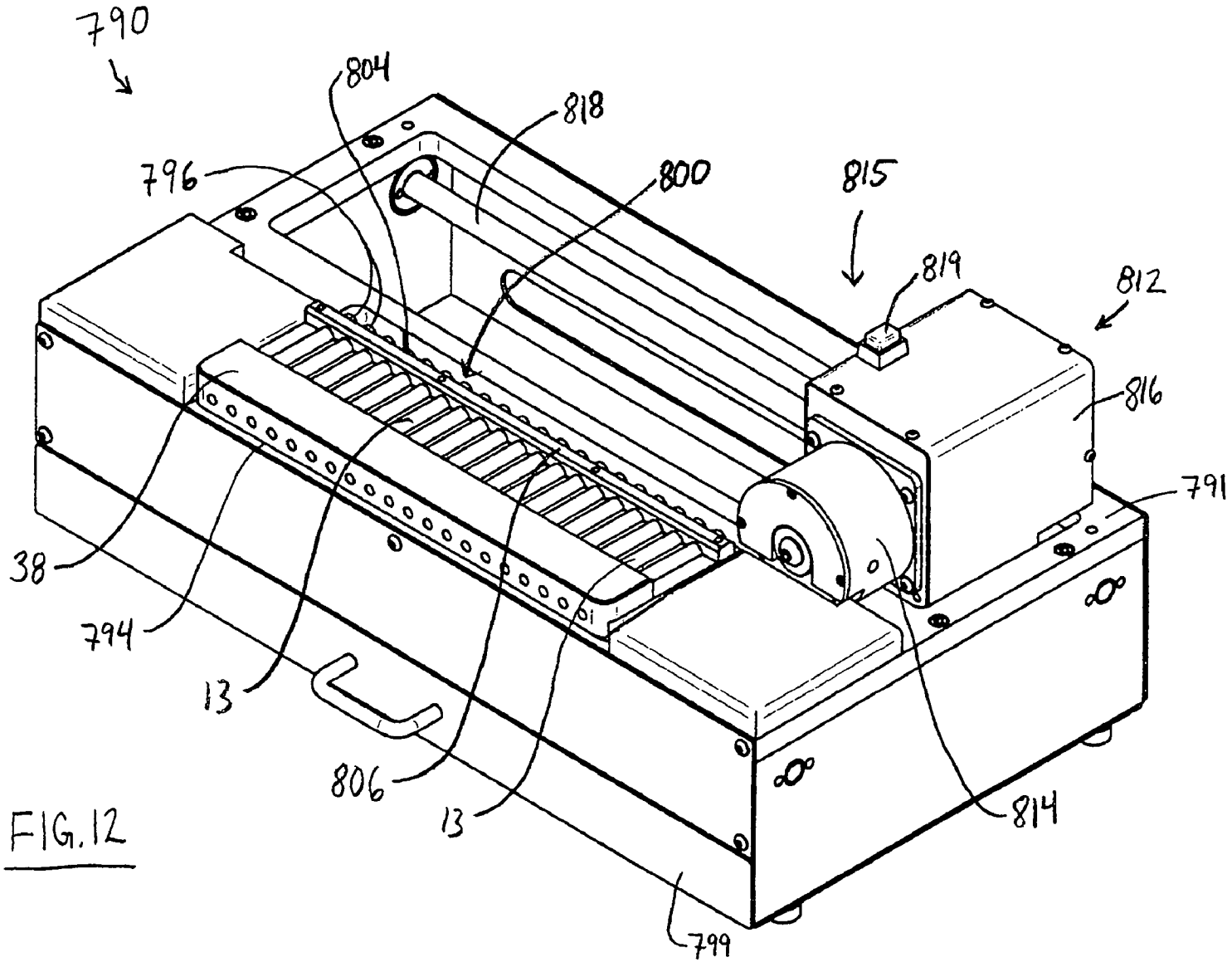
FIG. 12 is a perspective view of an apparatus for trimming tobacco strands from the ends of cigarettes.
Figure 13:
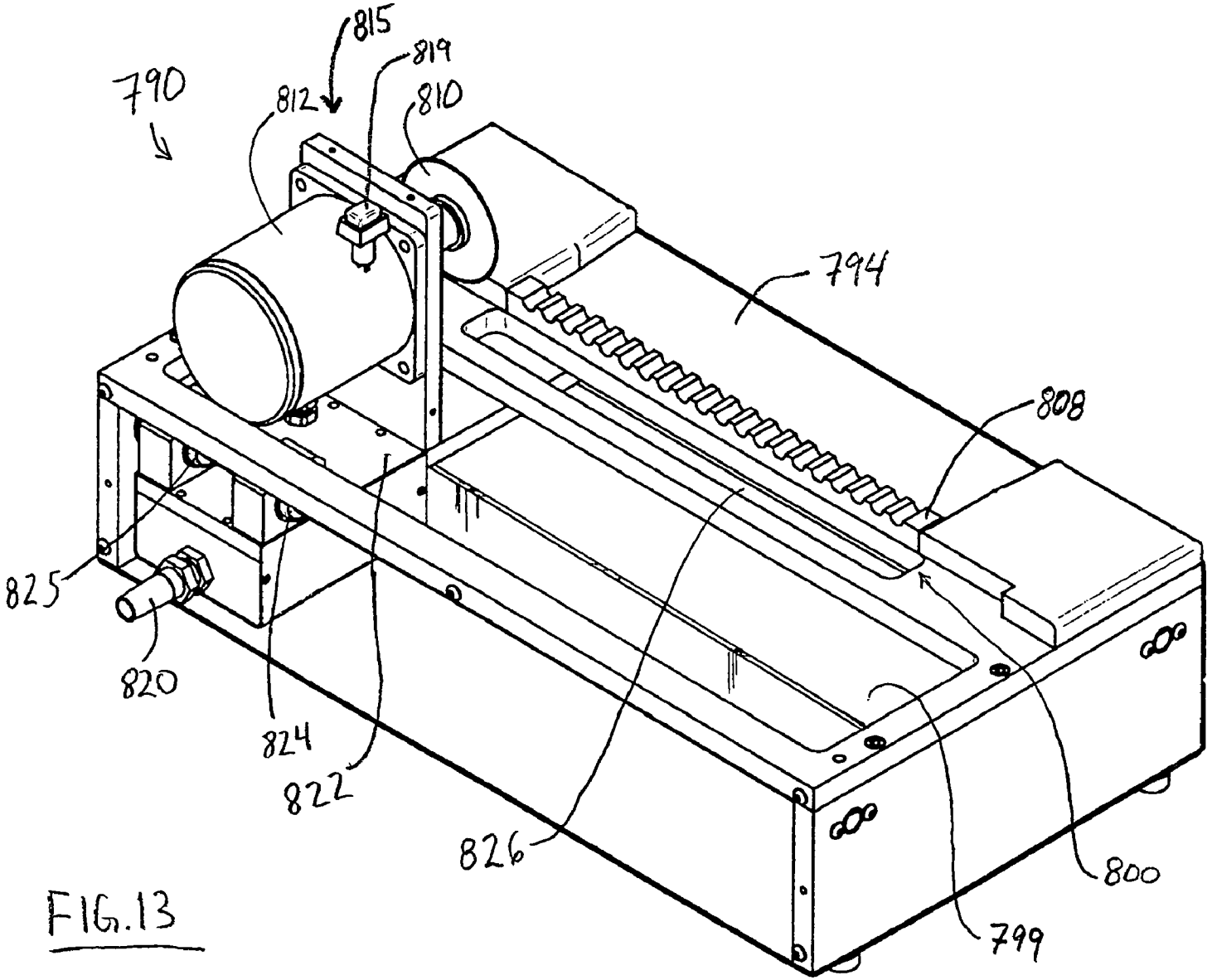
FIG. 13 is a perspective of the apparatus shown in FIG. 12 showing a rear view of that apparatus.

Referring to FIGS. 12 and 13, there is shown a trimming device 790 for trimming tobacco filler from the ends of finished cigarettes 13. The various components of the frame and chassis 791 of that device 790 preferably are manufactured from a metallic material, such as aluminum. A wrapper-holding cartridge 38 with finished cigarettes 13 lying in its grooves 48 is positioned on a cartridge-holding platform 794 in the top, front region of the device 790. Preferably, the filter ends of the cigarettes 13 all extend into the cavities 541 of the inner front face of the cartridge, such that the lighting ends 796 are all aligned across the back of the wrapper-holding cartridge 38. The ends of the cigarettes 13 in the wrapper-holding cartridge 38 extend beyond the back edge of the cartridge. A removable tray 799 is located beneath the cutting region 800 and is used to collect tobacco particles trimmed from the lighting ends of the cigarettes 13.

The rear face of the wrapper-holding cartridge 38 abuts a static lower ledger bar 808 of a ledger that extends across the rear of the cartridge-holding platform 794. The grooved upper face of the lower ledger bar 808 is adapted to be aligned with the grooves 48 in the upper face of the cartridge. Thus, when the cartridge is placed on the trimming device 790, each cigarette 13 rests in a groove 48 on the wrapper-holding cartridge 38 and a corresponding groove in the lower ledger bar 808. A movable upper ledger bar 806 has a bottom face that is configured to complement the shape of the cigarettes resting in the lower ledger bar 808. The movable upper ledger bar 806 can be removable so as to be placed by hand over the lower ledger bar 808, and thereby form the top of the ledger 804. The upper ledger bar 806 can be attached in place by clips, or another suitable fastening means. The upper ledger bar 806 also can be attached in place but movable relative to the lower ledger bar 808 by use of an appropriately positioned hinge, or other suitable means. Preferably, the ledger 804 is manufactured from a suitable metallic material, such as brass. Preferably, the back faces of the lower ledger bar 808 and the upper ledger bar 806 are vertically aligned with one another. Most preferably, when the wrapper-holding cartridge 38 is in place and the ledger 804 is closed, the preferred lighting tips of the cigarettes 13 (as defined by the ends of the tubular wrappers 21) are aligned with the back faces of each of the lower and upper ledger bars 808, 806.

During an operation of the trimming device 790, a circular cutting blade 810 is rotated at a very high rate of speed (e.g., 1200-2000 rpm) by a motor 812. The circular cutting blade/cutter 810 optionally is covered by a blade housing 814. The motor 812 also may be covered by an optional motor housing 816. A representative motor is available as an induction motor 25 W (1/30 HP), 115V P/N 41K25A-AWU from Oriental Motor U.S.A Corp. A representative cutter constructed of tungsten carbide, and has a diameter of about 62 mm and a thickness of about 0.3 mm. The blade and motor assembly preferably is securely mounted on a bar 818, or other suitable support means, such that the rotating cutter can be moved back and forth. A representative bar is a ground and polished stainless steel rod of about 12 mm diameter. In an alternative embodiment, a reciprocating cutting blade or other cutting means may be used rather than a rotating blade.

The cutter 810 preferably is mounted perpendicularly to the longitudinal axes of the cigarettes 13 in the wrapper-holding cartridge 38, and so that it rotates in a vertical plane. The cutter 810 also is positioned so as pass very close to the lighting ends of the cigarettes 13. That is, the cutter 810 is positioned so as to pass very close to the rear face of the ledger 804, and hence, very close to the lighting ends of the cigarettes (as defined by the ends of the tubular wrappers 21).

In use, the wrapper-holding cartridge 38, containing cigarettes 13, is placed on the trimming device 790, and the ends of the cigarettes 13 extending from the rear of the wrapper-holding cartridge 38 rest in the corresponding grooves of the lower ledger bar 808. The upper ledger bar 806 is positioned over the cigarettes 38 to hold them in place. The motor 812 is started by activating at switch 819, and the cutter 810 is rotated at a very high rate of speed (e.g., at about 1450 rpm). The cutter 810 is moved from one end of the trimming device 790 to the other such that the cutter trims away tobacco filler extending from the ends of the cigarettes 13. As such, the lighting end of each cigarette 13 preferably resembles in appearance the lighting end of a mass-produced cigarette manufactured using high-speed automated cigarette-making equipment, such as the type set forth in U.S. Pat. No. 4,474,190 to Brand.

Referring to FIG. 13, there is shown a rear view of the cigarette trimming device 790 described previously with reference to FIG. 12. The cutter blade 810 and motor 812 are shown without coverings or housings of the type shown in FIG. 12. The trimming device 790 includes a connection 820 for attachment to an electrical power source. The lower ledger bar 808 is positioned such that the cutter 810 passes closely across its rear face. The assembly 815, including both the motor 812 and cutter 810, is mounted on a frame support 822 equipped with a pair of sleeve bearings 824, 825, preferably having a 12 mm inner diameter. The sleeve bearings 824, 825 of the frame support 822 travel along the support bar 818 (not visible in FIG. 13, see FIG. 12). The sleeve bearings 824, 825 allow the cutter and motor assembly 815 to slide back and forth across a relevant region of the device 790. If desired, the cutter and motor assembly 815 alternatively can be mounted on a rail mechanism, ball slides, or other suitable movable support means. Preferably, the cutting edge of the cutter blade 810 is positioned so as to be spaced no more than about 0.5 mm from the rear face of the lower ledger bar 808. The device 790 also includes a support region for a wrapper-holding cartridge 38. A longitudinal waste aperture 826 is located just rear of the lower ledger bar 808 on the top face of the device, and is employed such that tobacco particles trimmed from the ends of cigarettes (not shown) can fall into the lower tray 799 of the device 790 for disposal. Other mechanisms or methods for ensuring that the tobacco filler of the tobacco rod does not extend beyond the end of the rod defined by the paper wrapper to any significant degree, within the scope of the present invention, will be apparent to those skilled in the art of cigarette manufacture.

Referring to FIG. 14, there is shown a cartridge-filling device 830 for filling a cartridge with empty pre-formed tubular wrappers 21. The cartridge-filling device 830 includes a base 831 that supports a cartridge-loading platform 832 and a tubular wrapper supply assembly 833. These components can be manufactured from any suitable material, but preferably are manufactured from a metallic material, such as aluminum. A representative preferred cartridge-loading platform includes polytetrafluoroethylene.

The cartridge-loading platform 832 includes a key stock 834 for maintaining a suitably configured cartridge (e.g., a wrapper-holding cartridge 38, as shown in FIGS. 5 and 6) in place, and an upwardly extending backstop 839 for preventing undesirable forward movement of the cartridge during use of the cartridge-filling device 830. It is highly preferred that tubular wrapper portions 21 being loaded onto the cartridge are positioned on their sides, substantially parallel to each other, and perpendicular to the longitudinal axis of the cartridge-loading platform 832. Preferably, the cartridge-loading platform 832 is disposed at a slight rear-to-front incline such that its front edge with the backstop 839 is lower than its rear edge.

The supply assembly 833 includes a movable upper reservoir 845 adapted to hold a container 848 of tubular wrappers (box shown as empty). A representative container 848 is a paperboard box containing two hundred pre-formed filtered tubular wrappers, each of which is about 24 mm in circumference and about 86 mm in length; and a representative box is about 85 mm in height, about 90 mm in width, and about 145 mm in length. For the embodiment shown, the paperboard box 848 and the upper reservoir 845 each are shown in an open position.

The supply assembly 833 also includes a hopper 851 that provides for alignment of a plurality of tubular wrappers. For the embodiment shown in FIGS. 14 and 15, the hopper 851 provides for the linear alignment of ten tubular wrappers. The hopper 851 is adapted to receive tubular wrappers from an open container 848 when the upper reservoir 845 is rotated about a hinge 854 so as to mate the bottom face 857 of the upper reservoir 845 with the top face 858 of the hopper 851 and thereby provide the supply assembly 833 in a closed position (see FIG. 15). The bottom face 857 of the upper reservoir 845 and the top face 858 of the hopper 851 are complementary in size and shape such that tubular wrappers readily can be emptied from the container 848 into the hopper 851. Each tubular wrapper entering the upper region of the hopper 851 preferably falls into one of a plurality of vertical passageways 862. The walls of the passageways 862, as well as the front and side walls of the hopper 851, preferably are manufactured from a clear material, such as, for example, a clear plastic, so that supply of wrappers in each passageway can readily be viewed. Alternatively, the inner walls can be manufactured from stainless steel, the side and back walls can be manufactured from aluminum, and the front wall can be manufactured from a clear material. Of course, other materials and combinations of materials may be used for the construction as well. Most preferably, the dimensions of the vertical passageways 862 are such that the tubular wrappers are stored as a single-file stack within each passageway 862. The embodiment shown in FIGS. 14 and 15 includes ten vertical passageways. A representative vertical passageway has a width of about 11 mm. Representative walls that provide for the various vertical passageways each have a width of about 1.7 mm, a height of about 6 cm, and a length of about 8.5 cm.

A tray 870 having a plurality of tray grooves 873 in its upper face is positioned beneath the hopper 851. The tray grooves 873 are aligned that corresponds to and lies beneath a vertical passageway 862. In the embodiment shown in FIGS. 14-16, the tray 870 includes ten tray grooves 873, each of which extends longitudinally between the front and rear of the tray 870. The tray 870 is spaced below the hopper 851 at a distance that approximates the outer diameter of the tubular wrappers that ultimately rest within each tray groove 873. Preferably, such a distance is about 7 mm to about 10 mm.

Figure 15:
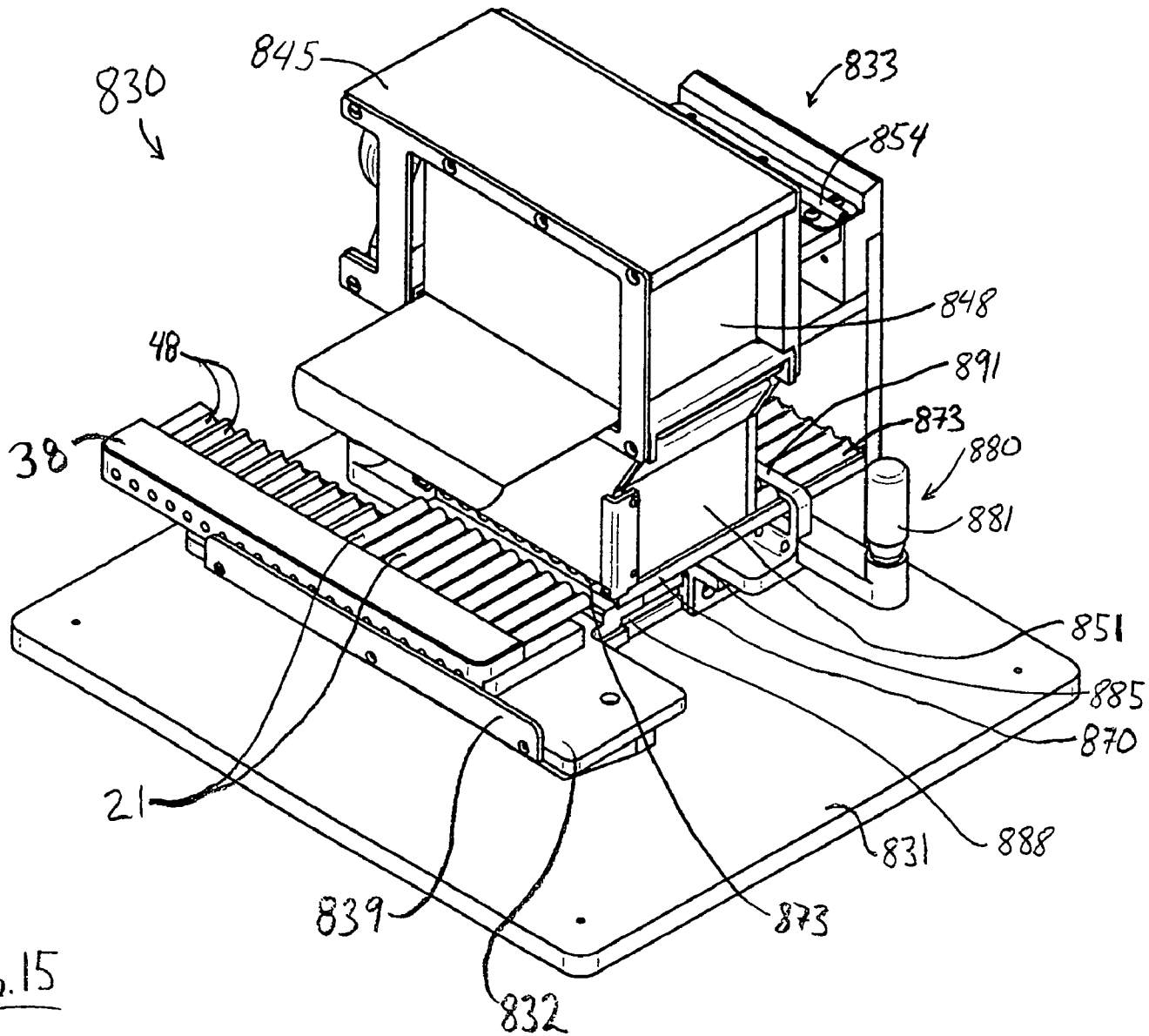
FIG. 15 is a perspective view of an apparatus shown in FIG. 14, the apparatus shown in the closed position.

Referring to FIG. 15, the upper reservoir 845 of the cartridge filling apparatus 830 is shown rotated into a closed position, and the cartridge-filling device 830 is shown having a wrapper-holding cartridge 38 appropriately positioned thereon, with a plurality of wrappers 21 placed in grooves 48 of the wrapper-holding cartridge 38. A slider system 880 is positioned to move along the front-to-rear axis of the tray 870. The slider system illustrated in FIGS. 14-16 includes two slider handles 881. The slider system 880 includes a sliding chassis 885 that slides along a track 888 supported by the base 831. The slider system 880 also includes a pusher-rod-supporting cross-bar 891, or other suitable attachment means between the slider handles 881 to support a series of generally cylindrical pusher rods 895. The components of the slider system 880 can be manufactured from any suitable material, but preferably are manufactured from a metal, such as aluminum.

As illustrated, the slider system 880 includes ten generally cylindrical pusher rods 895. During an operation of the slider system 880, (i) one tubular wrapper 21 is allowed to fall into each of the tray grooves when the slider handles 881 are positioned toward the rear of the cartridge-filling device 830, with the filter ends of the tubular wrappers preferably oriented toward the front of the device 830 (ii) a forward movement of the slider handles 881 moves the pusher rods 895 forward against the tubular wrappers within corresponding tray grooves 873 such that they are ejected from the tray 870 onto the wrapper-holding cartridge 38, (iii) the next tubular wrapper 21 in the vertical passageway 862 is prevented by one or both of the previous tubular wrapper 21 and pusher rod 895 from falling into the tray 870 prior to ejection of that previous tubular 21 wrapper from the tray 870 to the wrapper-holding cartridge 38; and (iv) the slider handles 881 are moved back to the rear of the device 830 so that the process can be repeated. The diameter and end surface configuration of each pusher rod 895 preferably is such that it will push against the open end of a tubular wrapper 21 sufficient to move the wrapper without a substantial portion of the pusher rod 895 entering or damaging the open end.

In operation, the cartridge-filling device 830 is positioned firmly in place on a table, bench, counter, or the like. Alternatively, the device 830 can be permanently affixed to components of a work station. When the upper reservoir 845 is moved to an open position, a box of pre-formed tubular wrappers may be placed in the reservoir 845, or tubular wrappers may otherwise be loaded into the reservoir 845 (e.g., by hand). The upper reservoir then may be rotated into a closed position. When the reservoir 845 is in the closed position, the tubular wrappers within the upper reservoir 845 fall into the hopper 851, and each tubular wrapper preferably falls into a vertical passageway 862. Thus, for the embodiment shown in FIGS. 14-15, the hopper 851 includes ten vertically aligned stacks of pre-formed tubular wrappers 21. Using the cartridge-filling device 830 as described, a plurality of tubular wrappers 21 can be transferred from a container to a cartridge and then on to a manufacturing assembly without the necessity of touching any of the tubular wrappers by hand.

During continuation of a preferred operation described above, the wrapper-holding cartridge 38 is moved on the cartridge-loading platform 832 such that the tray grooves of the device 830 are aligned with the remaining ten empty grooves 48 of the wrapper-holding cartridge 38. The slider system 880 is moved forward to push ten more tubular wrappers 21 into the wrapper-holding cartridge 38, and the slider handles 881 of the slider system 880 are moved to the rear of the device 830 for later use. Thus, the cartridge may be loaded with twenty tubular wrappers 21 in an efficient and effective two-step manner. The wrapper-holding cartridge 38 containing the tubular wrappers 21 is removed from the cartridge-loading platform 832, and is introduced into a cigarette-making apparatus, such as the type set forth previously with reference to FIG. 1 through FIG. 11. Another empty cartridge can be introduced into the cartridge filling apparatus, and the process can be repeated. After a requisite number of cartridges have been filled, the upper reservoir can be opened and reloaded with a new supply of tubular wrappers.

Figure 16:
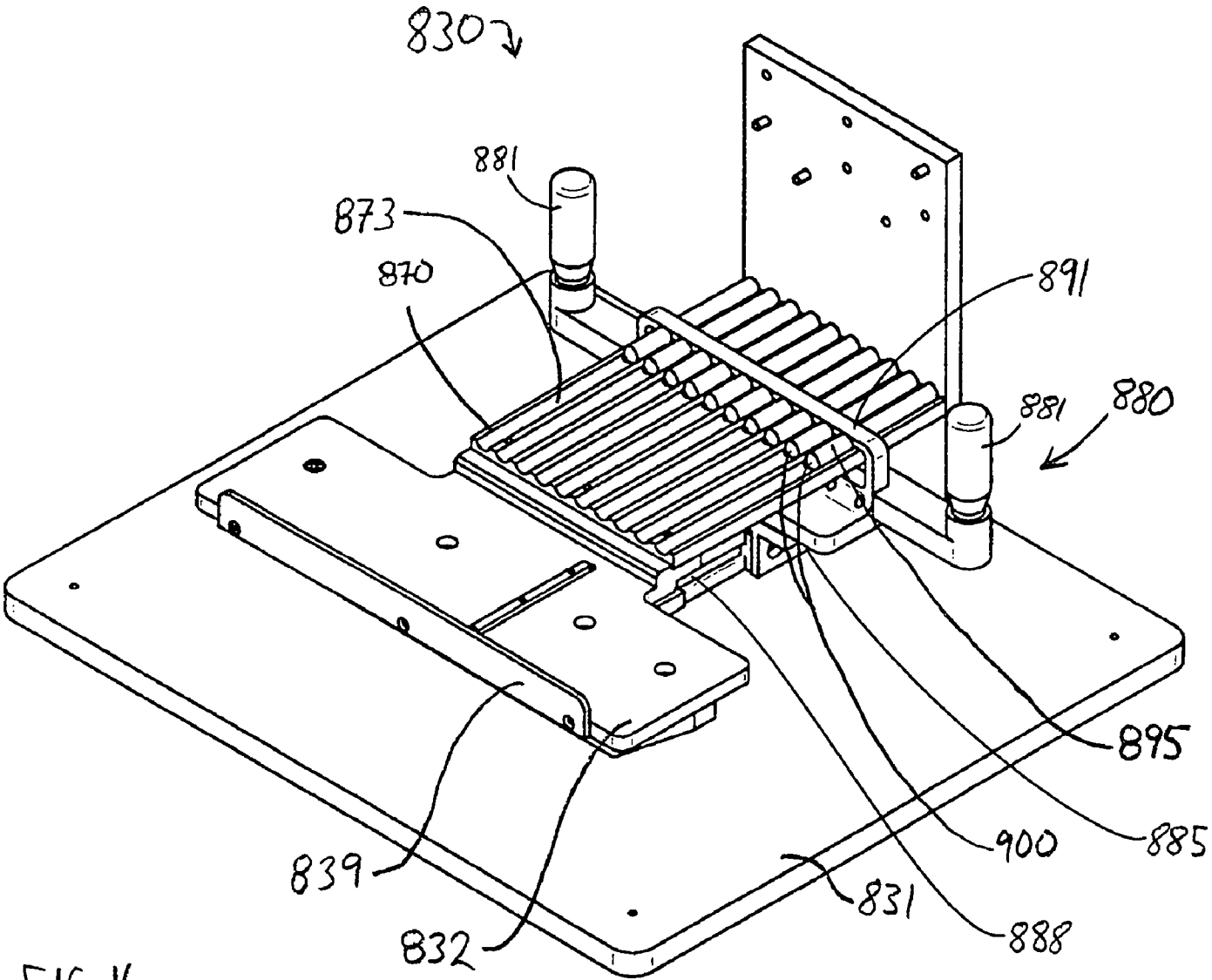
FIG. 16 is a perspective view of the base portion of the apparatus shown in FIG. 14.

FIG. 16 shows the base 831 and the slider system 880 of the cartridge-filling system 830 illustrated in FIGS. 14 and 15. Preferably, each of the cylindrical pusher rods 895 has a generally cone-shaped end 900. Each cone-shaped end 900 facilitates the ability eject a tubular wrapper by pushing on the hollow end of that tubular wrapper. A representative cylindrical plunger rod, suitable for use for ejecting a filter tubular wrapper portion having a total length of about 83 mm and a circumference of about 24.5 mm, has a length of about 80 mm and a diameter of about 8.2 mm. The rear portion of each plunger rod can be manufactured from any appropriate material such as, for example, aluminum. The cone-shaped front end of each rod preferably is manufactured from a soft material, such as nylon, polytetrafluoroethylene, synthetic rubber, or the like. A representative front end of a plunger rod covers and/or provides about 2.5 cm of the forwardmost length of that rod.

Figure 17:
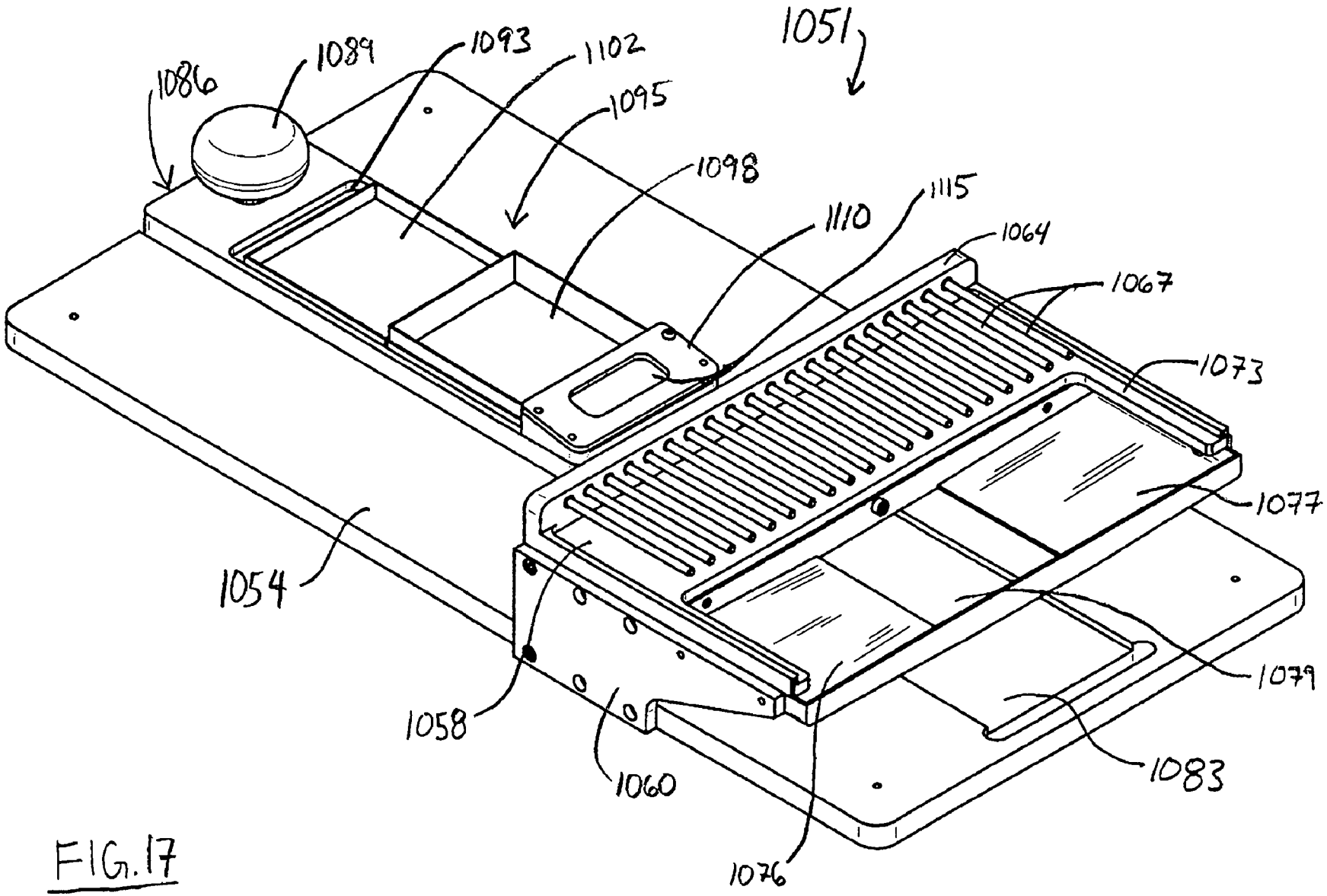
FIG. 17 is a perspective view of an apparatus for filling a cigarette package with manufactured cigarettes.

Referring to FIG. 17, there is shown a schematic illustration of a package-filling device 1051 for filling a cigarette package with manufactured cigarettes. The apparatus 1051 includes a bottom frame 1054. A representative bottom frame is about 27.5 cm wide and about 56 cm long. A representative base may be manufactured from any suitable material, but preferably is manufactured from aluminum.

The bottom frame 1054 supports an upper platform 1058. The upper platform 1058 is suspended above the base by left and right side walls 1060. In a representative embodiment, the clearance between the upper face of the bottom frame and the lower surface of the upper platform 1058 is about 3 cm. A representative upper platform may be manufactured from any suitable material, but preferably is manufactured from aluminum.

The upper platform 1058 includes an upwardly extending ejection rod-supporting cross-member 1064 that extends thereacross. Extending generally horizontally forward from the cross-member 1064 is a plurality of ejection rods 1067. For the embodiment shown, the device includes twenty forwardly-extending ejection rods 1067, each with a substantially circular cross-section. A representative ejection rod has a length of about 7.2 cm and a diameter of about 4 mm and is manufactured from steel. The package-filling device 1051 preferably is adapted such that in a region forward of the ejection rods 1067, there a positioning platform region 1073 for a wrapper-holding cartridge 38 filled with twenty cigarettes. It is highly preferred that the cigarettes within the cartridge are positioned on their sides (e.g., the longitudinal axis of each cigarette is parallel to, or substantially parallel to, the horizontal plane, and aligned with the longitudinal axis of the package-filling device 1051). The central portion of the positioning platform region 1073 includes a broad space open to the structures below, as is explained hereafter.

Below the front portion of the cartridge positioning platform region 1073 are an inwardly sloping left panel 1076 and an inwardly sloping right panel 1077 that define the sides of an open center region 1079. Representative sloping panels are manufactured from sheets of highly polished stainless steel. A representative open center region is generally rectangular with a width of about 8 cm and a length of about 9 cm.

The upper face of the bottom frame 1054 includes a broad groove 1083, channel, or other means for providing for controlled movement of a carriage 1086 from the back of the base 1054 to the front of the device 1051. A representative groove has a vertical depth of about 4 mm to about 6 mm, a width of about 9 cm, and a length such that the groove extends to within about 1 cm of the front end of the device. The arrangement of the carriage 1086 and groove 1083 preferably are such that the carriage 1086 is easily movable within the groove 1083. Typically, selection of the respective shapes and dimensions of the carriage and the groove define the arrangement of the carriage in the groove. For example, the sides of the carriage and the sides of the groove may be designed so as to cooperate in a tongue-in-groove type of arrangement.

The carriage 1086 includes an upwardly extending handle 1089, such that the carriage 1086 can be moved back and forth. Within a recess 1093 in the upper face of the carriage is positioned a cigarette package 1095 in an open position. A representative package 1095 includes a bottom component 1098 for holding twenty cigarettes (not shown), and a top cover 1102 that is designed to close over the bottom component 1098. A representative recess has a vertical depth of about 4 mm to about 6 mm; and a representative recess having a length of about 19 cm and a width of about 9 cm can readily accommodate a package with a bottom component having outer dimensions of about 8.2 cm wide, about 8.9 cm long and about 18 mm high (such dimensions being measured when the box is in a closed or sealed configuration).

In operation, the apparatus 1051 preferably is positioned firmly in place on a table, bench, counter, or the like. Alternatively, the apparatus can be permanently affixed to components of a work station. Optionally, a pre-cut inner package wrapping paper, foil/paper laminate or paper-lined foil (not shown) is placed into the package 1095. A typical foil sheet has a width that approximately the width of the inner portion of the package, and a length of about 16 cm. A forming block (not shown) having stamp face dimensions approximating those of the inner bottom face area of the package is used to push the foil into the box. As such, the foil is creased within the bottom portion of the box. The forming block then is removed from the box so as to provide a box having a type of inner liner (not shown) positioned therein. In addition, the foil most preferably is of such a length that tabs (not shown) extend from both of bottom front and back of the package.

A backstop 1110 located at the front of the carriage 1086 assists in maintaining the package 1095 in place during operation of the apparatus 1051. On the top face of the backstop 1110 is positioned a slot 1115. The slot 1115 preferably is designed such that inner package wrapping paper or paper-lined foil (not shown) extending from the front bottom of the package 1095 can be fed into the slot 1115 in order that the foil is positioned out of the way when the cigarette package 1095 is filled with cigarettes.

Figure 18:
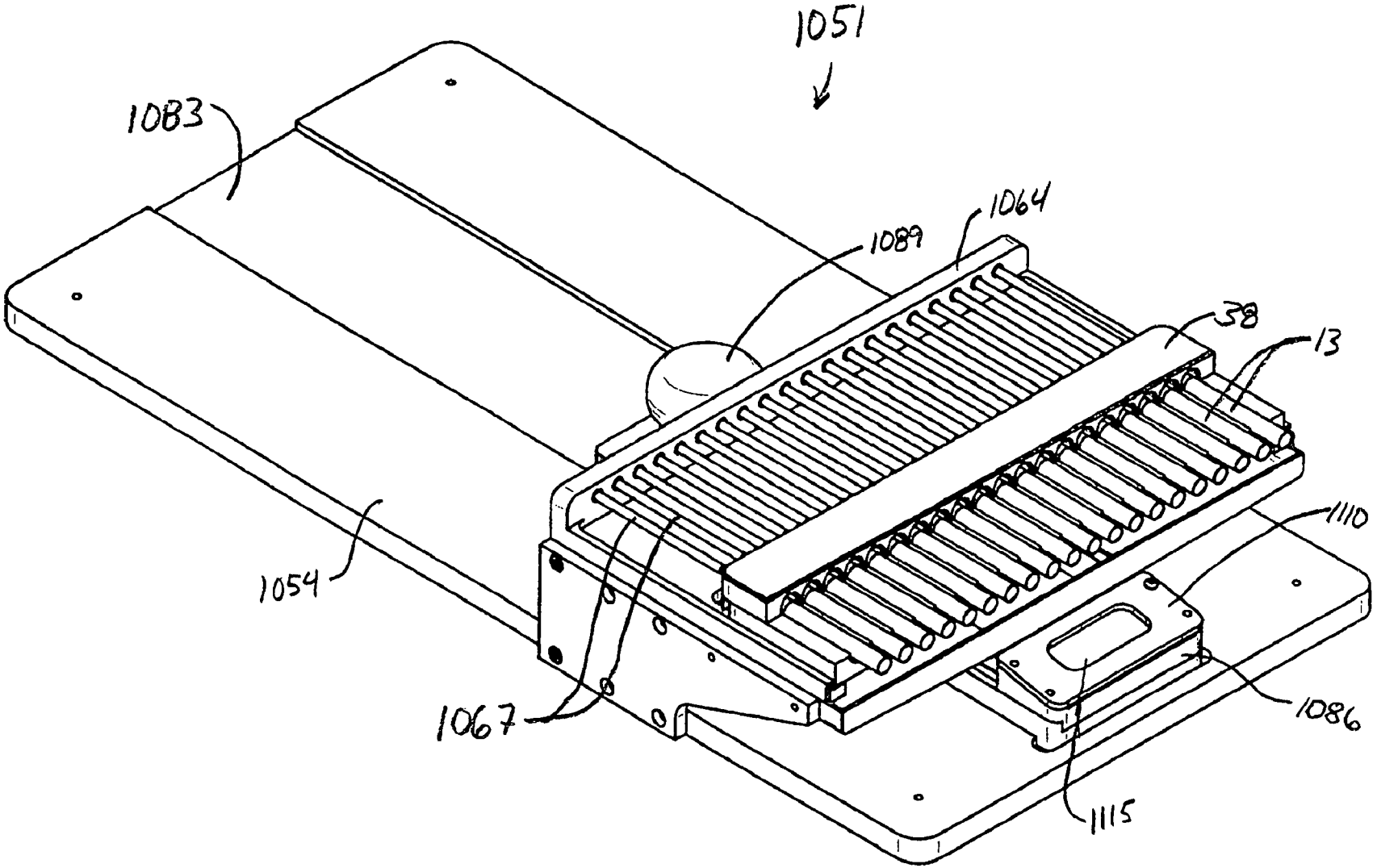
FIG. 18 is a perspective view of an apparatus for filling a cigarette package with manufactured cigarettes.

Referring to FIGS. 17 and 18, the package-filling apparatus 1051 is shown with a wrapper-holding cartridge 38 containing twenty cigarettes 13 appropriately positioned on the positioning region of the upper platform 1073. The carriage 1086 has been moved forward, such that a package 1095 carried thereby is positioned below the open center region 1079 beneath the cartridge. The device 1051 is designed such that the wrapper-holding cartridge 38 can be slid on the upper surface of the upper platform 1058 towards the rear of the device. When the cartridge is moved rearward, each ejection rod 1067 remains still such that each rod passes through the openings 550 in the front surface of the wrapper-holding cartridge 38 (see FIG. 6) and resists the cigarettes' rearward motion by pushing against the rear face of each filter element of each respective cigarette. Effectively, as the wrapper-holding cartridge 38 is moved rearward, each rod 1067 passes through the corresponding opening 550 in the front face of the wrapper-holding cartridge 38, hence pushing the cigarettes 13 out of the cartridge. As such, cigarettes can be removed from the cartridge without the necessity of turning the cartridge over to dump cigarettes therefrom or of tipping the cartridge upwards so that cigarettes fall therefrom. The cigarettes 13 that are pushed from the wrapper-holding cartridge 38 and fall through the open center region 1079. The cigarettes 13 consequently fall into, and fill, the open package 1095 that is positioned in the below the open center region 1079. An operator can use his/her finger to align the cigarettes within the package, but preferably the cigarettes are aligned without being touched, or are moved into alignment within the package using a tool (e.g., a nylon probe) that will not mar the cigarettes. The handle 1089 then can be used to move the carriage 1086 rearwards in order to expose the package filled with cigarettes. The filled package can be removed from the carriage and closed. A new empty package then can be inserted into the carriage. Meanwhile, the empty cartridge can be moved forward and removed from the device. A new cartridge filled with cigarettes can be placed into the device. As such, the package filling process can be repeated. In an alternative embodiment, the ejection rods 1067 may be moved relative to the wrapper-holding cartridge 38 to move the cigarettes therefrom.

Cigarettes also can be packaged in the manner used for those cigarettes commercially marketed under the trade name Camel Blackjack Gin by R. J. Reynolds Tobacco Company, in the manner used for those cigarettes commercially marketed under the trade name Salem Dark Currents Silver Label by R. J. Reynolds Tobacco Company. See also, the types of packages set forth in U.S. Pat. No. 4,715,497 to Focke et al.; U.S. Pat. No. 4,294,353 to Focke et al.; U.S. Pat. No. 4,534,463 to Bouchard; U.S. Pat. No. 4,852,734 to Allen et al.; U.S. Pat. No. 5,139,140 to Burrows et al.; and U.S. Pat. No. 5,938,018 to Keaveney et al.; U.K. Pat. App. No. 1,042,000; German Pat. App. DE 10238906 to Marx; and U.S. Published Pat. Apps. 2004/0217023 to Fagg et al.; 2004/0256253 to Henson et al. and 2005/0150786 to Mitten et al., each of which is incorporated herein by reference.

A representative device for filling a cigarette package with manufactured cigarettes is described with reference to FIG. 17 and FIG. 18. That illustrated device is designed to fill a package with twenty cigarettes. Suitable alterations to the apparatus and its components can be made to hold or transfer a greater or lesser number of cigarettes contained in a cartridge. For example, a package designed to contain ten cigarettes can be filled with the embodiment described with reference to FIG. 17 and FIG. 18 by loading ten cigarettes into the cartridge and using the device to fill that package.

Figure 19:
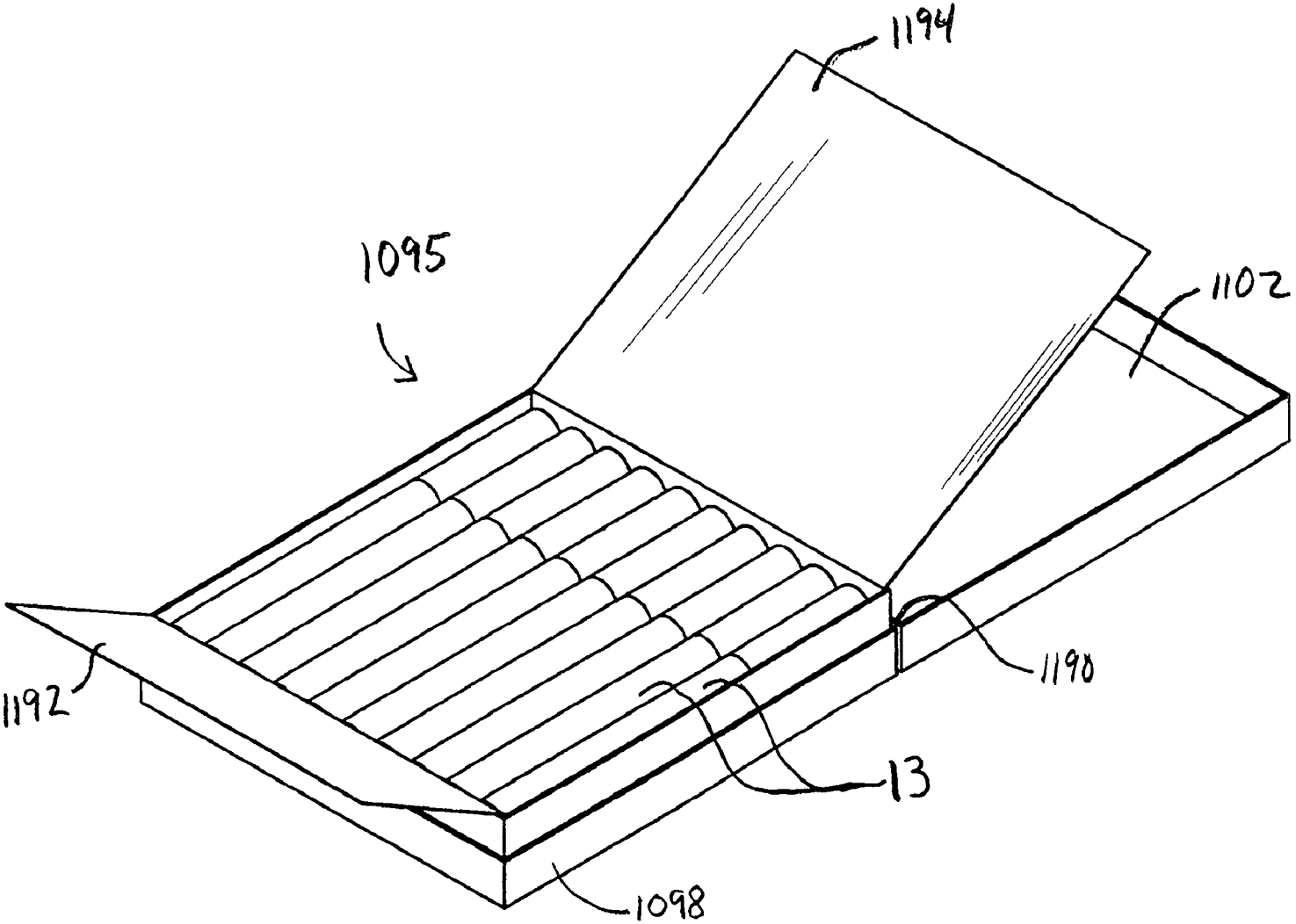
FIG. 19 is a perspective view of a package of cigarettes.

Referring to FIG. 19, there is shown a perspective view of a representative package 1095 for cigarettes 13. The illustrated package embodiment 1095 is of the type that has been referred to as a "shoulder box." The package 1095 is shown in an open position and is designed to contain twenty cigarettes. As illustrated, the cigarettes are aligned within the package in two rows of ten cigarettes, with one row positioned over the second row. The packaged cigarettes preferably are manufactured using the previously described equipment and materials. The package 1095 preferably is manufactured from folded paperboard material, and can be of any type useful for the packaging of cigarettes.

The package 1095 includes a generally rectilinear top 1102 that opens about a hinge 1190 that extends along the back side of the box. The cigarettes are contained in the bottom component 1098 of the box 1095. The bottom component 1098 also holds a foil front flap 1192 and a foil back flap 1194 that can close over the cigarettes 13, or that can be opened to expose the cigarettes (as is shown). Representative types of shoulder box packages have been commercially available, and the selection thereof is a matter of choice. If desired, the shoulder box and associated wrapping materials can be embossed, printed with indicia, or the like. If desired, the package of cigarettes can be wrapped in a plastic or other film (e.g., a clear polypropylene film).

Other representative types of cigarette packages suitable for use with the present invention includes those of the types set forth in U.S. Pat. No. 4,294,353 to Focke et al.; U.S. Pat. No. 4,534,463 to Bouchard; U.S. Pat. No. 4,852,734 to Allen et al.; and U.S. Pat. No. 5,139,140 to Burrows et al.; U.S. Pat. App. Pub. Nos. 2004/0217023 to Fagg et al. and 2004/0256253 to Henson et al.; and German Pat. App. DE 10238906 to Marx.

Figure 20:
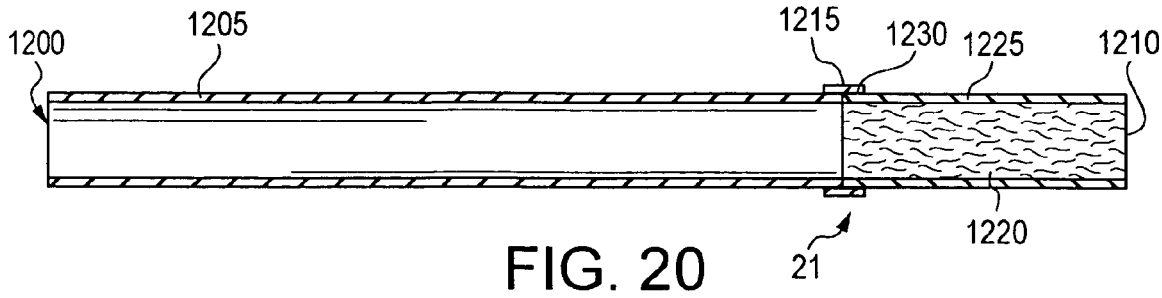
FIG. 20 is a cross-sectional view of a pre-formed tubular wrapper representative of the type used for the manufacture of a cigarette.

Referring to FIG. 20, there is shown a longitudinal cross-section of a pre-formed tubular wrapping portion 21. Such a wrapper portion has the general shape of a cigarette, but is substantially devoid of the smokable filler material that makes up a finished cigarette. The tubular wrapper 21 includes a hollow generally cylindrical region 1200 defined by cigarette paper wrapping material 1205 into which tobacco cut filler is inserted. That is, the tubular wrapper 21 is configured for receiving tobacco filler; and hence, for providing a wrapped, smokable tobacco rod. The tubular wrapping 21 preferably also includes a filter element 1210 positioned at one end thereof. The filter element 1210 preferably is attached to the wrapping material 1205 using a circumscribing tipping material 1215. The filter element 1210 includes filter material 1220 wrapped in a circumscribing plug wrap material 1225. The tipping material 1215 and plug wrap 1225 may optionally include a line of perforations 1230, in order that during use of the cigarette, mainstream smoke can be air diluted. The perforations 1230 may be provided during or after cigarette manufacture using on-line laser perforation techniques or the relevant wrapping materials may be pre-perforated.

Representative pre-formed tubular wrapper portions include those types of filtered cigarette tubes that have been available commercially as "Premier Filter Tip Tubes" from C.T.C. Canada Inc.; "MacDonald Export 'A' Express Kit Medium Regular Size Cigarettes Tubes" from RJR-MacDonald Inc.; and "Escort King Size Filter Tip Tubes" from C.T.C. Canada Inc.

Pre-formed tubular wrapper 21 can include filter and empty paper tube components that remain upon removal of tobacco from existing cigarettes. For example, filter cigarettes can be manufactured using conventional automated cigarette-making techniques, and the tobacco can be ejected therefrom using, for example, the type of apparatus set forth in U.S. Pat. No. 4,763,673 to Barnes et al., which is incorporated herein by reference, or using other suitable means. As such, components used for the manufacture of commercial grade filter cigarettes can be processed to remove the tobacco blend therefrom, and the resulting pre-formed tubular wrapper can be filled with a different tobacco blend in the fashion described above with reference to FIGS. 1-11. As such, it is possible to prepare lots of substantially identical cigarettes, except for a difference in a chosen smokable material within those cigarettes.

Figure 21A:
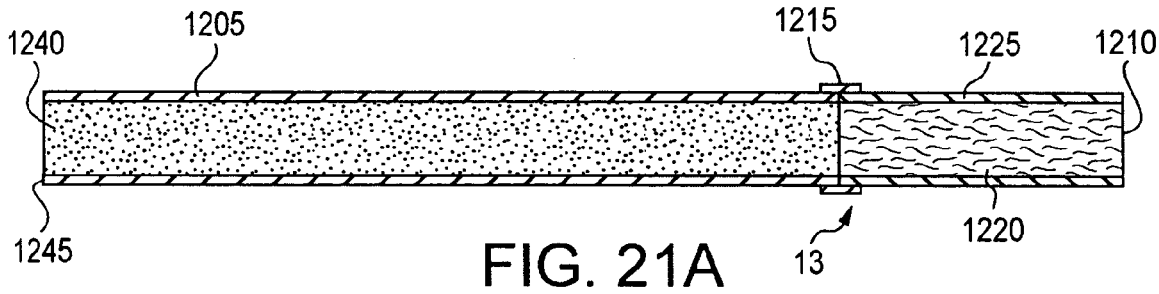
FIGS. 21A-21B each show a cross-sectional view of a finished cigarette embodiment.
Figure 21B:
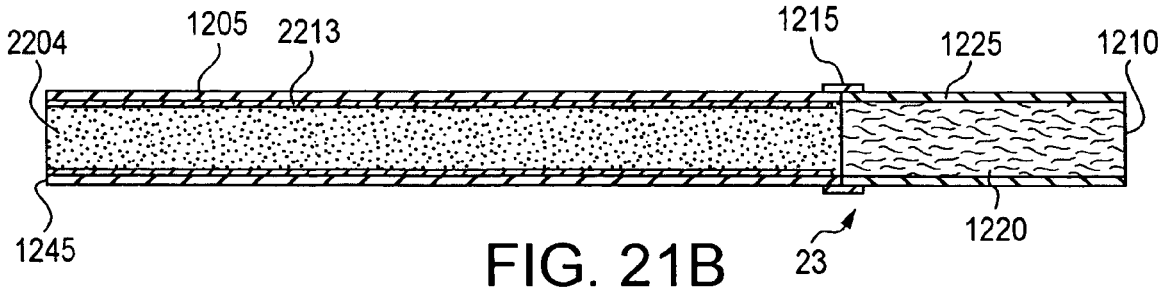

Referring to FIG. 21A, there is shown a first representative cigarette 13. The cigarette 13 includes cigarette wrapping material 1205 that surrounds strands or pieces of tobacco cut filler 1240, which is the smokable filler material that makes up a core of the cigarette 13. The lighting end 1245 of the cigarette preferably is configured such that the cut filler 1240 does not extend to any significant extent beyond the end of the wrapping material 1205. Preferably, cut filler 1240 extends about 1 mm or less and, most preferably, about 0.5 mm or less beyond the lighting end of the wrapping material 1205 of the tubular wrapper 21. Referring to FIG. 21B, there is shown a second representative cigarette 23. The cigarette 23 includes cigarette wrapping material 1205 that surrounds a tobacco cartridge 2204 which includes a thin, preferably porous, material 2213 around strands or pieces of tobacco cut filler 1240, which is the smokable filler material that makes up a core of the cigarette 23. The thin material 2213 may include, for example, a tobacco-containing paper or a paper not containing tobacco.

The tobacco cartridge 2204 preferably is embodied as a pre-formed charge of tobacco cut filler (e.g., in a loose form, or as a roll, cylinder, or preportioned stick) that, when used to form a cigarette 23 by insertion into the pre-formed tubular wrapper 21, preferably is contained within another material 2213 that circumscribes the length thereof. Preferably, the material 2213 circumscribing the tobacco cartridge 2204 is a thin, highly porous material. The material may be treated with formulations incorporating ethylcellulose, starch, alginate, or the like (e.g., to affect properties such as flavor, burn rate, porosity). Representative manners and methods for treating wrapping materials with additive materials are set forth in U.S. Pat. No. 6,779,530 to Kraker; U.S. Published Pat. Apps. 2005/0016556 to Ashcraft et al.; 2005/0076929 to Fitzgerald et al.; 2006/0021625 to Nyffler; and U.S. patent application Ser. No. 11/251,632, filed Oct. 14, 2005 to Oglesby; each of which is incorporated herein by reference. Preferably, that material 2213 is so thin and porous that the tobacco material within is visible, and the tobacco cartridge 2204 is not smokable until after being inserted into the tubular wrapping material portion 1205 of the tubular wrapper 21.

In an embodiment of the tobacco cartridge 2204 that does not include a wrapping material 2213, the cartridge 2204 preferably maintains a generally cylindrical shape as the tobacco is held together by, for example, binding agents and/or mechanical compression. In another embodiment, the wrapping material 2213 may be removable from the tobacco cartridge 2204, which thereafter preferably retains a generally cylindrical shape through an operation transferring it into a tubular outer wrapper. The size and shape of the cartridge 2204 is sufficient to allow it readily to be inserted within the pre-formed tubular wrapping portion, to fill the void volume within the tubular wrapping portion 1205, readily to be contained and maintained therein, and to provide a finished cigarette 23 that exhibits desirable performance characteristics. As such, the tobacco filler 1240 to be inserted within the tubular wrapper 21 preferably is provided in a form of predetermined size and shape, and that its overall size and shape is maintained to a significant extent after insertion thereof into the tubular wrapper 21.

In a preferred embodiment, the tobacco cartridge 2204 effectively and efficiently fills the hollow region 1200 of a tubular wrapper 21, fitting snugly therein. The lighting end 1245 of the cigarette preferably is configured such that the cut filler 1240 (or tobacco cartridge 2204) does not extend to any significant extent beyond the end of the wrapping material 1205. Preferably, cut filler 1240 (or tobacco cartridge 2204) extends about 1 mm or less and, most preferably, less than 0.5 mm beyond the lighting end of the wrapping material 1205 of the tubular wrapper 21 in an assembled cigarette 23. In a preferred embodiment of the cigarette 23, the tobacco cartridge 2204 abuts the filter 1220 and is nearly flush with the lighting end of the cigarette. Alternatively, the tobacco cartridge may be separated from the filter 1220 by a space that is preferably less than 1 mm.

Referring to FIG. 22, there is shown another embodiment of a cigarette-making apparatus 2200. The apparatus 2200 is configured for manufacturing a plurality of cigarettes by filling pre-formed filtered tubular wrappers 21 with tobacco. For the embodiment shown in FIG. 22, the cigarette-making apparatus 2200 is configured to concurrently manufacture five cigarettes by simultaneously filling the hollow portions of five pre-formed tubular wrappers 21 that have been placed upon a wrapper-holding cartridge 38 with five cylindrical charges of tobacco. In a preferred embodiment of using the apparatus 2200, twenty wrappers 21 are placed on the wrapper-holding cartridge 38 and the simultaneous filling operation is repeated to fill all of them.

The tobacco, preferably in cut filler form, is provided as a generally rod-shaped or cylindrical component 2204. Tobacco provided in such a form has been referred to as a "tobacco cartridge." One representative tobacco cartridge 2204 includes a pre-portioned amount of tobacco filler contained in a tubular casing of highly porous or air-permeable wrapping material, which optionally may be wrapped with more than a single layer of paper or other suitable material. Another representative tobacco cartridge 2204 includes a pre-portioned amount of tobacco filler without a wrapper, but which is held in a cylindrical shape by binding agents. The tobacco cartridge 2204 preferably is configured such that the cartridge, or the tobacco portion within the cartridge, can readily be inserted into a cigarette paper tube. Representative tobacco cartridges include those described in, for example, U.S. Pat. No. 3,822,710 to Bramhill; U.S. Pat. No. 4,887,617 to Ruppert et al.; U.S. Pat. No. 5,018,536 to Liebich; U.S. Pat. No. 5,105,830 to Brackmann et al.; U.S. Pat. No. 5,133,366 to Liebich; U.S. Pat. No. 5,141,000 to Ruppert et al.; U.S. Pat. No. 5,167,248 to Ruppert et al.; U.S. Pat. No. 5,197,495 to Ruppert et al.; U.S. Pat. No. 5,615,692 to Ruppert et al.; and U.S. Pat. No. 5,713,377 to Gerding et al., each of which is incorporated herein by reference. Representative cartridge assemblies and components have been commercially available in Canada, for example, by Rothmans, Benson & Hedges Inc. under the trade name "Belvedere." Cartridges, devices, and methods described here are expected to be useful with certain applications of the present invention.

The cigarette manufacturing apparatus 2200 includes a lower base 2206, which may be manufactured from a suitable material, such as metal (e.g., stainless steel, brass or aluminum), plastic (e.g., polycarbonate, polymethylmethacrylate, acrylate/butadiene/styrene or ABS type plastic, nylon, or other suitable polymeric material), composite material (e.g., a graphite-based ceramic), or like material; but preferably is manufactured from aluminum. As illustrated, the base 2206 includes feet 2208 and a waste tray 2210. The waste tray 2210 preferably is removably mounted below the base and configured to capture loose tobacco for convenient removal. Also supported by the base 2206 is a tobacco filler insertion mechanism 2300 and a loading chamber assembly 2220.

Figure 24:
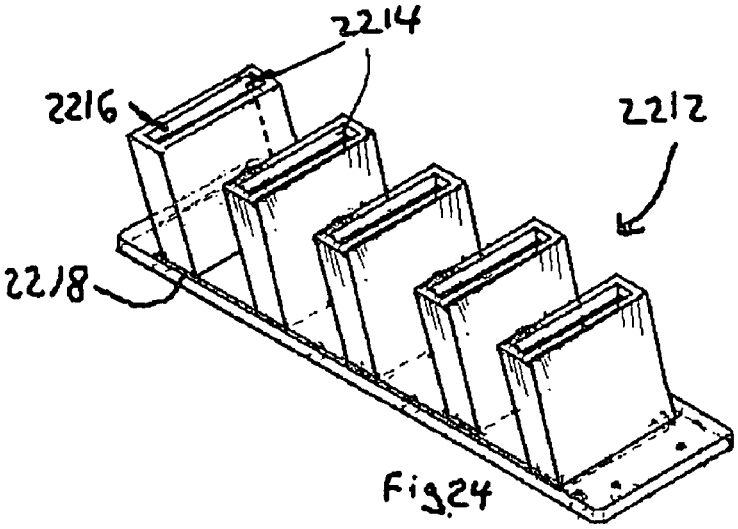
FIG. 24 is a top perspective view of an alternative tobacco cartridge hopper.
Figure 25:
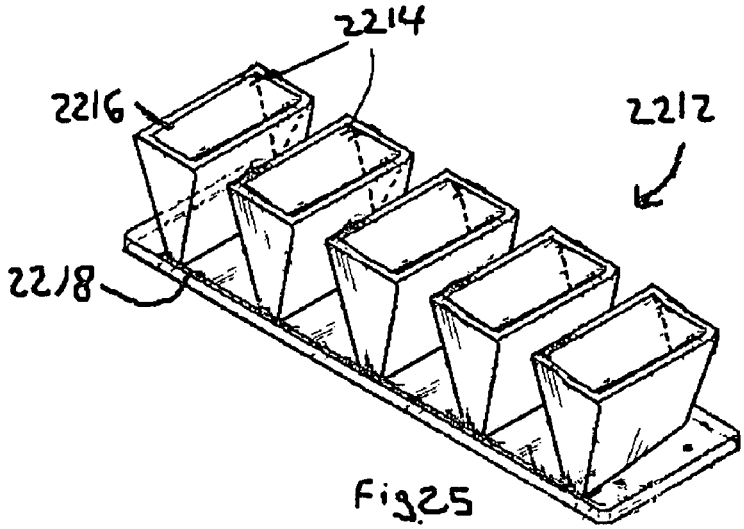
FIG. 25 is a top perspective view of another alternative tobacco cartridge hopper.
Figure 26:
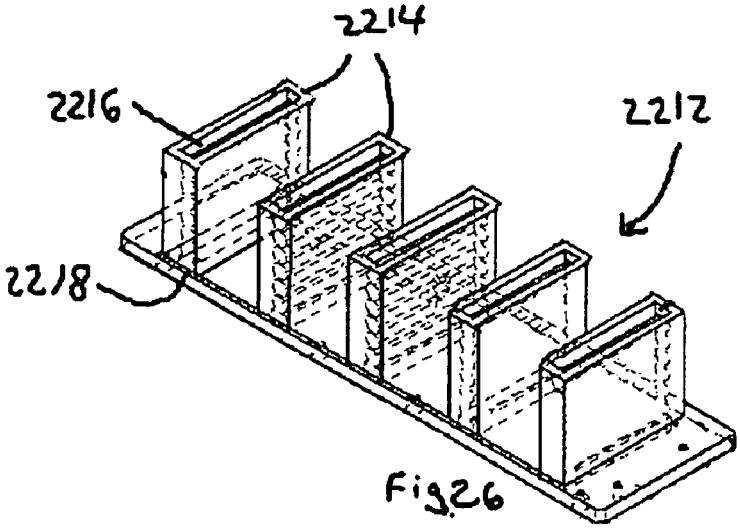
FIG. 26 is a top perspective view of yet another alternative tobacco cartridge hopper.

A tobacco cartridge delivery hopper 2212 is removably mounted on the loading chamber assembly 2220. The hopper 2212 includes five parallel vertical chambers 2214 supported by a surrounding wall 2215, which are open at the top 2216 and bottom 2218 and are configured to hold tobacco cartridges 2204. It should be appreciated that, in other embodiments, the chambers 2214 may be angled rather than vertical (see FIG. 24), and/or may be wider at the top 2216 than at the bottom 2218 (e.g., to hold more tobacco cartridges than the embodiment in FIG. 23; see FIG. 25). A cartridge delivery hopper embodiment may be provided without the surrounding wall 2215, as is shown, for example, in FIG. 26. In the illustrated embodiment of FIG. 23, the chambers 2214 each hold a plurality of tobacco cartridges 2204 in a single-file vertical column. The open bottom 2218 of each chamber 2214 allows passage (e.g., by gravity-feed) of the tobacco cartridges into the loading chamber assembly 2220. In an alternative embodiment, a system of weights such as is illustrated in FIG. 1 may be provided to aid downward progress of the tobacco cartridges.

In the illustrated embodiment, the tobacco filler insertion mechanism 2300 is enclosed on its top and sides by a cover 2202. The cover may provide for an improved aesthetic appearance and/or for shielding of the components of the tobacco filler insertion mechanism 2300 (for example to decrease the accumulation of dust therein and/or to protect mechanical components thereof). The tobacco filler insertion mechanism 2300 in the embodiment illustrated in FIG. 22 preferably is similar or identical in design and function to the tobacco filler insertion mechanism 300 shown and described herein with reference to FIGS. 3, 10, and 11. In a preferred embodiment for use with tobacco cartridges, the loading arms (not shown) of the tobacco filler insertion mechanism 2300 do not include forward-projecting "spoons" (like the semi-cylindrical extension portions 695 in FIG. 10). The crank-arm handle 2302 actuates a plurality of loading arms (not shown; see, for example, plunger insertion arms 251 illustrated in FIG. 10) to direct the tobacco cartridges 2204 into the wrappers 21. In alternative embodiments, the tobacco filler insertion mechanism may include any appropriate means for simultaneously transferring a plurality of tobacco cartridges into a corresponding plurality of wrappers. For example, certain means for transferring tobacco into a wrapper are disclosed in U.S. application Ser. No. 11/281,083, which is incorporated herein by reference. Such means may be adapted for use with tobacco cartridges in conjunction with the present invention.

Figure 23:
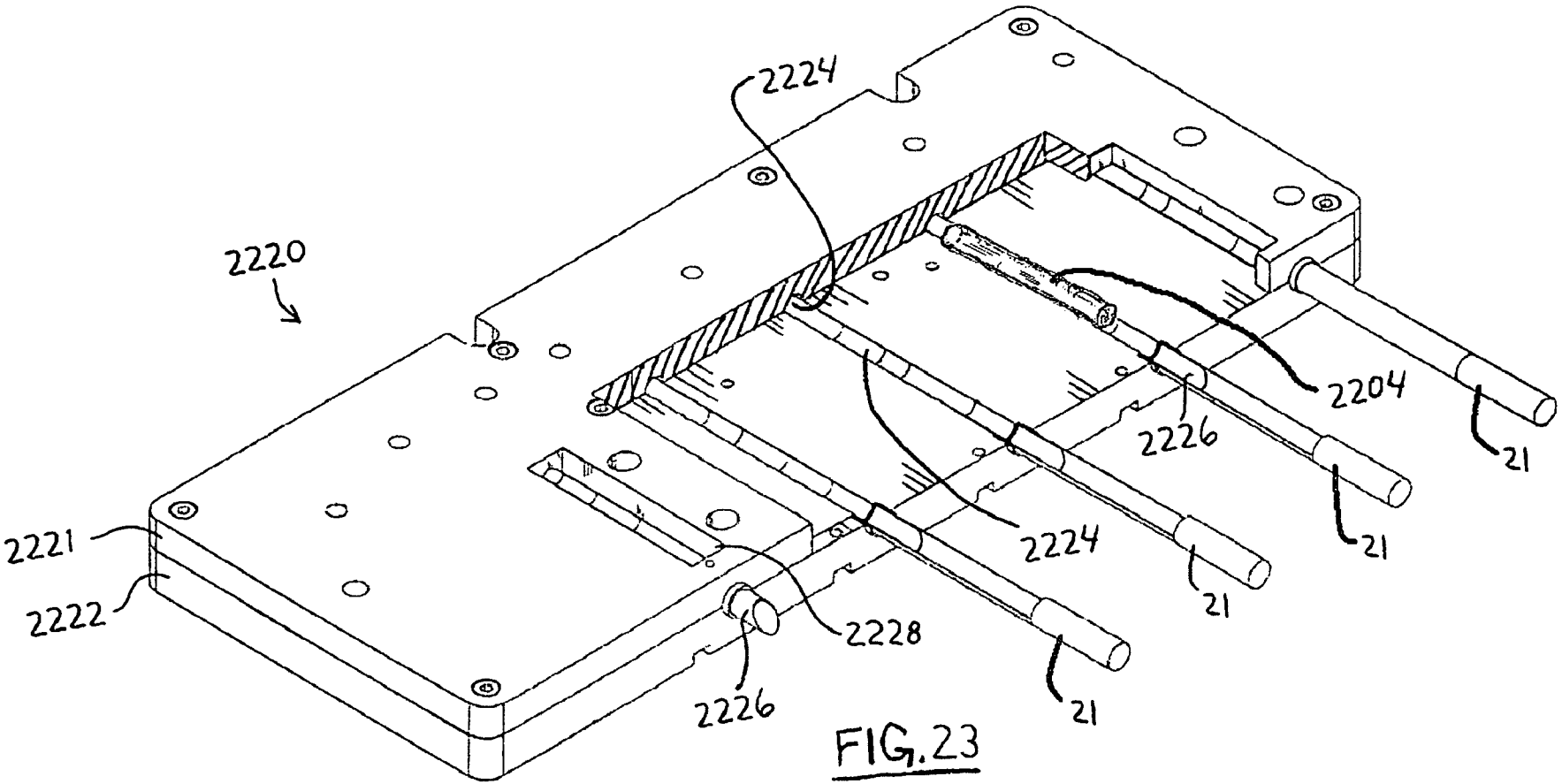
FIG. 23 is a top perspective view of a loading chamber assembly of the apparatus in FIG. 22.

The base 2206 supports the loading chamber assembly 2220 at the front side of the cover 2202. In the embodiment illustrated in FIG. 22, the loading chamber assembly 2220 includes an upper plate 2221 and a lower plate 2222. A more detailed view of the loading chamber assembly 2220 is depicted in FIG. 23, which shows a top perspective view, with a portion of the upper plate 2221 cut away. Five generally cylindrical passages 2224 are defined by complementary channels in the upper and lower plates. The front surface includes a plurality of nozzles 2226. In the illustrated embodiment of FIGS. 22-23, the front side of the assembly 2220 includes five nozzles 2226. Each nozzle 2226 preferably is designed such that the open end of a hollow pre-formed tubular wrapper 21 fits over that nozzle 2226 such that a tobacco cartridge 2204 can be transported through that nozzle 2226 and into a corresponding tubular wrapper 21 (e.g., by the tobacco filler insertion mechanism). Three wrappers 21 are shown in partial longitudinal cross-section in FIG. 23, illustrating how they engage with the nozzles 2226.

In the embodiment illustrated in FIG. 23, a single tobacco cartridge 2204 in each passage 2224 can be directed (by the tobacco filler insertion mechanism) through a corresponding nozzle 2226 into a wrapper 21. In a preferred embodiment, the diameter of each of the cylindrical passages 2224 is sized such that one tobacco cartridge 2204 at a time may be directed therethrough. A set of top apertures 2228 over the passages 2224 is spaced to align with the bottom 2218 of the chambers 2214 of the cartridge hopper 2212, allowing passage of the tobacco cartridges 2204 from the cartridge hopper 2212 into the cylindrical passages 2224. In another embodiment, a set of weights such as, for example, the weight assembly 92 illustrated in FIG. 1 may be used to aid transfer of tobacco cartridges by enhancing a gravitational transfer from cartridge hopper to loading chamber assembly.

An application of the embodiment depicted in FIG. 22 may include a method with the following steps: Providing a tobacco filler insertion mechanism 2300; Providing a loading chamber assembly 2220; Providing a wrapper-holding cartridge 38 loaded with wrappers 21, wherein a sub-plurality of the wrappers is aligned with nozzles of the loading chamber assembly; Providing a tobacco cartridge delivery hopper 2212; Loading a plurality of tobacco cartridges 2204 into the tobacco cartridge delivery hopper 2212; Allowing a tobacco cartridge 2204 from each of the chambers 2214 to pass through the top apertures 2228 of the loading chamber assembly 2220 into a passage 2224 thereof; Actuating the tobacco filler insertion mechanism 2300 to transfer the tobacco cartridges 2204 into the wrappers 21; Moving the wrapper-holding cartridge 38 to a second position; and repeating the allowing step and the actuating step until all wrappers on the wrapper-holding cartridge are filled with tobacco. The resulting cigarettes may then be trimmed, if needed, and transferred to a container using, for example, the devices and container described herein with reference to FIGS. 13 and 17-19.

In an alternative application, the tobacco cartridge delivery hopper 2212 may be used with the apparatus 10 shown in FIG. 1. In such an application, the hopper unit 99 is removed, and the tobacco cartridge delivery hopper 2212 put in its place. In a method using that alternative application, tobacco cartridges 2204 may pass (e.g., by gravity-feed) from the cartridge hopper chambers 2214 into the fill slots 608 of the compression assembly 75 (as shown, for example, in FIGS. 1 and 7). Then, the tobacco filler insertion mechanism 300 may be actuated to transfer the tobacco cartridges 2204 into the wrappers 21. If desired, the compression assembly 75 may be actuated in a manner that may adjust the shape of the tobacco cartridge 2204 (e.g., if the cartridge has become flattened).

In one embodiment of the methods described above, the step of loading tobacco cartridges 2204 into the cartridge delivery hopper 2212 includes loading of tobacco cartridges comprising different tobacco mixtures (such as, for example, different flavors, varieties, or species of tobacco). In this manner, a customer with particular tastes or requirements may obtain, using the methods and devices of the present invention, a single package of cigarettes containing a preselected number of each of several different cigarette varieties. For example, using a 20-wrapper cartridge and cigarette container such as is described above, a user/customer may select up to twenty different tobacco cartridges and readily make a pack of cigarettes containing that desired mix. In a preferred embodiment of the method, a resulting cigarette includes visual indicia of the cigarette's components. For example a certain color, a handwritten marking, or a printed pattern may be used to identify to a user customer a particular combination of wrapper, filter, and tobacco. Most preferably, all cigarettes in a package are substantially the same size.

As illustrated in, for example, FIGS. 1 and 22, preferred cigarette maker machines of the present invention include structure for feeding tobacco (e.g., loose tobacco or tobacco cartridges) vertically downward into a receptacle region, and then horizontally advancing the tobacco into a pre-formed wrapper. It should be appreciated that the geometry and directionality of the tobacco's passage may be varied. For example, the apparatus 2200 in FIG. 22 is shown in a generally horizontal orientation. However, the apparatus 2200 could be mounted, for example, onto a wall in a generally vertical orientation. In such an application, magnets or other attachment means may be employed to mount the hopper 2212 and wrapper-holding cartridge 38 to the base 2206, and a spring means may be used to retain the tobacco cartridges 2204 in the hopper 2212. In another embodiment, the hopper 2212 may be configured to provide tobacco cartridges in a vertical orientation for transfer into wrappers 21 also held in a generally vertical orientation. Other embodiments of cigarette maker machines within the scope of the present invention may use different orientations for operating.

The dimensions of a representative cigarette can vary. Preferred cigarettes are substantially rod shaped, with diameters of about 7.5 mm (e.g., circumferences of about 22.5 mm to about 25 mm); and total lengths of about 80 mm to about 100 mm. The length of the filter element can also vary. Typical filter elements can have lengths of about 20 mm to about 40 mm. In one preferred embodiment, the length of the filter element is about 27 mm and the length of the tobacco rod is about 56 mm. Preferably the tipping paper circumscribes the entire filter element and extends about 4 mm of the length of the tobacco rod in the region adjacent to the filter element.

Preferred wrapping materials of the cigarettes described herein encompass a wide range of compositions and properties. The selection of a particular wrapping material will be readily apparent to those skilled in the art of cigarette design and manufacture. The most preferred cigarettes have a single layer of wrapping material. Exemplary types of wrapping materials, wrapping material components and treated wrapping materials are described in U.S. Pat. No. 5,220,930 to Gentry; U.S. Pat. App. Pub. Nos. 2004/0129281 to Hancock et al. and 2005/0039764 to Barnes et al.; and PCT Application Pub. Nos. WO 2004/057986 to Hancock et al. and WO 2004/047572 to Ashcraft et al.; each of which is incorporated herein by reference in its entirety. The wrapping materials of the tubular wrapper portions and/or the thin materials wrapping a tobacco cartridge can be treated with additive materials. For example, those materials may be treated with formulations incorporating ethylcellulose, starch, alginate, or the like. Representative manners and methods for treating such wrapping materials with additive materials are set forth in U.S. Pat. No. 6,779,530 to Kraker; U.S. Published Pat. Apps. 2005/0016556 to Ashcraft et al.; 2005/0076929 to Fitzgerald et al.; 2006/0021625 to Nyffler; and U.S. patent application Ser. No. 11/251,632, filed Oct. 14, 2005 to Oglesby; each of which is incorporated herein by reference.

Tobacco materials useful within cigarettes of the present invention may vary significantly. Tobacco materials can be derived from various types of tobacco, such as flue-cured tobacco, burley tobacco, Oriental tobacco or Maryland tobacco, dark tobacco, dark-fired tobacco and Rustica tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobaccos used with the present invention are those that have been appropriately cured and aged.

Tobacco materials for cigarette manufacture can be used in a "single strain" form. That is, the tobacco material used to manufacture the cigarette is composed of one type of tobacco (e.g., all of the tobacco filler is a flue-cured tobacco). Typically, tobacco materials for cigarette manufacture are used in a so-called "blended" form. For example, certain popular tobacco blends, commonly referred to as "American blends," comprise mixtures of flue-cured tobacco, burley tobacco and Oriental tobacco. Such blends, in many cases, contain tobacco materials that have a processed form, such as processed tobacco stems (e.g., cut-rolled or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, The Design of Cigarettes, 3rd Ed., p. 43 (1990) and *Tobacco Production, Chemistry and Technology*, Davis et al. (Eds.) p. 346 (1999). Other representative tobacco types and types of tobacco blends also are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; U.S. Pat. App. Pub. Nos. 2002/0000235 to Shafer et al.; 2004/0084056 to Lawson et al.; 2004/0255965 to Perfetti et al; 2004/0261807 to Dube et al.; and 2005/0066986 to Nestor et al; PCT Application Pub. No. WO 2002/37990; and Bombick et al., *Fund. Appl. Toxicol.,* 39, p. 11-17 (1997), each of which is incorporated by reference in its entirety.

Tobacco materials employed for manufacture of cigarettes in accordance with the present invention typically have forms, and are used in manners, that are traditional for the manufacture of smoking articles, such as cigarettes. The tobacco normally is used in cut filler form (e.g., shreds or strands of tobacco filler cut into widths of about 1/20 inch to about 1/60 inch, often about 1/25 inch to about 1/50 inch, frequently about 1/30 inch to about 1/45 inch, and in lengths of about 1/4 inch to about 3 inches). One preferred form of cut filler has a cut width of about 40 cuts per inch. Tobacco cut filler is used in a loose form; that is, as a mixture of pieces of tobacco filler.

The amount of tobacco filler normally used within the tobacco rod of a cigarette of the present invention preferably ranges from about 0.6 g to about 1 g. The tobacco filler normally is employed so as to fill the tobacco rod at a packing density of about 100 mg/cm$^3$ to about 300 mg/cm$^3$, and preferably about 150 mg/cm$^3$ to about 275 mg/cm$^3$.

If desired, the tobacco materials of the tobacco rod can also include other components. Other components may include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will readily be apparent to those skilled in the art of cigarette design and manufacture. Most preferably, a person selecting a tobacco, different tobacco types, or tobacco blend(s) makes a choice based upon desired sensory characteristics (such as, for example, smell, taste, appearance). See, e.g., Gutcho, *Tobacco Flavoring Substances and Methods*, Noyes Data Corp. (1972) and Leffingwell et al., *Tobacco Flavoring for Smoking Products* (1972).

It is desirable that the moisture content of the tobacco filler be sufficiently high so that the tobacco filler does not undergo an undesirable degree of degradation during handling and processing associated with cigarette manufacture in accordance with the present invention. It also is desirable that the moisture content of the tobacco filler not be so high that the tobacco filler would exhibit undesirable clumping during handling and processing associated with cigarette manufacture in accordance with the present invention. Preferably, cigarettes are manufactured using tobacco filler having a moisture content of about 12 weight percent to about 13 weight percent. Tobacco filler most preferably is purchased immediately prior to use, and stored and handled in a manner such that moisture is not lost. For example, tobacco filler can be stored in sealed plastic bags, in sealed metal drums, or the like. Typically, for normal situations of tobacco filler handling, tobacco filler can be shipped, handled and stored in sealed containers or plastic bags in amounts of about 5 kilograms.

Tobacco filler can be provided using techniques familiar in the art of tobacco blend formulation and preparation. Tobacco filler can be provided using blending drums, air transport devices, or other suitable means that provides adequate physical mixing of pieces of tobacco filler material. It is highly desirable that the tobacco filler, whether as single strain or blended form, have the form of a consistent mixture in terms of distribution of particle size, density of components and composition of components.

A small lot of cigarettes can be manufactured in accordance with the present invention as described above during a relatively short time period. Typically, for a lot of cigarettes numbering approximately twenty, an appropriate amount of tobacco filler is selected, optionally blended—if multiple tobacco types are selected and desired to be blended—and loaded into a cigarette-making machine. Approximately twenty pre-formed tubular wrapper portions that have been loaded within a cartridge are introduced to the cigarette-making machine, and those wrapper portions within the cartridge are loaded with tobacco filler (preferably compressed from loose tobacco, or provided as pre-formed tobacco cartridges) such that approximately twenty finished cigarettes are be manufactured. Excess tobacco filler can be trimmed from those cigarettes if necessary, and those cigarettes can be packaged. All of the foregoing, can be carried out in less than about three minutes, and most preferably can be carried out in less than about two minutes.

A tobacco rod in a cigarette of the present invention preferably exhibits good firmness and good integrity. Specifically, when measured at 76° F. and 60 percent relative humidity using a Cigarette Firmness Tester Model No. CFTA supplied by Fairchild Industries, Winston-Salem, N.C., typical rods of 24.5 mm circumference and made by a conventional high-speed cigarette-making machine yield firmness values of about 2 to about 7 units. See, e.g., U.S. Pat. No. 4,962,773 to White et al. at col. 5, lines 10-24. Cigarettes manufactured in accordance with the present invention typically are firmer than comparable cigarettes (in terms of comparable component materials, sizes, formats and weights) that are manufactured using conventional automated cigarette manufacturing techniques, such as the type of cigarette-manufacturing machine available as "Protos" from Hauni-Werke Korber & Co. KG. For example, cigarettes manufactured in accordance with the present invention typically are firmer than comparable cigarettes manufactured using a "Protos"-type of cigarette-manufacturing machine by as much as about 5 to about 7 units.

The selection of a particular filter element, including or in addition to a desired degree of air dilution, will be readily apparent to those skilled in the art of cigarette design and manufacture. Properties such as the composition and size of the filter element, and the format and configuration of the filter element, can be a matter of design choice. Preferred filter elements are composed of plasticized cellulose acetate tow. Filter elements also can be composed of materials such as polypropylene tow, gathered polypropylene web, gathered cellulose acetate web or gathered paper. Filter elements can be segmented in nature. Filter elements can incorporate flavors, flavored pellets, breakable capsules, resin particles, activated carbon particles, and the like. Preformed tubular wrapping portions incorporating filter elements containing volatile flavoring agents can be used promptly after production, or stored in sealed containers until use is desired.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 70 mm and about 180, more preferably between about 80 mm to about 150 mm, water pressure drop at 17.5 cc/sec. air flow. Typically, pressure drop values of cigarettes are measured using a "Filtrona Filter Test Station" (CTS Series) available from Filtrona Instruments and Automation Ltd.

Preferably, each tobacco rod is uniformly filled with tobacco filler. That is, it is highly preferred that each tobacco rod of each cigarette of the present invention (i) include a sufficient amount of tobacco filler, (ii) not contain tobacco fines that fall from the cigarette, (iii) not include what can be characterized as a "loose end," (iv) have good integrity throughout, and (v) not include low density or void regions.

Preferably, cigarettes are manufactured such that substantially all of the cigarettes within a lot are of consistent quality. It is highly preferred that cigarettes of a particular lot are comparable to one another in terms of appearance, size, shape, component materials, weight, tobacco filler particle size distribution, tobacco rod firmness, smoking properties, puff count, smoke yield, and the like. Preferred cigarettes within a lot each incorporate tobacco filler from a comparable source, and the weight of tobacco filler within each cigarette differs by not more that 10 percent, more preferably by not more than about 5 percent, and most preferably by not more than about 2.5 percent. In a preferred cigarette-making operation using each of the above-described devices, an operator never touches the tubular wrappers directly with her hands. This preferred mode of operation prevents moisture, skin oils, or other materials on the operator's hands from soiling or marring the aesthetic appearance of the tubular wrappers.

In another aspect, the invention includes a method comprising the steps of: providing a selection of tobacco appropriate for use in cigarettes; allowing a customer to select a tobacco or blend of several tobaccos; assembling the selected tobacco or blend of tobaccos substantially simultaneously into a plurality of cigarettes having substantially consistent quality (including at least consistent density and tobacco mass); and providing at least some of the plurality of cigarettes to the customer. The method may further include packaging the plurality of cigarettes. In an alternative embodiment of the method, the allowing step includes allowing a customer to select a plurality of tobaccos or a plurality of tobacco blends, and the assembling step includes assembling a plurality of cigarettes wherein one or more of the plurality of cigarettes includes a different tobacco and/or blend than other (s) in the plurality of cigarettes. In another alternative embodiment of the method, the selected tobacco or blend of tobaccos is provided in the form of tobacco cartridges that may be assembled into cigarettes using, for example, a cigarette making apparatus such as is described with reference to FIGS. 22-26.

A cigarette making device of the present invention may be incorporated within a tobacco specialty retail shop or store. That is, at least one such device may be on prominent display within the premises of in a retail establishment specializing in high quality or premium tobacco products. Such a shop or store may have a name that corresponds to the brand name of tobacco products available for sale within that shop or store. The shop or store preferably includes an inviting atmosphere, comfortable lounge areas or appropriate places to sit and enjoy the smoking of tobacco products, a high quality air handling or air conditioning system, and locations to purchase tobacco products. A customer within such a shop or store can talk with a tobacconist about the cigarettes that are manufactured in that retail establishment. The packaging, filter materials, cigarette paper materials, tobacco components (including the selection of tobacco types and grade, tobacco blends, and casing and top dressing components) can be high quality in terms of sensory properties and appearance. Locating a cigarette making device within such a shop or store allows the customer within such an establishment to experience the manufacture of cigarettes, and enjoy cigarettes that are freshly made in his/her presence. For example, that customer can smell the aroma of different tobaccos within the store, and can view the manufacture of cigarettes expressly for him/her. In this environment, using multi-sensory inputs (e.g., sight, smell), the customer can make an informed decision on his/her selection of different tobaccos and/or tobacco blends to be loaded into a cigarette making apparatus to manufacture cigarettes in his/her presence. Thus, the methods and devices embodied in the present invention may be utilized in a retail setting that provides a customer with an aesthetic experience and an individually selected product.

It is intended that the foregoing detailed description be regarded as illustrative rather than limiting. It should be understood that the following claims, including all equivalents, are intended to define the spirit and scope of this invention.

We claim:

1. A device for manufacturing cigarettes from pre-formed tobacco cartridges and pre-formed tubular wrapping portions, the device comprising:

a tobacco cartridge delivery hopper, said hopper comprising a plurality of substantially parallel chambers open at top and bottom;

a plurality of receptacles adjacent the plurality of substantially parallel chambers and configured to receive tobacco cartridges therefrom, the receptacles comprising means for adjusting the shape of the pre-formed tobacco cartridge;

a wrapper-holding cartridge adjacent the plurality of receptacles, the wrapper-holding cartridge configured for supporting a plurality of pre-formed tubular wrapping portions, each wrapping portion having a generally hollow region at one end for receiving tobacco filler, and each of a predetermined number of the wrapping portions being aligned with one of the plurality of receptacles; and an insertion mechanism adjacent the receptacles and configured for simultaneously moving a pre-formed tobacco cartridge from each receptacle into the hollow region of each of the predetermined number of wrapping portions.

2. The device of claim 1 wherein the insertion mechanism comprises means for delivering a tobacco cartridge from a receptacle into the hollow region of a tubular wrapping portion.

3. The device of claim 2 wherein the means for delivering a tobacco cartridge comprises at least one elongated, longitudally reciprocal member.

4. The device of claim 1 wherein the plurality number of receptacles is five.

5. The device of claim 1 wherein the plurality of receptacles comprises a first number of receptacles, and wherein the wrapper-holding cartridge includes a plurality of surfaces for supporting at least the same first number of pre-formed tubular wrapping portions.

6. The device of claim 5 wherein the first number of receptacles is five, and the wrapper-holding cartridge includes a plurality of surfaces for supporting at least ten pre-formed tubular wrapping portions.

7. The device of claim 5 wherein the first number of receptacles is at least two, and the wrapper-holding cartridge includes a plurality of surfaces for supporting at least ten pre-formed tubular wrapping portions.

8. The device of claim 5 wherein the first number of receptacles is at least four, and the wrapper-holding cartridge includes a plurality of surfaces for supporting at least twenty pre-formed tubular wrapping portions.

9. The device of claim 5 wherein the first number of receptacles does not exceed five, and the wrapper-holding cartridge includes a plurality of surfaces for supporting no more than twenty pre-formed tubular wrapping portions.

10. The device of claim 5 wherein the first number of receptacles is at least five, and the wrapper-holding cartridge includes a plurality of surfaces for supporting no more than forty pre-formed tubular wrapping portions.

11. The device of claim 1 wherein the wrapper-holding cartridge is movable relative to the device.

12. A device for manufacturing cigarettes from pre-formed tobacco charges and pre-formed tubular wrapping portions, the device comprising:

a hopper comprising a plurality of passageways for passage of pre-formed tobacco charges;

a corresponding plurality of receptacles configured for receiving the pre-formed tobacco charges from each of the plurality of passageways, the receptacles comprising means for adjusting the shape of the pre-formed tobacco cartridge;

a wrapper-holding cartridge configured to support a plurality of pre-formed tubular wrappers, each wrapper including a hollow region at one end configured for receiving a pre-formed tobacco charge;

a support configured for positioning the wrapper-holding cartridge adjacent the receptacles such that at least a pre-determined number of the pre-formed tubular wrappers are aligned with and adjacent to a corresponding predetermined number of the receptacles;

means for providing a controlled number of pre-formed tobacco charges to each receptacle; and an insertion mechanism configured for moving the pre-formed tobacco charges from the receptacles into the hollow region of each pre-formed tubular wrapper aligned adjacent thereto, the insertion mechanism comprising an actuation handle and at least one elongate member in mechanical communication with one of the receptacles.

13. The device of claim 12 wherein the plurality of receptacles comprises a first number of receptacles, each configured to receive one pre-formed tobacco charge at a time, and wherein the wrapper-holding cartridge includes a plurality of surfaces configured to support at least the same first number of pre-formed tubular wrapping portions.

14. The device of claim 12 wherein the wrapper-holding cartridge is movable relative to the support.

15. The device of claim 13 including at least five receptacles each configured for receiving a pre-formed tobacco charge, and at least five pre-formed tubular wrapping portions supported by the wrapper-holding cartridge.

16. The device of claim 12 wherein the plurality of receptacles comprises a first number of receptacles and wherein the wrapper-holding cartridge includes a plurality of surfaces configured to support greater than the first number of pre-formed tubular wrappers.

17. The device of claim 16 wherein the first number of receptacles is five, and the wrapper-holding cartridge includes a plurality of surfaces configured to support at least ten pre-formed tubular wrappers.

18. The device of claim 16 wherein the first number of receptacles is at least two, and the wrapper-holding cartridge includes a plurality of surfaces configured for supporting at least ten pre-formed tubular wrappers.

19. The device of claim 16 wherein the first number of receptacles is at least four, and the wrapper-holding cartridge includes a plurality of surfaces configured for supporting at least twenty pre-formed tubular wrappers.

20. The device of claim 16 wherein the first number of receptacles does not exceed five, and the wrapper-holding cartridge includes a plurality of surfaces configured for supporting no more than twenty pre-formed tubular wrapping portions.

21. The device of claim 16 wherein the first number of receptacles is at least five, and the wrapper-holding cartridge includes a plurality of surfaces configured for supporting no more than forty pre-formed tubular wrapping portions.

22. The device of claim 12 wherein the wrapper-holding cartridge is removable from the device.

23. The device of claim 12 wherein the at least one elongate member of the insertion mechanism comprises a longitudinally reciprocal member configured for moving the pre-formed tobacco charge from at least one of the receptacles into the hollow region of the tubular wrapper.

24. The device of claim 12, further comprising a plurality of weights adjacent the plurality of passageways, the plurality of weights configured for being moved into the passageways in a manner that aids a movement of the pre-formed tobacco charges from the passageways to the receptacles.

25. The device of claim 12, wherein each passageway of the plurality of passageways is narrower at an end nearer to a corresponding receptacle than at an opposite end.

26. A method for manufacturing cigarettes from a quantity of pre-formed tobacco charges and pre-formed tubular wrappers, the method comprising the steps of:

providing the device of claim 12, introducing at least one pre-formed tobacco charge into each of the passageways such that at least one pre-formed tobacco charge enters each of the plurality of receptacles;

providing the plurality of pre-formed tubular wrappers, each wrapper including a hollow region at one end, each pre-formed tubular wrapper being supported by the wrapper-holding cartridge;

positioning the wrapper-holding cartridge on the support and adjacent the receptacles such that at least a predetermined number of the pre-formed tubular wrappers is aligned with and adjacent to a corresponding predetermined number of the plurality of receptacles; and actuating the insertion mechanism in a manner that moves each pre-formed tobacco charge from each receptacle into the hollow region of each pre-formed tubular wrapper aligned adjacent thereto.

27. A device for manufacturing cigarettes comprising:

a tobacco delivery hopper, said hopper comprising a plurality of receptacles;

the plurality of receptacles configured for receiving pre-formed charges of tobacco, the receptacles comprising means for adjusting the shape of the pre-formed tobacco cartridge;

a plurality of slidable plunger rods, each rod positioned for sliding movement through each of the plurality of receptacles; and a wrapper-holding cartridge comprising a generally rectangular platform; said wrapper-holding cartridge configured to support a plurality of pre-formed tubular wrappers; the such that at least two of the tubular wrappers are positioned immediately adjacent an end of a corresponding receptacle, wherein, upon a simultaneous sliding movement of the plunger rods through the receptacles, pre-formed charges of tobacco from the receptacles are substantially simultaneously received into each of the two or more tubular wrappers from the corresponding receptacle.

28. The device of claim 27, comprising about 2 to about 40 receptacles.

29. The device of claim 27, comprising at least 2 receptacles and at least 2 plunger rods.

30. The device of claim 27, comprising at least 10 receptacles and at least 10 plunger rods.

31. The device of claim 27, comprising at least 20 receptacles and at least 20 plunger rods.

32. The device of claim 27, wherein the wrapper-holding cartridge comprises a plurality of parallel surface grooves, each groove sized for supporting one tubular wrapper.

33. A device for manufacturing cigarettes from tobacco filler and pre-formed tubular wrapping portions, the device comprising:

a tobacco delivery hopper, said hopper comprising plurality of substantially parallel chambers open at top and bottom;

a plurality of receptacles adjacent the plurality of substantially parallel chambers and configured to receive tobacco therefrom, the receptacles comprising means for adjusting the shape of the tobacco;

a moveable wrapper-holding cartridge adjacent the plurality of receptacles, the wrapper-holding cartridge configured for supporting a plurality of pre-formed tubular wrapping portions, each of a predetermined number of the wrapping portions being aligned with one of the plurality of receptacles; and an insertion mechanism configured for moving tobacco from each receptacle into the hollow region of each of the predetermined number of the wrapping portions.

34. A method for making cigarettes, the method comprising the steps of:

providing the device of claim 33;

providing tobacco into the tobacco delivery hopper;

moving the tobacco from the tobacco delivery hopper to the plurality of receptacles;

providing pre-formed tubular wrapping portions upon the wrapper-holding cartridge, each wrapping portion having a hollow region at one end for receiving tobacco; and moving tobacco from the receptacles into the pre-formed tubular wrapping portions.

35. The method of claim 34, wherein the tobacco is provided as loose tobacco.

36. The method of claim 35, wherein the device further comprises means for compressing of the tobacco into a cylindrical charge of tobacco; and wherein the step of moving tobacco from the tobacco delivery hopper to the plurality of receptacles further comprises a step of actuating the compressing means to compress the tobacco in each receptacle into a generally cylindrical charge.

37. The method of claim 34, wherein the tobacco is provided as a pre-formed cartridge of tobacco comprising a generally cylindrical tobacco charge circumscribed by a wrapping material.

* * * * *